US012157509B2

(12) United States Patent
Vujanic et al.

(10) Patent No.: US 12,157,509 B2
(45) Date of Patent: Dec. 3, 2024

(54) METHOD AND APPARATUS FOR OPERATION OF RAILWAY SYSTEMS

(71) Applicant: Technological Resources Pty. Limited, Red Hill (AU)

(72) Inventors: Robin Vujanic, Red Hill (AU); Andrew John Hill, Red Hill (AU); Shaun Thomas Robertson, Red Hill (AU)

(73) Assignee: TECHNOLOGICAL RESOURCES PTY. LIMITED, Red Hill (AU)

( * ) Notice: Subject to any disclaimer, the term of this patent is extended or adjusted under 35 U.S.C. 154(b) by 327 days.

(21) Appl. No.: 17/642,516

(22) PCT Filed: Sep. 11, 2020

(86) PCT No.: PCT/AU2020/050979
§ 371 (c)(1),
(2) Date: Mar. 11, 2022

(87) PCT Pub. No.: WO2021/046619
PCT Pub. Date: Mar. 18, 2021

(65) Prior Publication Data

US 2022/0348242 A1 Nov. 3, 2022

(30) Foreign Application Priority Data

Sep. 13, 2019 (AU) ..... 2019903427

(51) Int. Cl.
*B61L 27/12* (2022.01)
*B61L 27/16* (2022.01)
(Continued)

(52) U.S. Cl.
CPC ..... *B61L 27/12* (2022.01); *B61L 27/16* (2022.01); *B61L 27/20* (2022.01); *B61L 27/60* (2022.01); *B61L 27/70* (2022.01); *B61L 2201/00* (2013.01)

(58) Field of Classification Search
CPC ..... B61L 27/12; B61L 27/16; B61L 27/20; B61L 27/60; B61L 27/70; B61L 2201/00
See application file for complete search history.

(56) References Cited

U.S. PATENT DOCUMENTS 6,135,396 A 10/2000 Whitfield et al.
6,546,371 B1 4/2003 Doner
(Continued)

FOREIGN PATENT DOCUMENTS

EP 3141451 A1 3/2017
KR 20150035303 A 4/2015
KR 20180049673 A 5/2018

OTHER PUBLICATIONS

Dec. 13, 2022—(EP) Search Report—App 20863028.5.
Jan. 5, 2021—(WO) International Search Report and Written Opinion—App PCT/AU2020/050979.

*Primary Examiner* — Russell Frejd
*Assistant Examiner* — Brittany Renee Peko
(74) *Attorney, Agent, or Firm* — Banner & Witcoff, Ltd.

(57) ABSTRACT

A method is provided for operating a railway network having a number of trains, the method comprises operating a scheduling machine that is in communication with the railway network over a data communication system, to receive time separated state data defining states of the railway network at respective times. The scheduling machine accesses a model of the railway network that is stored in an electronic data source. The model defines locations in the railway network that allows for passing of trains and paths for journeys of each of the trains. The method includes operating the scheduling machine to apply the state data to the model to determine, at each of the respective times, controls associated with each trains' path for each of the trains. The scheduling machine is operated to determine the controls by optimizing an objective function for the trains, such as minimizing total travel time of the trains, taking into account the locations in the network,
(Continued)

positions of the trains and paths of each of the trains. The controls are transmitted, via the data communication system, to control movement of the trains, for example by operation of railway network switches (points) and signal lights, through the railway network based on the controls.

21 Claims, 32 Drawing Sheets

(51) Int. Cl.

| | |
|---|---|
| ***B61L 27/20*** | (2022.01) |
| ***B61L 27/60*** | (2022.01) |
| ***B61L 27/70*** | (2022.01) |

(56) References Cited

U.S. PATENT DOCUMENTS

| | | | | |
|---|---|---|---|---|
| 7,092,894 | B1 | 8/2006 | Crone | |
| 7,340,328 | B2 | 3/2008 | Matheson et al. | |
| 8,612,071 | B2 | 12/2013 | Chun | |
| 9,073,562 | B2 * | 7/2015 | Bollapragada | B60L 27/0016 703/8 |
| 2007/0014532 | A1 * | 1/2007 | Parisi | H04N 5/91 386/68 |
| 2013/0284859 | A1 * | 10/2013 | Polivka | B61L 27/0055 264/34 R |
| 2020/0120510 | A1 * | 4/2020 | Gresset | H04W 16/14 |

* cited by examiner

METHOD AND APPARATUS FOR OPERATION OF RAILWAY SYSTEMS

CROSS REFERENCE TO RELATED APPLICATIONS

The present application is a U.S. National Phase filing of International Application No. PCT/AU2020/050979, filed on Sep. 11, 2020, designating the United States of America, which claims priority to Australian Patent Application No. 2019903427, filed on Sep. 13, 2019, and the present application claims priority to and the benefit of the above-identified applications, the disclosures of which are incorporated by reference herein in their entireties.

TECHNICAL FIELD

The present invention concerns methods and apparatus for operating railways in order to adjust train schedules for purposes such as minimizing travel times of trains, minimizing deviations from a given timetable or allocating precedence to trains, whilst ensuring safety and avoiding deadlocks.

BACKGROUND ART

Any references to methods, apparatus or documents of the prior art are not to be taken as constituting any evidence or admission that they formed, or form part of the common general knowledge.

Railway systems comprise rail networks that include interconnected blocks of rails and rolling stock such as locomotives and carriages that ride along the rails. For example, FIG. 1 is a side view of a train 1 travelling over rails 3. FIG. 2 indicates various internal assemblies of locomotive 5 of train T1.

FIG. 3 provides side views of trains 1*a*, . . . , 1*n* in a rail network 21 comprised of rails 3.

The network 21 includes network devices for controlling the paths of trains over the rails and for causing trains to stop and proceed at and from designated positions or "stations" throughout the rail network. Examples of the network devices include visual display signals 9*a*, 9*b* and switches 10*a*, 10*b*, for connecting one block of rail with either of two (or more) other blocks of rails, for example to divert train 1*a* to siding 23. The rail network 21 also includes a data communications system 29 having a data network 31 for transmitting position updates of trains to a central rail network controller 27 and for distributing scheduling data and/or commands for use in controlling the signal indicators 9*a*, 9*b* and switches 10*a*, 10*b* and thus the timing of trains along the rails and the paths taken by the trains. The data communications system 29 includes suitable radio infrastructure including terrestrial radio stations 14 and satellite stations 16.

Train 1*a* is shown in FIG. 3 dwelling at siding 23 of the network 21 and waiting for signal 9*a* to change state from "halt" to "proceed" under command from central controller 27. Whilst train 1*a* waits in the siding 23 the main line 25 is clear for another train 1*a* to pass therealong.

Upon the signal 9 changing state to "proceed" a person operating the locomotive 5 will manipulate control system 11 (FIG. 2) to send suitable signals to the train's propulsion system 13 to propel the train via its engine, transmission and wheels, along the rails 3. Autonomous trains, which do not necessarily have a human driver are also known and in that case the control system 11 is arranged to detect "halt" and "proceed" signals from remote central controller 27, for example via radio communications system 15 and coupled antenna 17. As train 1 proceeds along rails 3 it tracks its position via position tracker 19 (which is for example a geographical positioning system or Global Satellite Navigation System (GNSS)) and relays that position to the remote central controller across the data communications system 29. Alternatively, train position may be tracked by circuits in the tracks 3 that are arranged to determine the presence of a train and relay that information to the central controller 27.

It will be realized that optimizing the scheduling of the journeys of trains along their allocated paths for each journey is important. Optimization is required to minimize the amount of time that a train, such as trains 1*a*, must wait for another train, such as train 1*b*, to be able to pass safely and to avoid deadlocks occurring.

Railway traffic, is usually operated on a rail network according to reference schedules. In some cases, these might be fixed cyclical timetables. In other contexts, such as in freight transport, schedules are usually established some time in advance depending on the availability and delivery requirements of the goods to be transported.

Real time operation of a railway network (or "rail network") as it may be referred to herein) is affected by the presence of disturbances, which manifest themselves as delays or early arrival of trains. These disturbances can originate from a variety of sources including weather conditions, unexpected outages, train driver and passenger behavior, and span a broad range of magnitudes. Consequently, compensating real-time traffic control mechanisms are required to ensure that the railway network is operated correctly and in a manner that minimizes the propagation of these disturbances. The task of making real-time adjustments to the schedule becomes more complicated as railway systems are operated closer to capacity, resulting in complex configurations involving several trains on congested segments of the system that are difficult to resolve optimally manually. At the same time, the propagation of delays is exacerbated in magnitude and extent under the same circumstances. Despite this, a surprising amount of human interaction is still a practical reality for many railway systems [6].

One method that is used for train scheduling is the stringline plot, a prior art example of which is shown in FIG. 4. A stringline plots time along a horizontal axis and track positions in the form of stations or control points (i.e. switching points) along the vertical axis. The horizontal axis of FIG. 4, for example, runs from 5:00 a.m. on a first day until 11:00 a.m. on the following day and depicts movement along a track interconnecting Station 1 ("Stn01") and Station 17 ("Stn17") with fifteen other control points labelled Stn02-Stn016 in between. Within the grid formed by the time and positions, the movements of trains are plotted to form schedules for each train in the form of diagonal lines. As trains move in one direction, for example from Stn17 toward Stn01, the stringline for a train appears as a rightward and upward diagonal.

Trains starting their travel in the opposite direction, i.e. from Stn01 to Stn17, appear on the stringline as a leftward and downward diagonal. Where one train must be sided to await the passage of another, the stringline becomes horizontal as time passes by without movement of the sided train. For example, train 11 was sided at Stn02 for nearly two hours awaiting the passage of the train 99 and train B2.

Similarly train 88 was sided 5 twice, once in Stn02 to wait the passage of train F6 and a second time in Stn05 to await the passage of train G7.

As can be seen in the stringline chart of FIG. 3B, a train can spend a substantial amount of time in sidings (train 88, for example, spent almost two hours of a five-hour trip sitting at sidings).

Clearly it would be advantageous if the timing of the various trains' trips could be altered to achieve different objectives. For example an objective that is often of primary importance is reducing time spent by trains in sidings, which would equate to a reduction in overall length of time needed to take any particular trip thus permitting greater throughput for the railway system and reducing such costs as engine idling, crews, and other time dependent factors.

It is still quite common for humans working in the network controller 27 to construct stringline plots, either entirely manually or with the help of computerized tools for scheduling trains across the railway network. Humans tend to err on the side of caution so that trains may be sided for longer than necessary. Furthermore, constructing a stringline graph for a large railway network with many trains is very demanding and mistakes can occur.

In recent years optimization methods have been used to assist in finding feasible scheduling solutions. However, it has been found that the computational demands for solving the optimization problem for large railway network s with many trains can result in the computer time becoming infeasibly long, even with use of high-speed computer systems.

It is an object of the present invention to provide a method and apparatus for assisting in the scheduling of trains over a rail network that addresses at least one of the problems of the prior art or which is at least a commercially attractive alternative to hitherto known methods and apparatus of the prior art.

SUMMARY OF THE INVENTION

According to a first aspect of the present invention there is provided a railway system comprising:

- a railway network including,
  - a plurality of blocks of rails and a number of trains located thereon;
  - one or more positioning assemblies for determining positions of each train;
- a data communication system for transmitting state data defining states of the railway network at respective times;
- a model of the railway network stored in an electronic data source the model defining locations in the railway network allowing passing of trains and paths for journeys of each of the trains; and
- a scheduling machine in communication with the data communication system for receiving the state data, the scheduling machine including:
  - one or more processors; and
  - an electronic memory in communication with the processors containing instructions for the processors to:
    - access the model of the railway network stored in the electronic data source;
    - apply the state data to the model to determine, at each of the respective times, controls associated with each trains' path for each of the trains;
    - determine the controls by optimizing an objective function for the trains, taking into account said locations in the railway network, positions of the trains and paths of each of the trains; and
    - transmit the controls to the railway network for controlling movement of the trains.

In an embodiment the controls include timings for movements of the trains.

In an embodiment the controls specify positions for the train at the railway network locations.

In an embodiment the controls specify a position comprising a siding at the network location.

In an embodiment the electronic memory contains instructions for the processors to apply control signals based on the controls to traffic controllers of the railway network.

In an embodiment the traffic controllers include signal lights for timing the movement of the trains.

In an embodiment the traffic controllers include switches for directing trains to the positions at the railway network locations.

In an embodiment the electronic memory contains instructions for the processors to transmit a series of train schedules comprising the controls.

In an embodiment the electronic memory contains instructions for the processors to display the train schedules as stringline plots on electronic displays for reference of human operators.

In an embodiment the electronic memory contains instructions for the processors to determine the controls by optimizing an objective function for the trains comprises minimizing total travel time of the trains.

In an embodiment the electronic memory contains instructions for the processors to determine the controls for an optimization horizon, for each train along its path.

In an embodiment the optimization horizon extends to at least one location allowing passing of trains.

In an embodiment the electronic memory contains instructions for the processors to determine said horizon for each train in the system upon determining that the system is in a safe state.

In an embodiment the electronic memory contains instructions for the processors to iteratively extend the optimization horizon for each train in the safe state until it reaches a node of the model, such that the state of the system would be safe if trains transited up to that node from respective current positions thereof.

In an embodiment the electronic memory contains instructions for the processors to extend the optimization horizon for each train until the determined optimization horizon is solvable to obtain a feasible solution for the model.

In an embodiment the electronic memory contains instructions for the processors to determine if the railway network is in a non-deadlocked state.

In an embodiment the electronic memory contains instructions for the processors to apply a time-wise problem decomposition procedure comprising optimizing the objective function by optimizing objective functions for each of a sequence of smaller models for incremental additional portions of time.

In an embodiment the electronic memory contains instructions for the processors to apply a train-wise problem decomposition procedure comprising optimizing the objective function by considering only portions of the number of trains at a time.

In an embodiment the electronic memory contains instructions for the processor to implement an optimization engine for optimizing the objective function for the trains.

In an embodiment the model includes a graph comprised of nodes and edges corresponding to railway network locations and blocks of rails therebetween.

In an embodiment the model defines locations in the railway network allowing passing of trains with nodes including two or more slots for accommodating two or more corresponding trains at the node.

In an embodiment the model further defines locations in the railway network allowing passing of trains with double edges representing double tracks of the railway network.

According to a further aspect of the invention there is provided a method for operating a railway network having a number of trains, the method comprising:

operating a scheduling machine in communication with the railway network over a data communication network to receive time separated state data defining states of the railway network at respective times;

operating the scheduling machine to access a model of the railway network stored in an electronic data source, the model defining locations in the railway network allowing passing of trains and paths for journeys of each of the trains;

operating the scheduling machine to apply the state data to the model to determine, at each of the respective times, controls associated with each trains' path for each of the trains;

wherein the scheduling machine is operated to determine said controls by optimizing an objective function for the trains, taking into account said locations in the railway network, positions of the trains and paths of each of the trains; and transmitting the controls via the data communication network to control movement of the trains through the railway network based on the controls.

In an embodiment the controls include timings for movements of the trains.

In an embodiment the controls include positions for the train at the railway network locations.

In an embodiment the positions for the train at the railway network locations include a siding.

In an embodiment the method includes applying control signals based on the controls to traffic controllers of the railway network.

In an embodiment the traffic controllers include signal lights for timing the movement of the trains.

In an embodiment the traffic controllers include switches for directing trains to the positions at the railway network locations.

In an embodiment the method includes operating the scheduling machine to transmit a series of train schedules comprising the controls.

In an embodiment the method includes displaying the train schedules as stringline plots on electronic displays for reference of human operators.

In an embodiment the method includes operating the scheduling machine to determine said controls by optimizing an objective function for the trains comprises minimizing total travel time of the trains.

In an embodiment the method includes operating the scheduling machine to determine controls for an optimization horizon, for each train along its path.

In an embodiment the optimization horizon extends to at least one railway network location allowing passing of trains.

In an embodiment the method includes determining the optimization horizon for each train in the system upon determining that the system is in a safe state.

In an embodiment the method includes iteratively extending the optimization horizon for each train in the safe state until it reaches a node of the model, such that the state of the system would be safe if trains transited up to that node from respective current positions thereof.

In an embodiment the method includes further extending the optimization horizon for each train until the determined optimization horizon is solvable to obtain a feasible solution for the model.

In an embodiment the method includes operating the scheduling machine to determine if the system is in a non-deadlocked state.

In an embodiment the method includes applying a time-wise problem decomposition procedure comprising optimizing the objective function by optimizing objective functions for each of a sequence of smaller models for incremental additional portions of time.

In an embodiment the method includes applying a train-wise problem decomposition procedure comprising optimizing the objective function by considering only portions of the number of trains at a time.

In an embodiment the method includes optimizing of the objective function for the trains is with an optimization engine of the scheduling machine.

In an embodiment of the method the model includes a graph comprised of nodes and edges.

In an embodiment the model defines locations in the railway network allowing passing of trains with nodes including two or more slots for accommodating two or more corresponding trains at the node.

In an embodiment the model further defines locations in the railway network allowing passing of trains with double edges representing double tracks of the network.

According to a further aspect there is provided a method for producing controls, such as timings for movement, for trains of a railway network including processing information defining a state of the railway network relative to a model of the network including paths for each of the trains and optimizing an objective function defining a desired outcome for movements of the trains across the network, wherein an optimal solution of the objective function results in values for the controls.

According to another aspect of the invention there is provided a machine configured to perform the method for producing controls for trains.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

1. Overview and Scheduling Machine

Figure 1:
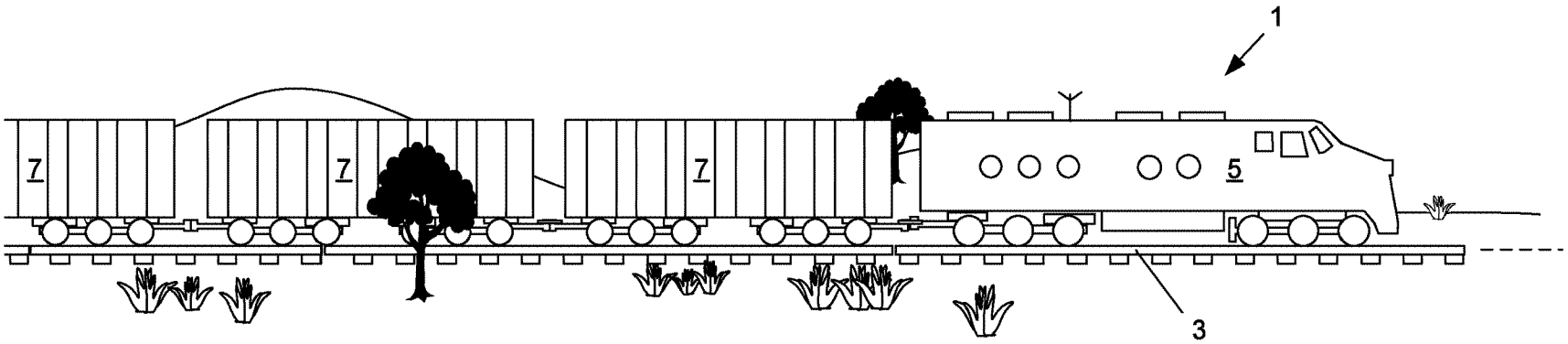
FIG. 1 depicts a train in use.
Figure 2:
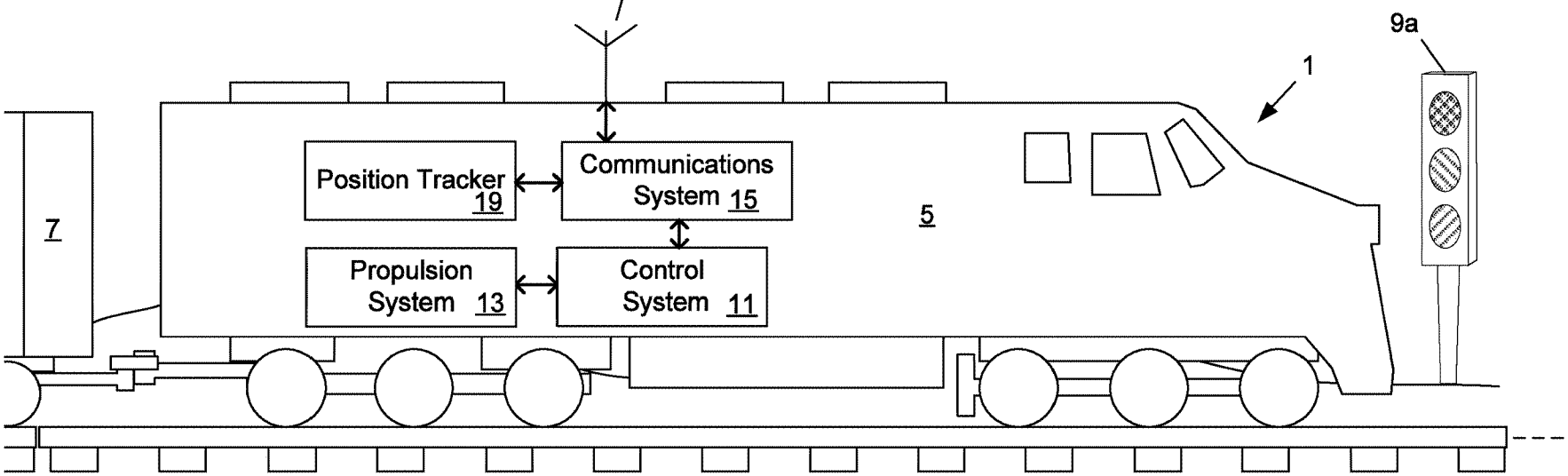
FIG. 2 depicts a train in use revealing internal assemblies of a locomotive of the train.
Figure 5:
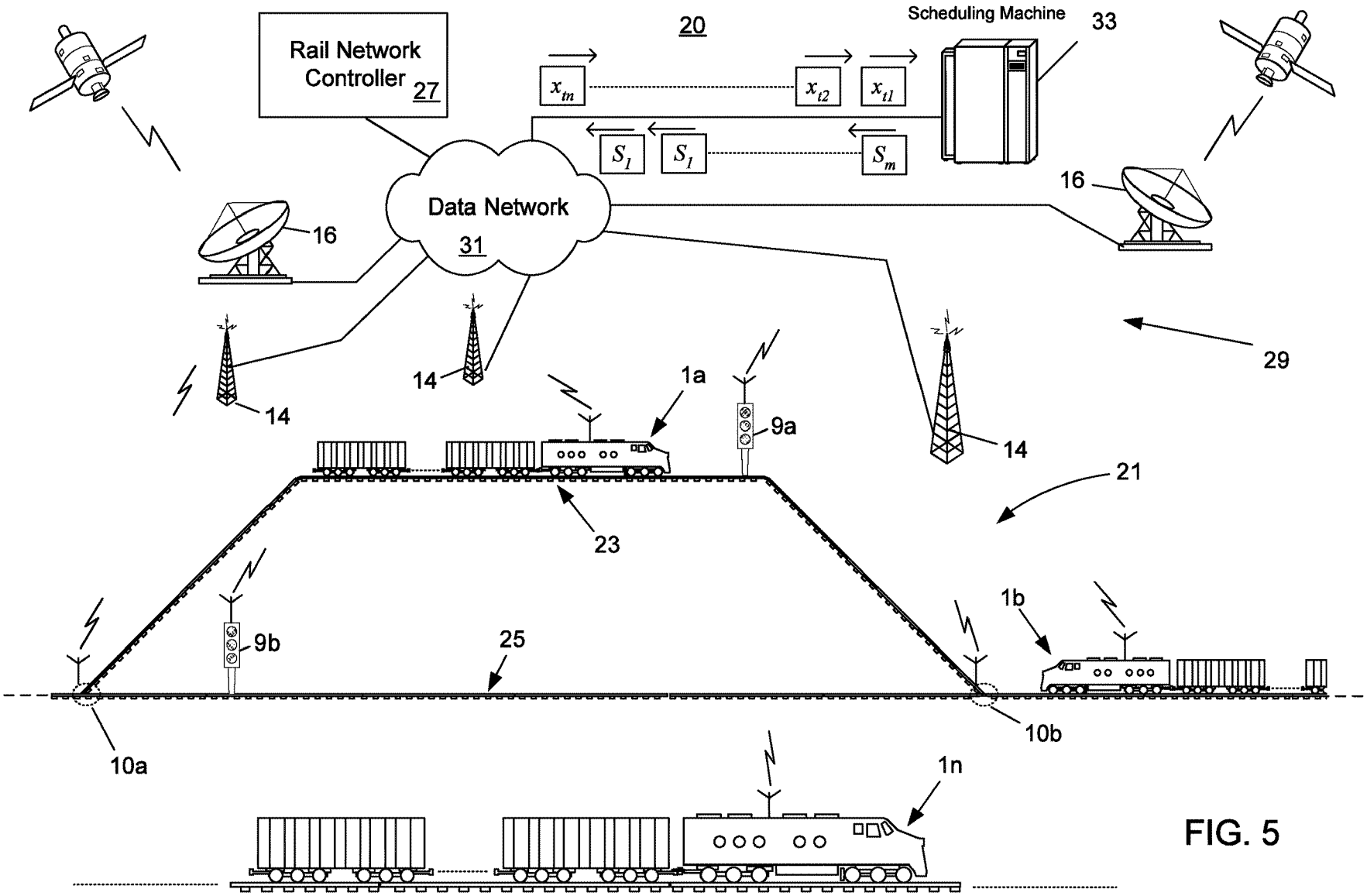
FIG. 5 is a block diagram of a railway system according to an embodiment of the present invention in use.

Referring now to FIG. 5 there is depicted, in one embodiment, a railway system 20. The railway system 20 includes a railway network 21 that includes a plurality of blocks of rails such as main line 25 and siding 23 and a number of trains 1*a*, . . . , 1*n* located on the blocks of rails. The network also includes one or more positioning assemblies, such as position tracker 19 (FIG. 2) for determining positions of each train. Railway system 20 includes a data communication systems 29 for transmitting state data, such as state data reports xt1, . . . , xtn defining states of the railway network 21 at respective times. The railway system also includes a model 55 of the railway network 21. As will be discussed, the model 55 (FIG. 6) is stored in an electronic data source in the form of database 42. The model 55 defines locations in the network 21 allowing passing of trains such as sidings, and double tracks. The model also contains information as to paths for journeys of each of the trains, for example journeys for them to carry out haulage assignments. Railway system 20 also includes a scheduling machine 33 that is in communication with the data communication system 29 for receiving the state data. As will be discussed in more detail shortly, the scheduling machine 33 includes one or more processors 35 and an electronic memory 47 in communication with the processors 35.

The electronic memory contains instructions for the processors 35 to effect a number of tasks as follows:

- access the model 55 of the railway network 21 stored in the electronic data source 42;
- apply the state data xt1, . . . , xtn to the model 44 to determine, at each of the respective times of the state data, controls associated with each trains' path for each of the trains 1*a*, . . . , 1*n*. (For example the controls may include one or more of the time at which a train leaves a network location, the blocks of tracks that the train is to travel over in its path, the position that the train is to assume at a given network location, e.g. a siding or a main line);
- determine the controls by optimizing an objective function, for example one possible objective function is to minimize the sum of the trains' arrival times, taking into account said locations in the network, positions of the trains and paths of each of the trains; and
- transmit the controls to the railway network, for example as schedules S1, . . . , Sm (FIG. 5) for controlling movement of the trains. For example the controls may be transmitted in the schedules to the Rail Network Controller 27 where they are for example displayed as stringlines for human operators to then issue control signals to the trains and network traffic controllers such as switches 10*a*, 10*b* and signal lights 9*a*, 9*b*. Alternatively, or in addition, control signals 24 (FIGS. 5A, 5B) based on the controls generated by the scheduling machine 33 may be applied to the network traffic controllers, e.g. switches 10*a*, 10*b* via control line 24*a* which is coupled to the data network 31.

As previously mentioned, according to a preferred embodiment of the present invention a specially programmed computational device in the form of scheduling machine 33 is provided that is in data communication with the Rail Network Controller 27 via data communication system 29 including data network 31. As will be discussed, scheduling machine 33 accesses a graph 55, comprised of nodes interconnected by edges that models the railway network.

The scheduling machine 33 receives time separated network state data in the form of state data reports $xt_1, \ldots, xt_n$ from the rail network controller 27 via the data communications system 29. Scheduling machine 33 is configured by instructions comprising a software product 40 that it runs to implement a method for processing the network state snapshots to generate time separated schedules $S_1, \ldots, S_m$ for trains running on the network 21. The rail network controller 27 uses the time separated schedules $S_1, \ldots, S_m$ to operate traffic controllers such as switches, e.g. switches 10*a*, 10*b* and signaling apparatus, e.g. signal lights 9*a*, 9*b* of the network in order to dynamically manage rail traffic across the network in accordance with the schedules $S_1, \ldots, S_m$.

Figure 5A:
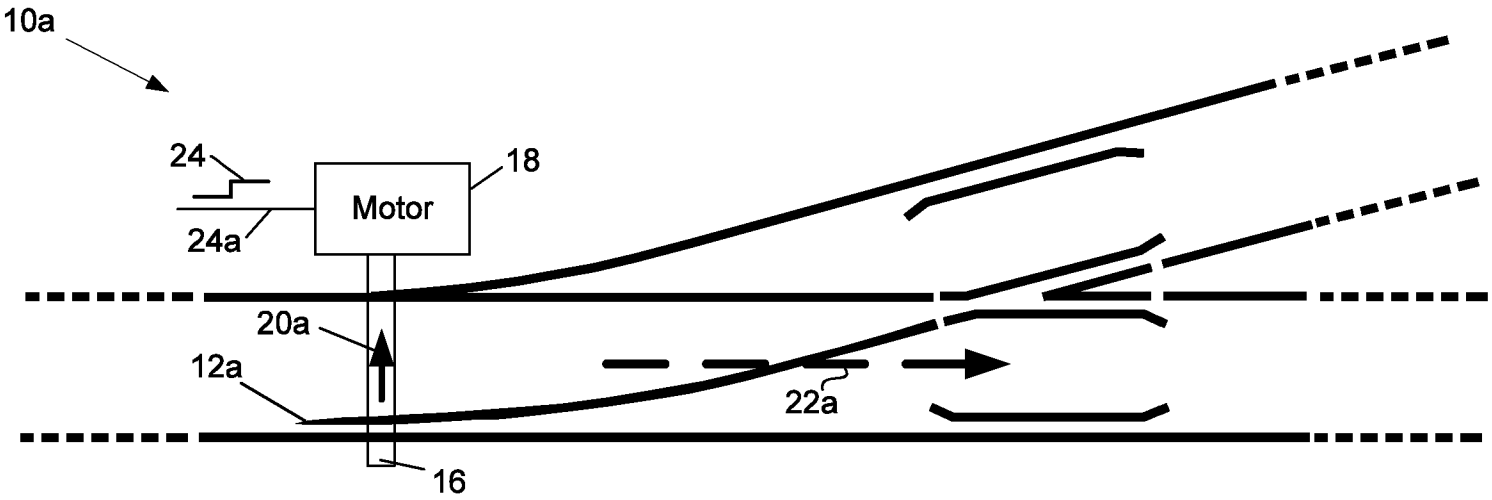
FIG. 5A is a plan view of a traffic controller in the form of a switch for selectively directing a train along one of two paths, shown in a configuration for directing the train along a first path being a main line.
Figure 5B:
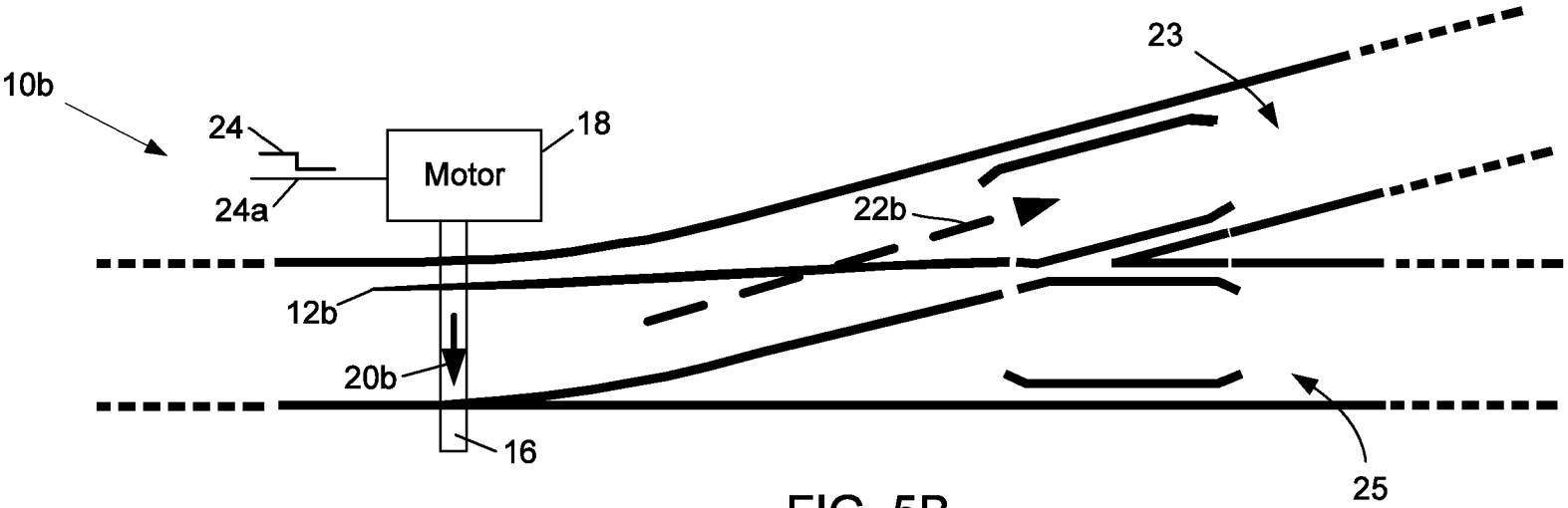
FIG. 5B is a plan view of the switch shown in a further configuration for directing the train along a second path being a siding.

FIG. 5A is a plan view of a railway network traffic controller in the form of the switch 10*a*. Switch 10*a* includes point blades 12*a*, 12*b* which are tied by throw bar 16. The throw bar 16 is coupled to motor 18 for translating the throw bar 16 back and forth as indicated by arrows 20*a*, 20*b* in order to point blades 12*a*, 12*b* simultaneously from the position shown in FIG. 5A to the position shown in FIG. 5B. In the position shown in FIG. 5A the point blades 12*a*, 12*b* directs a train along the main line 25 as indicated by arrow 22*a*. Alternatively, in the position shown in FIG. 5B the switch 10A directs the train along the siding 23 as indicated by arrow 22*b*.

The motor 18 is electrically coupled to the data network 31 of data communications system 29 and so the switch 10*a* can be remotely operated by controls in the form of control signals 24 that are ultimately derived from scheduling information generated by scheduling machine 33. Similarly, signal lights such as lights 9*a*, 9*b* are also remotely controllable. Consequently, by using traffic controllers of the railway network, such as switches 10*a*, 10*b* and signal lights 9*a*, 9*b*, and also be sending commands to the trains, train schedules generated by the scheduling machine 33 are able to be implemented in the railway network.

Figure 6:
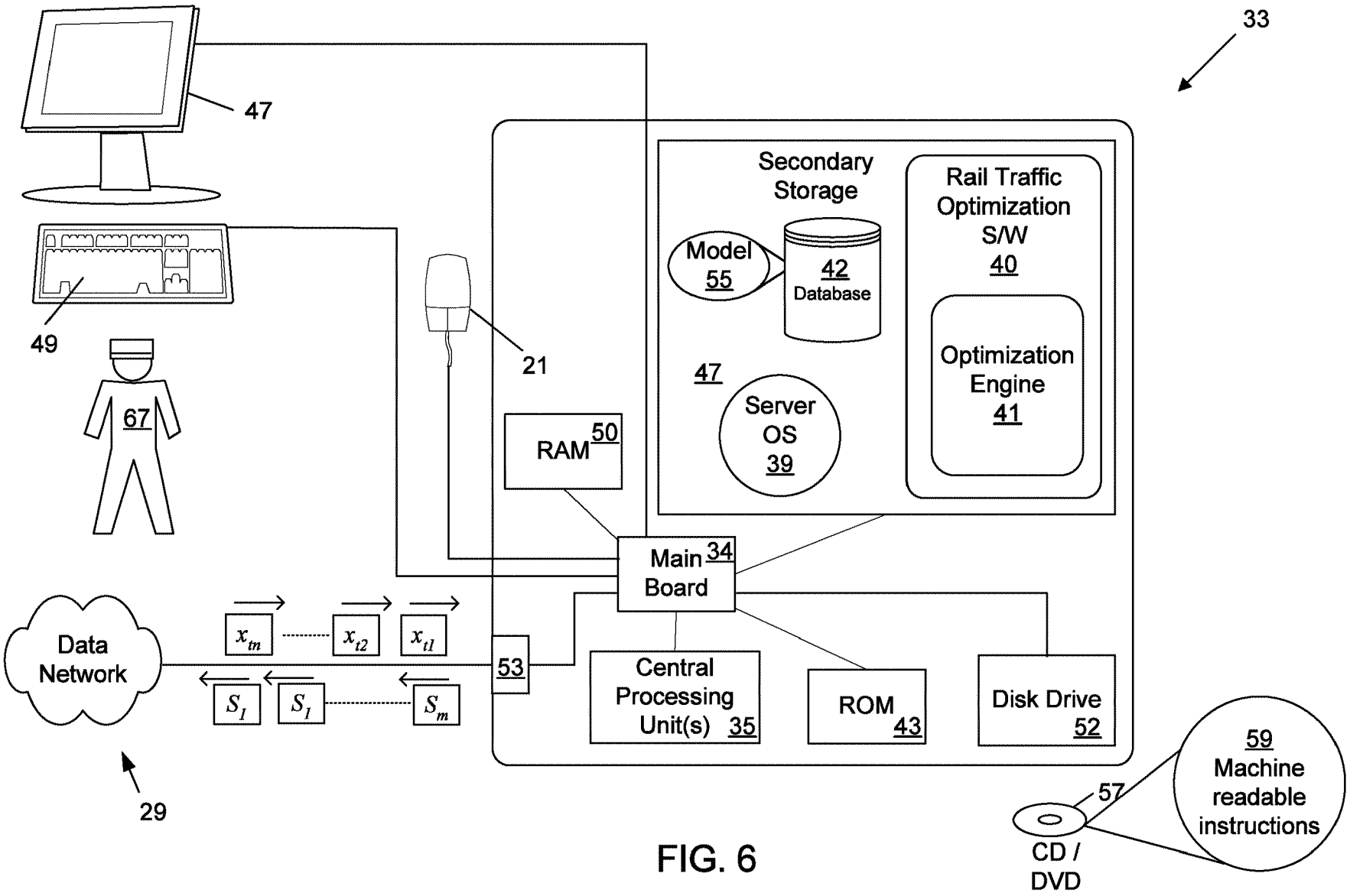
FIG. 6 is a block diagram of a scheduling machine in the form of a specially programmed computational device being a computer server, shown in use.

FIG. 6 comprises a block diagram of one embodiment of the scheduling machine 33. scheduling machine 33 includes a main board 34 which includes circuitry for powering and interfacing to one or more onboard microprocessors 35.

The main board 34 acts as an interface between microprocessors 35 and secondary memory 47. The secondary memory 47 may comprise one or more optical or magnetic, or solid state, drives. The secondary memory 47 stores instructions for an operating system 39. The main board 3 also communicates with random access memory (RAM) 50 and read only memory (ROM) 43. The ROM 43 typically stores instructions for a startup routine, such as a Basic Input Output System (BIOS) which the microprocessor 35 accesses upon start up and which preps the microprocessor 5 for loading of the operating system 39.

The main board 34 also an integrated graphics adapter for driving display 47. The main board 3 will typically include a communications adapter, for example a LAN adaptor or a modem 55, that places the scheduling machine 33 in data communication with data network 29.

An operator 67 of scheduling machine 33 interfaces with it by means of keyboard 49, mouse 21 and display 47.

The operator 67 may operate the operating system 39 to load software product 40. The software product 40 may be provided as tangible, non-transitory, machine readable instructions 59 borne upon a computer readable media such as optical disk 57. Alternatively it might also be downloaded via port 53.

The secondary storage 47, is typically implemented by a magnetic or solid-state data drive and stores the operating system, for example Microsoft Windows Server, and Linux Ubuntu Server are two examples of such an operating system.

The secondary storage 47 also includes a server-side rail traffic scheduling software product 40 according to a preferred embodiment of the present invention which implements a database 42 that is also stored in the secondary storage 47, or at another location accessible to the scheduling machine 33. The database 42 stores the model 55 that is used, in conjunction with the system state data $xt_1, \ldots, xt_n$ by processor 35 under control of software 40 to implement a method for determining optimal rail traffic journeys across the railway network. The database 42 stores the railway network model including data defining edges interconnected by nodes comprising a graph. Scheduling software product 40 includes an optimization engine 41 such as Gurobi Optimizer provided by Gurobi Optimization, LLC of 9450 SW Gemini Dr. #90729, Beaverton, Oregon, 97008-7105, USA; website: www.gurobi.com.

During operation of the scheduling machine 33 the one or more CPUs 35 load the operating system 39 and then load the software 40.

The scheduling machine 33 receives data, for example the network state information $xt_1, \ldots, xt_n$ about the state of the railway network from the data network 29, to which the scheduling machine 33 is connected by means of its data port 53.

In use the scheduling machine 33 is operated by an administrator 67 who is able to log into the scheduling machine interface either directly using mouse 21, keyboard, 49 and display 47, or more usually remotely across network 29. Administrator 67 is able to monitor activity logs and perform various housekeeping functions from time to time in order to keep the scheduling machine 33 operating in an optimal fashion.

It will be realized that scheduling machine 33 is simply one example of a computing environment for executing software 40. Other suitable environments are also possible, for example the software 40 could be executed on a virtual machine in a cloud computing environment.

2. Railway Traffic Optimization Model 2.1. Overview. The Rail Traffic Optimization software 40, stores a model 55 of a railway network, such as network 21, in database 42, or some other datasource that is accessible to scheduling machine 33. Model 55 captures the arrangement of the railway network as a graph.

Figure 7A:
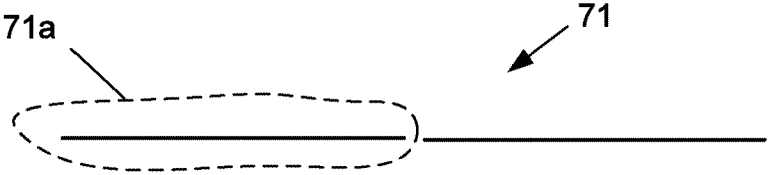
FIGS. 7A, 8A, 9A, depict small railway networks or portions of a railway network.
Figure 7B:
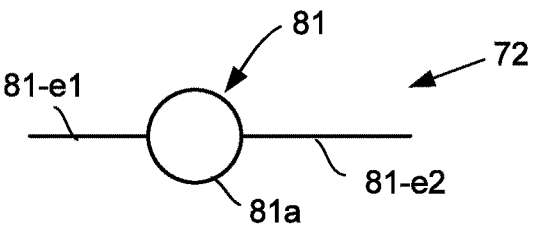
FIGS. 7B, 8B, 9B depict graphs corresponding to the small railway networks.
Figure 8A:
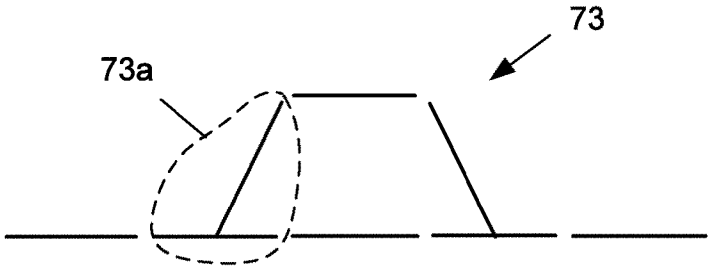
Figure 8B:
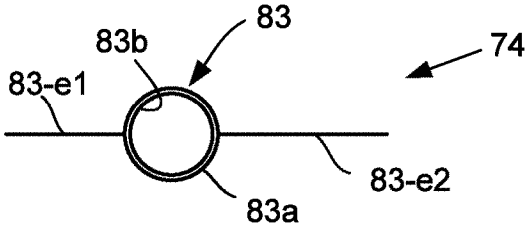
Figure 9A:
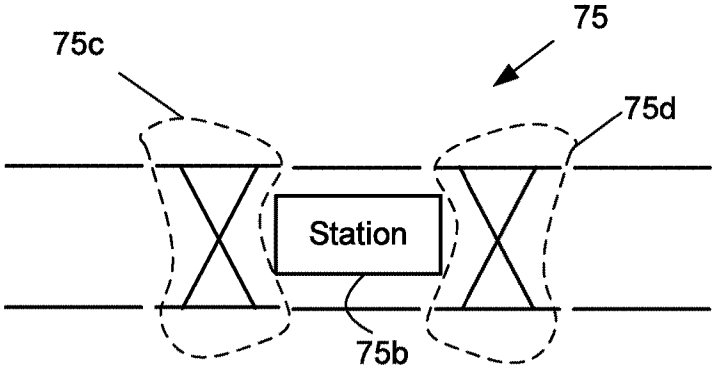
Figure 9B:
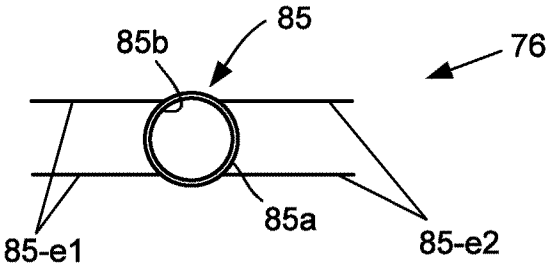

FIGS. 7A, 8A and 9A illustrate simple railway networks 71, 73, 75 and FIGS. 7B, 8B and 9B illustrate corresponding graphs 72, 74, 76 for modelling the network. Nodes 81, 83, 85 within the graphs correspond to stops, stations (including larger terminals, which might be characterized by complex tracks layouts), and sidings on single track lines where, e.g., trains transiting in opposite directions can pass each other, as well as other components (not shown in the figure) such as turnouts. Nodes are characterized by a number of slots which indicates how many trains can be present on the node at the same time. For example, node 81 is shown as a circle with a single line perimeter which means that it has a single slot 81*a*. In contrast, nodes 83 and 85 are represented as circles that each have a double line perimeter wherein each line of the double line indicates a slot 83*a*, 83*b* and 85*a*, 85*b*.

Nodes with more than two slots are also possible depending on the layout of the railway network.

The smallest building unit of a track in the railway network is called a block. One block of each network 71, 73, 75 is identified by a dashed line loop 71*a*, 73*a*, 75*a* in each of FIGS. 7A, 8A and 9A.

The network segment in FIG. 7A has two long consecutive blocks and is modelled in FIG. 7B as a graph portion that has a single node 81 with two single edges 81-*e*1, 81-*e*2 connected to the node 81. The node 81 in FIG. 7B has a single slot 81*a* and thus allows transit of consecutive trains therethrough. FIG. 8A depicts a network segment with six blocks including a passing platform 73*b*. The corresponding graph model in FIG. 8B comprises a node 81 with two slots 83*a*, 83*b* and interconnecting single edges 83-*e*1 and 83-*e*2. FIG. 9A depicts a railway network that includes a station 75*b* with turnout tracks 75*c*, 75*d*. FIG. 9B depicts a graph 76 corresponding to railway network 75 which comprises a node 85 with two slots 85*a*, 85*b*. Node 85 interconnects double edges 85-*e*1 and 85-*e*2.

The movement of trains is modelled to occur in stages. A stage is the movement of a train from a node to the next node. Nodes are connected by edges, which can be single or double. A single edge represents a single line and at any given time only one train can transit over such an edge. A double edge models a double track, which allows the transit of two trains at the same time, as long as they are transiting in opposite directions. Consequently, under normal operating conditions two trains can travel in opposite directions on a double track segment. Nodes in the graph representing the railway network are connected by either single or double edges.

As shown, nodes are also characterized by a number of slots indicating how many trains can be present on the node at the same time. Locations where passing can occur (e.g., sidetracks, stations) can be modelled as nodes with multiple slots and are shown as double (or multiple) circles in the graph. (Models of trains transit based on standard job-shop scheduling essentially assume that all nodes have an infinite number of slots.)

Figure 10A:
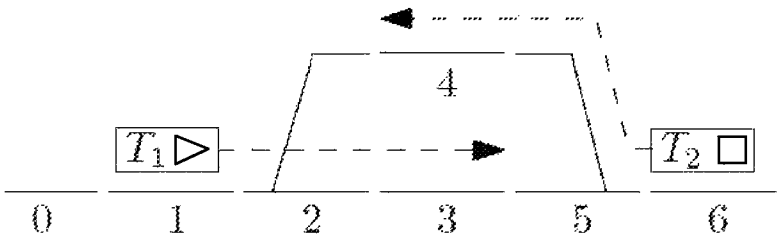
FIG. 10A depicts an example of a model for a railway network.
Figure 10B:
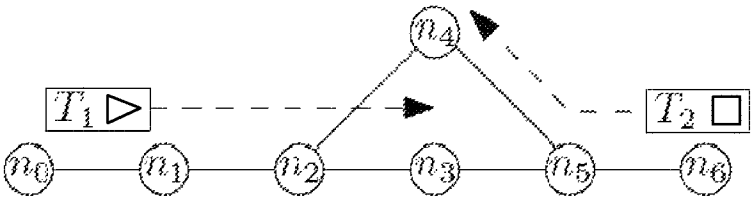
FIG. 10B-10D depict progressively simplified models for the railway network of FIG. 10A.
Figure 10C:
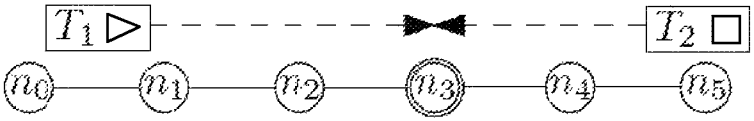
Figure 10D:
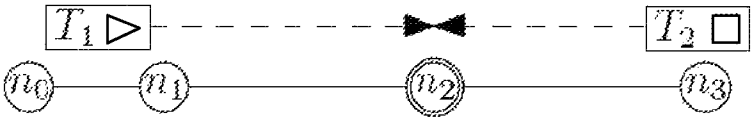

The same railway system can be represented by different graphs, depending on the density of traffic allowed and the desired granularity of the schedules produced. FIG. 10*a* illustrates a specific example entailing two trains T1, T2 and 7 blocks, numbered 0, . . . , 6 arranged to form a meeting point. In FIG. 10*b*, the transit over each block is considered a valid stage, and the siding is mapped into two separate nodes n3, n4. The same siding can be represented as a node with two slots, i.e. node n3 as shown in FIG. 10*c*. The graph in FIG. 10*d* is a further simplification of that of FIG. 10*c* in which nodes $n_2$ and $n_5$ are removed, indicating that schedules should entail train stops on the turnout blocks 2 and 5 of FIG. 10*a*. This reduction in nodes might be necessary when, for instance, trains are longer than a single block. In the illustration of FIG. 10*a*, if $T_1$ is longer than the turnout block 2, when it transits over it impedes travel on block 1 by other trains, as its back is still occupying this preceding block. This is due to circuitry that impedes the presence of more than one train on any block. That is, the railway network, e.g. railway network 21 of FIG. 5 includes circuitry, such as switches 10, that is arranged to prevent the transit of more than one train over a single block at any given time.

Nodes in a model of a network represent the completion of processes rather than physical locations. In FIG. 10*a*, train $T_1$ is currently transiting over block 1 (the fact that it is moving is indicated by the white forward triangle "play" sign), while $T_2$ has completed its transit over block 6 and it has stopped (indicated by the square "stop" sign), with its head at the end of the block. This is mapped into the graph on FIG. 10*b* as $T_1$ transiting on the edge between $n_0$ and $n_1$; arrival at node $n_1$ maps to the event that the train has completed transiting on its current block (its head reached the end of the block). Suppose $T_2$ reaches the sidetrack first (block 4), and stops until $T_1$'s head reaches the end of block 3 before departing. At that instant, both will be represented as being on the same (double slotted) node n3 although their physical location will be different: $T_1$ will be on block 3 with its head located at the right end of that block, while $T_2$ will be on block 4 with its head at the left end of block 4.

It will be realised that the visual representation of nodes and edges interconnected as a graph is primarily for ease of human comprehension. The graph is used to determine the sequence of nodes from the current location of the train to its destination and need not be visually displayed, e.g. on display 47. The rail traffic optimization software 40 only needs to be able to retrieve the ordered list of nodes (and edges) that the train needs to occupy as it progresses along its path, and in what sequence, so that it is able to ensure that e.g. no two trains occupy the same resource (node or edge) at the same time if it is for example a single capacity edge.

Figure 11A:
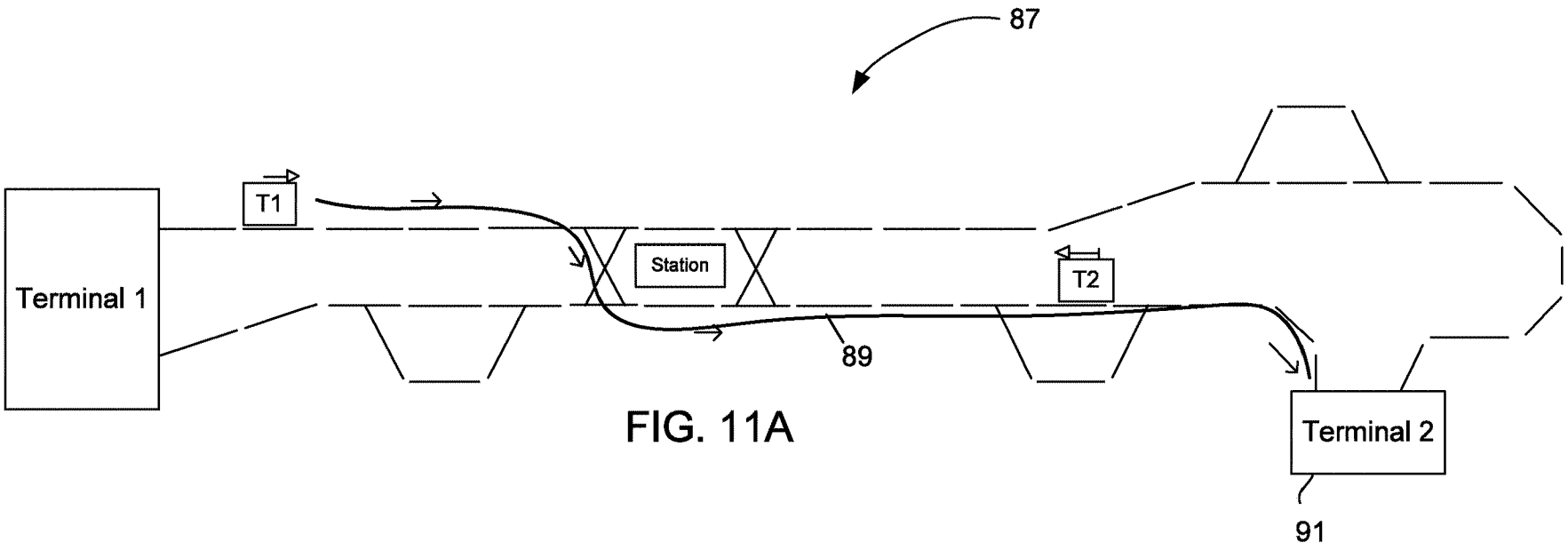
FIG. 11A depicts a railway network with two trains wherein a path for one of the trains is indicated.
Figure 11B:
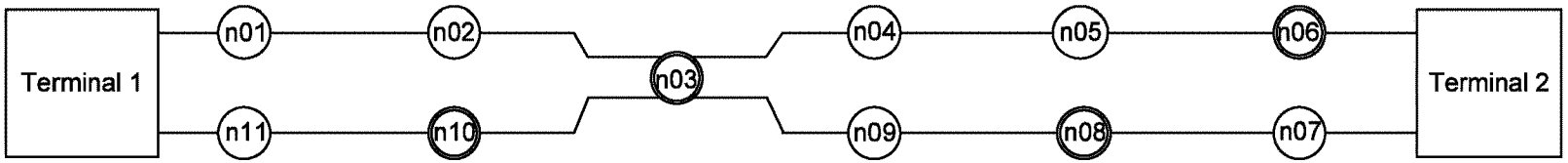
FIG. 11B is a graph corresponding to the railway network of FIG. 11A.

FIG. 11A shows a small railway network 87 in which a train T1 is travelling along a predetermined path 89 to Terminal 2. FIG. 11B shows a corresponding graph for railway network 87. It will be observed that between the Terminal 1 and Terminal 2 there are seven nodes with a single slot (i.e. nodes n01, n02, n04, n05, n07, n09 and n11) and four nodes with a double slot node (i.e. nodes n03, n06, n08, n10). Nodes that have more than a single slot are essential because trains can dwell on such nodes whilst other trains are able to pass through the nodes.

To allow for a clean characterization of deadlock in the next section, in the optimization model presented here, which is the model that is stored in software 40, the physical constraints on railway traffic are focussed on. Also, the primary operational requirement in the presently described embodiment is that throughput should be maximized or equivalently that the sum of the trains' arrival times are minimized. These requirements result in a particularly suitable model for cases in which the railway system is used for freight transportation [1, 13]. In other embodiments of the invention the primary operational requirement may be otherwise, for example to adjust train schedules for purposes such as minimizing travel times of trains, minimizing deviations from a given timetable or allocating precedence to trains.

In the presently described embodiment the path that each train will take, e.g. path 89 in FIG. 11A, is stored in database 42 as sequences of nodes and edges associated with each train.

2.2. Model Formulation. In order to model the rail network the first step is for a human operator to make a graph G (E,N) for the model that corresponds to the rail network and which is stored as part of model 55 in database 42 of scheduling machine 33. As previously discussed, a Graph G (E,N) comprises a set of edges E and nodes N.

Figure 12A:
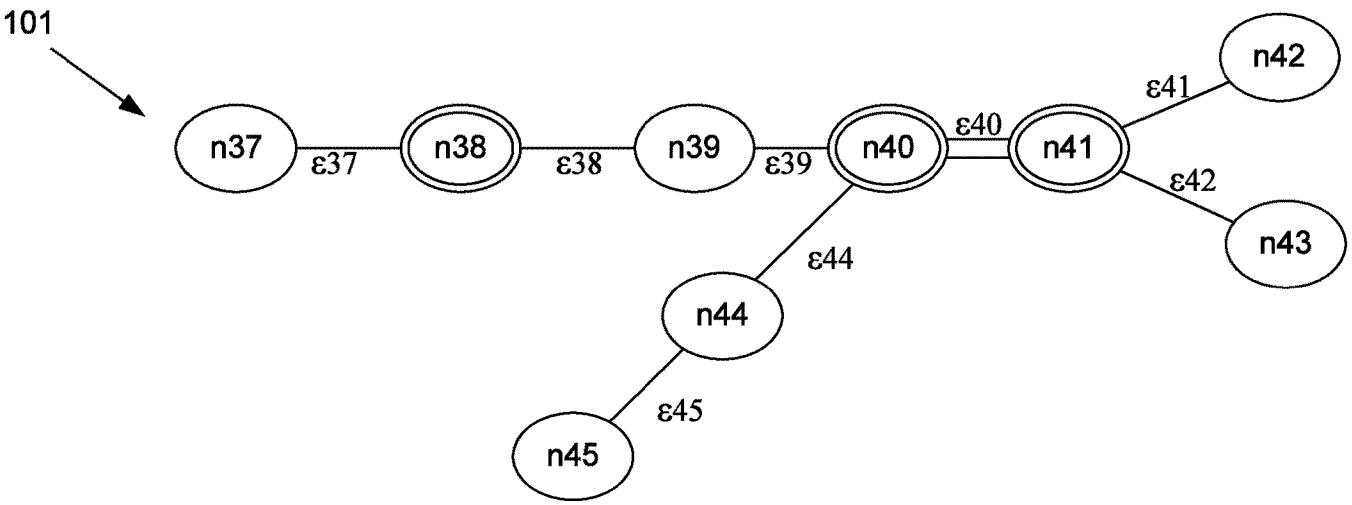
FIG. 12A is an exemplary graph corresponding to a railway network.

FIG. 12A depicts an example graph 101 that is comprised of edges labelled ε37, ε38, 39, ε40, ε41, ε42, ε44, ε45 (there is no ε43; ε40 is the sole double-edge); and nodes labelled n37, n38, n39, n40, n41, n42, n43, n44, n45.

Figure 12B:
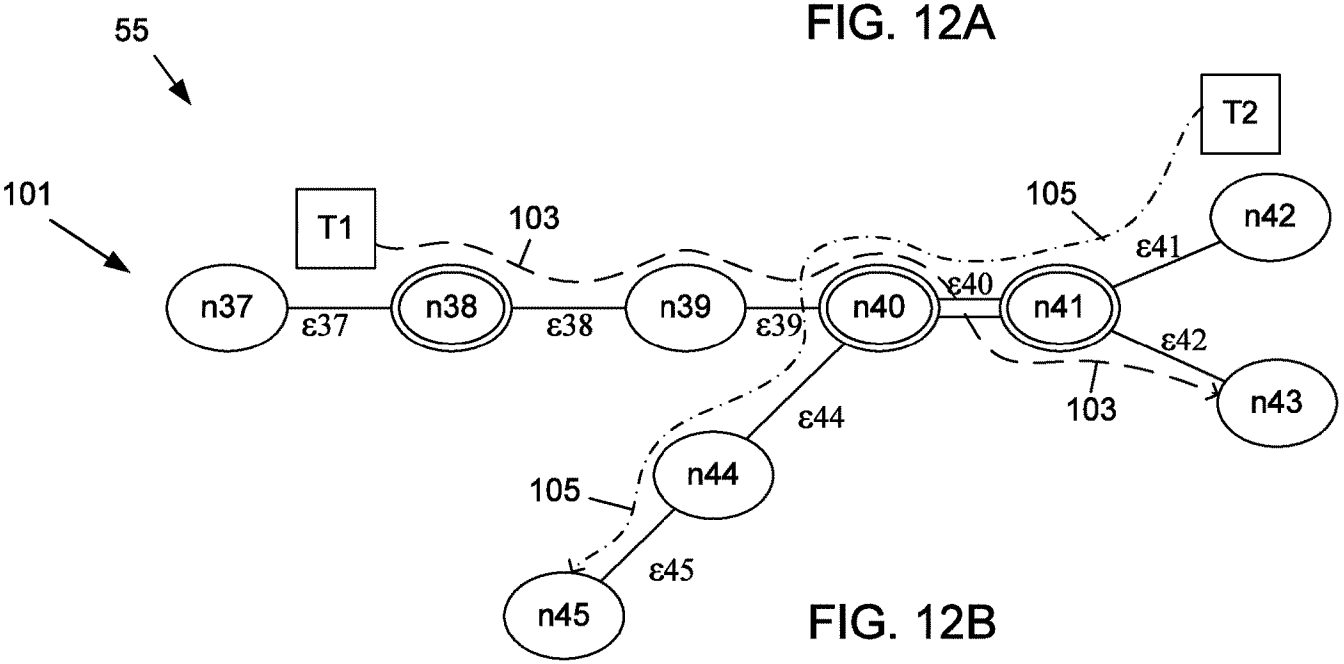
FIG. 12B is a model incorporating the graph of FIG. 8C and including two trains in a current state with paths indicated for each train.

The model 55 further comprises trains $T_i$, where $i \in I$ FIG. 12B shows an example of model 55 including the graph 101 of FIG. 12A and further including two example trains T1 and T2. The model 55 is shown at a particular time where the trains T1 and T2 are at particular locations in the graph, i.e. the model is shown in a particular one of its possible states $xt_1, \ldots, xt_n$, which have been previously discussed in relation to FIGS. 5 and 6. For example, in the state of the model 55 that is shown in FIG. 12B train T1 is halfway along node ε37 whereas $T_2$ is located at node n42.

For each train $T_i$, where $i \in I$ $$n_i=(n_i[0],n_i[1], \ldots ,n_i[F_i]) \tag{1A}$$

is the sequence of nodes in the path of train $T_i$ from its current position to its destination node $n_i[FA]$, where $F_i$ characterizes the number of stages from train $T_i$'s current position to its destination node $n_i[F_i]$. Similarly, for each train $$e_i=(e_i[0],e_i[1], \ldots ,e_i[F_i-1]) \tag{1B}$$

is the sequence of edges in the path of train $T_i$ from its current position to its destination node $n_i[F_i]$, where $F_i$ is the sequences of nodes and edges, respectively, in the path of train $T_i$ from its current position to its destination node $n_i[F_i]$, where $F_i$ characterizes the number of edges to the "terminals", being the nodes at the end of the train's path. In the following bracket notation [·] is used when edges are being referred to.

If a train is currently transiting an edge, then that edge is $e_i[0]$ in $e_i$, and $n_i[0]$ is the last node it visited. Accordingly, trains' trajectories for the example shown in FIG. 10*c* would be characterized as:

$n_{T1}=(n_0, n_1, n_2, n_3)$, $e_{T1}=(e_{0\text{-}1}, e_{1\text{-}2}, e_{2\text{-}3})$, $n_{T2}=(n_5, n_4, n_3)$, $e_{T2}=(e_{4\text{-}5}, e_{3\text{-}4})$ As a further example, in the model 55 at the state illustrated in FIG. 12B the paths for each of 1 and T2 are indicated by dashed lines 103 and 105.

The sequence of nodes and edges for the paths of T1 and T2 in FIG. 12B are as follows:

T1—Sequence of Nodes n1=(n37, n38, n39, n40, n41, 43,)

$n1=(n_1[0], n_1[1], n_1[2], n_1[3], n_1[4], n_1[5])$

T1—Sequence of Edges e1=(ε37, ε38, ε39, ε40, ε42)

$e1=(e_1[0], e_1[1], e_1[2], e_1[3], e_1[4])$

T2—Sequence of Nodes n2=(n42, n41, n40, n44, n45)

$n1=(n_1[0], n_1[1], n_1[2], n_1[3], n_1[4])$

T2—Sequence of Edges e2=(ε41, ε40, ε44, ε45)

$e2=(e_2[0], e_2[1], e_2[2], e_2[3])$

Let $k_i[e]$ be the index of edge e in $e_i$, and $k_i[n]$ be the index of node n in $n_i$. Whenever clear from the context, the index i will be dropped and k[e], k[n], n[k], e[k] will be written instead.

Sequentiality of transit. The initial set of constraints represents the required temporal sequentiality of transit over the edges of the network. Let $y_i[k] \in R^+$ be the optimization variable modelling the time at which train $T_i \in I$ departs from the k-th node $n_i[k]$. Then, $$y_i[1] \geq y_i[0]+\tau_{i,e[0]}^{edge}\cdot(1-\underline{\omega}_i)\forall i \in I$$

$$y_i[k] \geq y_i[k-1]+\tau_{i,e[k-1]}^{edge}\forall i \in I, k=2 \ldots ,F_i-1 \tag{2}$$

where $\tau_{i,e[k]}^{edge} \in \mathbb{R}$ is the time required by train i to complete travel over the k-th edge $e_i[k]$, which for the first stage is reduced by the fraction of the edge already traversed $w_i$. For example, in FIG. 12B it will be observed that train T8 is shown having already traversed about 0.5 of edge ε37 so that w1=0.5.

The underlining of $\underline{w}_i$ in (2) indicates that this is a measurement of the $\tau_{i,e[k]}^{edge}$ current state of the system used to initialize the optimization model, an aspect which will be further analyzed in Section 3 where closed loop operation is discussed. Note that can depend on a number of factors, including the current speed of the train, its state, i.e., whether it's empty or loaded with goods, wear and tear conditions, its length and number of locomotives, etc. As long as these characteristics are effectively captured in the edges' travel times they fit into the optimization framework.

Initial conditions. Let $I^{edge} \subseteq I$ be the subset of trains currently transiting an edge (i.e., not stopped at a node), and $e_i[0]$ be that edge. Then we have $$y_i[0]=0 \ \forall i \in I^{edge}. \tag{3}$$

Table 1 includes times required by each of trains T1 and T2 to complete travel over each of the edges $e_i[k]$,

TABLE 1

Edge Travel Times for the Network of FIG. 12B

| Edge Label | $\tau^{edge}$ $T_1$ (hrs) | $\tau^{edge}$ $T_2$ (hrs) | Edges of Path e1 (for T1) | Edges of Path e2 (for T2) |
|---|---|---|---|---|
| ε37 | 0.25 | 0.3 | $e_1[0]$ | |
| ε38 | 0.6 | 0.7 | $e_1[1]$ | |
| ε39 | 0.5 | 0.6 | $e_1[2]$ | |
| ε40 | 0.9 | 1.1 | $e_1[3]$ | $e_2[1]$ |
| ε41 | 0.3 | 0.5 | | $e_2[0]$ |
| ε42 | 0.8 | 0.8 | $e_1[4]$ | |
| ε44 | 1.1 | 1.0 | | $e_2[2]$ |
| ε45 | 0.5 | 0.6 | | $e_2[3]$ |

As an example, the application of Eqn (2) for T1 in FIG. 12B is as follows:

$$y_1[1] \geq y_1[0]+\tau_{1,e[0]}\cdot(1-\underline{w}_1)$$

Here, $y_1[1]$ is the time at which train T1 departs from the first node $n_1[1]$ which is n38 and is greater than or equal to the time that it departed from the zeroth node $n_1[0]$ (i.e. n37) plus the time it takes for train 1 to travel over the zeroth edge (i.e. ε37 reduced by the fraction of the zeroth edge already traversed.

The initialisation state is $y_1[0]=0$ because T1 is not starting from a node but from 0.5 the way along edge ε37.

Applying Eqn 2 to the data in Table 1 results in:

$$y_1[1] \geq 0+0.25\times(1-0.5)=0.125 \text{ hrs.}$$

$$y_1[2] \geq 0.125+0.6=0.725 \text{ hrs.}$$

$$y_1[3] \geq 0.725+0.5=1.225 \text{ hrs.}$$

$$y_1[4] \geq 1.225+0.9=2.125 \text{ hrs.}$$

The application of Eqn (2) for $T_2$ is: $y_2[1] \geq y_2[0]+\tau_{2,e[0]}\cdot(1-\underline{w}_2)$ in which $y_2[1]$ is the time at which train T2 departs from the first node $n_1[1]$ which is n41 and is greater than or equal to the time that it departed from the zeroth node $n_1[0]$ (i.e. n42) plus the time it takes for train 1 to travel over the zeroth edge (i.e. ε41 reduced by the fraction of the zeroth edge already traversed (which in this case is zero since T2 starts from n42 and so must traverse all of zeroth edge ε41).

In this case $y_2[0]$ is left as an optimization variable that is only required to be equal or greater than 0. Its final value will be determined after having solved the optimization model. Because T2 is at a node, it generally can dwell there for some amount of time before it departs from that node; that is what it would mean for $y_2[0]$ to have some strictly positive value, it would be the amount of time T2 dwells on n42 from the point in time the state of the system was determined and used to construct the optimization model.

If a train is currently transiting an edge it cannot be stopped in the middle of that edge which is why y[0]=0 in those cases.

Edge conflicts. The set of edges $\varepsilon$ is partitioned into single $\varepsilon^s$ and double tracks, $\varepsilon^d$ so that $\varepsilon \doteq \varepsilon^s \cup \varepsilon^d$. The single edges allow the transit of at most one train at the time, while on the latter two trains can transit as long as they are headed in opposite directions. For each single track edge $e \in \varepsilon^s$ the following set of conflicts hold $$C_e = \{(i,j) \forall i,j \in I, j > i | e \in e_i, e \in e_j\}, \tag{4}$$

encoding the fact that if both trains i and j are to transit over edge e within their planned path to destination, then a conflict must be resolved to determine the train transiting first.

The construction for double edges $e \in \varepsilon^d$ is similar, but conflicts are considered only among trains transiting in the same direction.

A binary optimization variable $z_{i,j,e}^{edge}$ will now be introduced $z_{i,j,e}^{edge}$ is set to 1 if train i is scheduled to transit before j over edge e, and is 0 otherwise as follows:

$$\left.\begin{aligned} & y_i[k[e]] \geq y_j[k[e]] + \tau_{j,e}^{edge} - M z_{i,j,e}^{edge} \\ & y_j[k[e]] \geq y_i[k[e]] + \tau_{i,e}^{edge} - M\left(1 - z_{i,j,e}^{edge}\right) \\ & z_{i,j,e}^{edge} \in \{0, 1\}. \end{aligned}\right\} \forall (i, j) \in C_e, c \in \varepsilon \tag{5}$$

The value of M has to be set to a sufficiently large value, e.g., $M \geq \max_{i \in I} y_i[F_i - 1]$.

Initial conditions. Trains that are currently transiting an edge $i \in I^{edge}$ automatically get priority over that edge:

$$z_{i,j,e_i}^{edge} = 1 \ \forall i \in I^{edge}, (i,j) \in C_{e_i[0]} \tag{6}$$

Node conflicts. Similar to edges, the resolution of conflicts over a node involves node deciding which train transits first, and is encoded with the binary variable $z_{i,j,n}^{node}$, attaining 1 if train i transits over n before train j. Nodes are characterized by a number of "slots" indicating how many trains can be present over that node at the same time. Before transiting, a train thus also needs to acquire a slot on the nodes along its path. To capture this, the binary variable $z_{i,n,l}^{slot}$ is introduced, which indicates whether train i occupies slot $l \in L_n$ on its transit over node n, where $L_n$ is the set of slots at node n.

Then, for each $n \in N$, the following set is introduced to capture conflicts over nodes:

$$C_n \doteq \{(i,j) \forall i,j \in I, j > i | n \in n_i, \text{ and } n \in n_j\},$$

and require that schedules satisfy the following constraints:

$$\begin{aligned} & y_j[k[n]-1] \geq y_i[k[n]] - M(1 - z_{i,j,n}^{node}) - M(1 - z_{i,n,j}^{slot}) - M(1 - z_{j,n,l}^{slot}), \\ & y_i[k[n]-1] \geq y_j[k[n]] - M z_{i,j,n}^{node} - M(1 - z_{i,n,l}^{slot}) - M(1 - {}_{j,n,l}^{slot}) \end{aligned} \tag{7}$$

for all $n \in N$, $l \in L_n$, and $(i, j) \in C_n$. These constraints can be active only if, for a given node n and slot l, both $z_{i,n,l}^{slot}$ and $z_{j,n,l}^{slot}$ attain a value of 1 in the solution, i.e., both trains, are scheduled to use the same slot during their transit. In such case, the constraint ensures that if train i transits before j on the node, then the start time of train j over the edge leading to node n has to be greater or equal to the start time of i leaving node n. Additionally, each train occupies exactly one slot during transit:

$$\sum_{l \in L_n} z_{i,l}^{slot} = 1 \quad \forall i \in I. \tag{8}$$

In order to simplify the exposition herein terminal stations are generally modelled as nodes with infinite capacity, i.e., nodes for which constraints (8)-(9) are suppressed. Note also that it is possible to extend the formulation in (8) with the addition of a quantity of time $\tilde{\tau}$. Doing so requires that the train giving way must wait an additional amount of time equal to $\tilde{\tau}$ after the train with precedence has left the conflict node allowing for, e.g., safety headways of long trains. The quantity $\tilde{\tau}$ may also be negative allowing for earlier departure, a feature that may be useful on long edges.

Initial conditions. As with edges, trains that are currently transiting a node are occupying a slot on that node and hence they automatically get priority over that node and acquire a slot. Let $I^{node} \subseteq I$ be the subset of trains currently transiting on a node, $n_i[0]$ be that node and $\underline{l}_i$ be the slot they are currently occupying.

Then, $$\begin{aligned} & z_{i,j,n_i[0]}^{node} = 1 \ \forall i \in I^{node}, (i,j) \in C_{n_i[0]} \\ & z_{i,n_i[0],\underline{l}_i}^{slot} = 1 \ \forall i \in I^{node}, \end{aligned} \tag{9}$$

where, as before, the underlining of $\underline{l}_i$ indicates that this is part of the state that is measured.

Objective function. As a proxy for rail network throughput maximization, the objective in the presently described embodiment is the minimization of the sum of the trains' arrival times, $$\text{minimize} \sum_{i \in I} y_i, F_i - 1. \tag{10}$$

It may be noted that there is significant flexibility in the type of objectives that could be used so that it is possible to include, e.g., penalties on delays at intermediate steps, which would allow a straightforward extension of the model presented to pursue timetable adherence. To achieve this, for some train $i \in I$ scheduled to depart from stage k at the reference time $y_i^{ref}[k]$ stemming from, e.g., a timetable, a new optimization variable $y_i^{dev}[k] \geq 0$ can be introduced as:

$$-y_i^{dev}[k] \leq y_i[k] - y_i^{ref}[k] \leq y_i^{dev}[k]$$

This variable could then be added to the objective function allowing a straightforward extension of the model presented to pursue timetable adherence.

In summary, the complete model (eqn (11)) is:

$$P: \begin{cases} \min\limits_{y,z} & \text{total completion time (10)} \\ \text{s.t.} & \text{sequentiality (2)} \\ & \text{edge conflicts (5)} \\ & \text{node conflicts (7), (8)} \\ & \text{initial conditions (3), (6), (9)} \\ & z^{edge}, z^{node}, z^{slot} \in \{0, 1\} \\ & y \geq 0. \end{cases}$$

3. Closed Loop Operation: Receding Horizon Control

In this section the optimization model P of Section 2 is embedded within a strategy called receding horizon control, in which a shortened optimization horizon $f_i$, where $0 \leq f_i \leq F_i$ for train $i \in I$, is used rather than $F_i$ (eqn (1A), (1B)), which extends all the way to the train's destination node. Use of the shortened optimization horizon $f_i$ enables the scheduling machine 33 to operate with reduced computation times, and also reflects the fact that in practice, the presence of disturbances and imperfect information on transit times means that the final part of schedules stretching far into the future is likely to be of little value, and unnecessarily leads to increased computational demands; note that the size of the model 55, measured in number of constraints and variables, grows as $O(|I|^2|N|)$. Within this framework, feedback is introduced by scheduling machine 33 continuously monitoring the current state of the system, since it is arranged to receive state reports $x_t$, via data communications system 29 and using the new state information to recompute adapted schedules.

The state of the system $x_t=(\underline{n}_i, \underline{w}_i, \underline{l}_i)_{i\in I}$ denotes the complete set of measurements required to initialize the optimization model P, where $\underline{n}_i \equiv n_i[0] \in N$ is the most recent node visited by train $i \in I$, $0 \leq \underline{w}_i \leq 1$ is the fraction of the edge $e_i[0]$ already traversed and $\underline{l}_i$ indicates the slot occupied if the train is currently located at a node.

$P(t, x_t, f)$ indicates the instance of P generated at time t for the initial state $x_t$ and under the optimization horizon schedule $f=(f_i)_{i\in I}$. In this section the evolution through time of the state of the railway system x, under the control of movement schedules S1, . . . , Sm produced by scheduling machine 33 as it solves $P(t, x_t, f_t)$ will be discussed.

For simplicity of notation and exposition, it is assumed here that the schedules, e.g. S1, . . . , Sm of FIG. 5, which are generated by scheduling machine 33 in response to the state reports xt1, . . . , xtn are generated at constant intervals of time $\Delta t$ in the presently described embodiment. It should be realized though that this is not necessary and the procedure presented herein can be applied in ad-hoc contexts where arbitrary events, such as trains arriving late at a station, are used to trigger plan re-computations. Note that t represents global (continuous) time, while k in the previous section was an index of time expressed as an integer number of stages relative to the position of the system at the time it was instantiated.

A potential problem with shortening prediction horizons is that the trains interactions in the later stages are not determined, which might lead to deadlocking.

Example 3.1. Consider the State of a Portion of the Rail Network 21 Depicted in FIG. 13A and modelled in FIG. 13B: $T_1$ and $T_2$, originating from separate branches of the network are about to merge on the same single line with two passing sidetracks, while $T_3$ is transiting in opposite direction. The terminal destinations for the trains are indicated with dotted arrows having crossed heads: the destination for $T_1$ and $T_2$ is $n_5$ (which could represent a station), while the destination for $T_3$ is $n_0$. Trains are stopped with their heads at the end of the blocks on which they are dwelling (indicated with white squares, for "stopped").

Figure 13A:
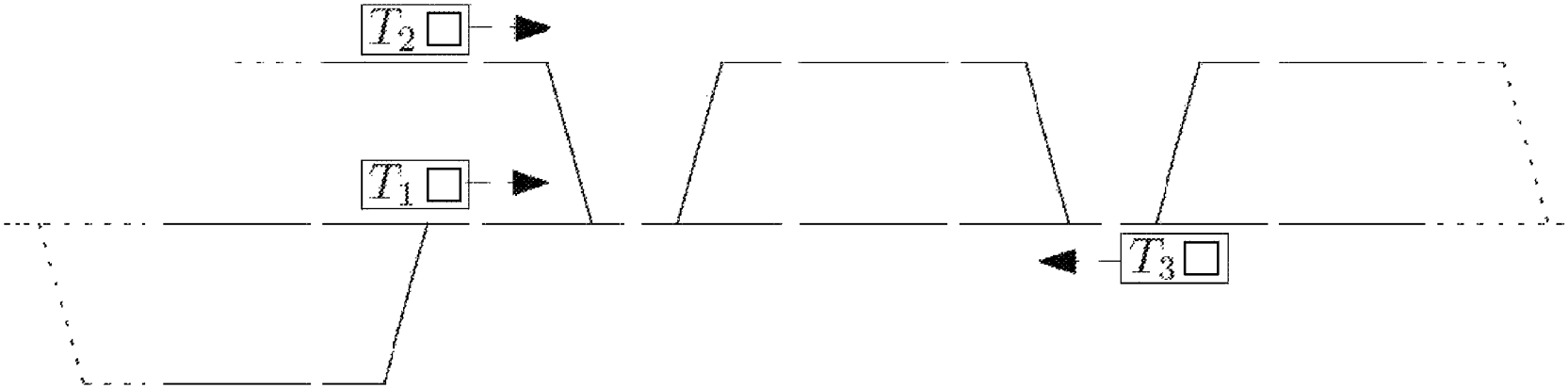
FIG. 13A depicts a railway network with a number of trains thereon.
Figure 13B:
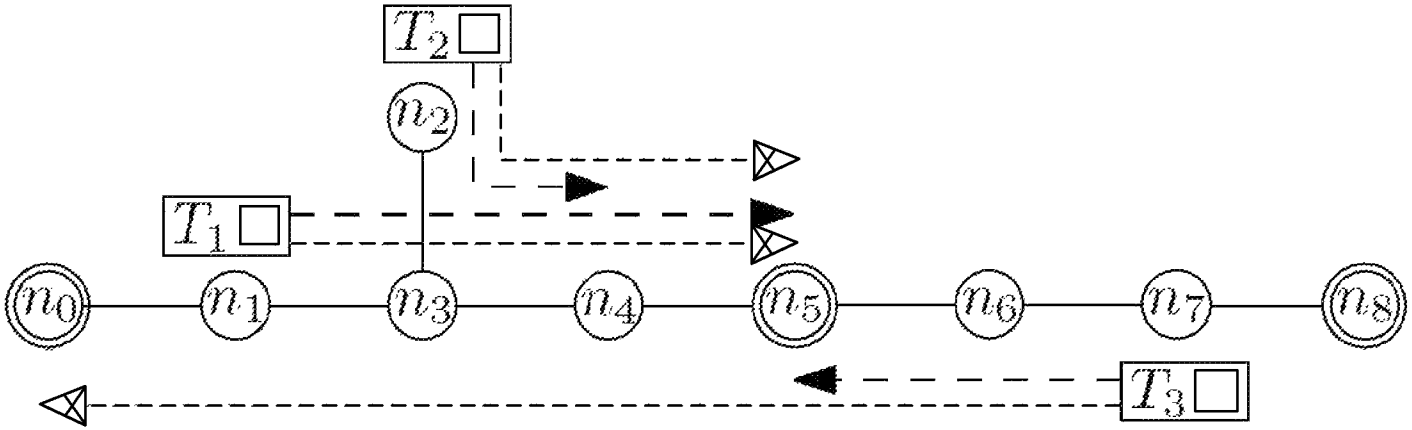
FIG. 13B is a model incorporating the graph of FIG. 13A and including three trains with terminal destinations and optimization horizons for each indicated thereon.

Assume that at that point in time t, the optimization horizons for the individual trains used to construct model $P(t, x_t, f_t)$ are as depicted in FIG. 13B by the respective solid black headed arrows, i.e., $$f_t = \begin{bmatrix} f_{T_1} \\ f_{T_2} \\ f_{T_3} \end{bmatrix} = \begin{bmatrix} 3 \\ 2 \\ 2 \end{bmatrix}$$

Figure 13C:
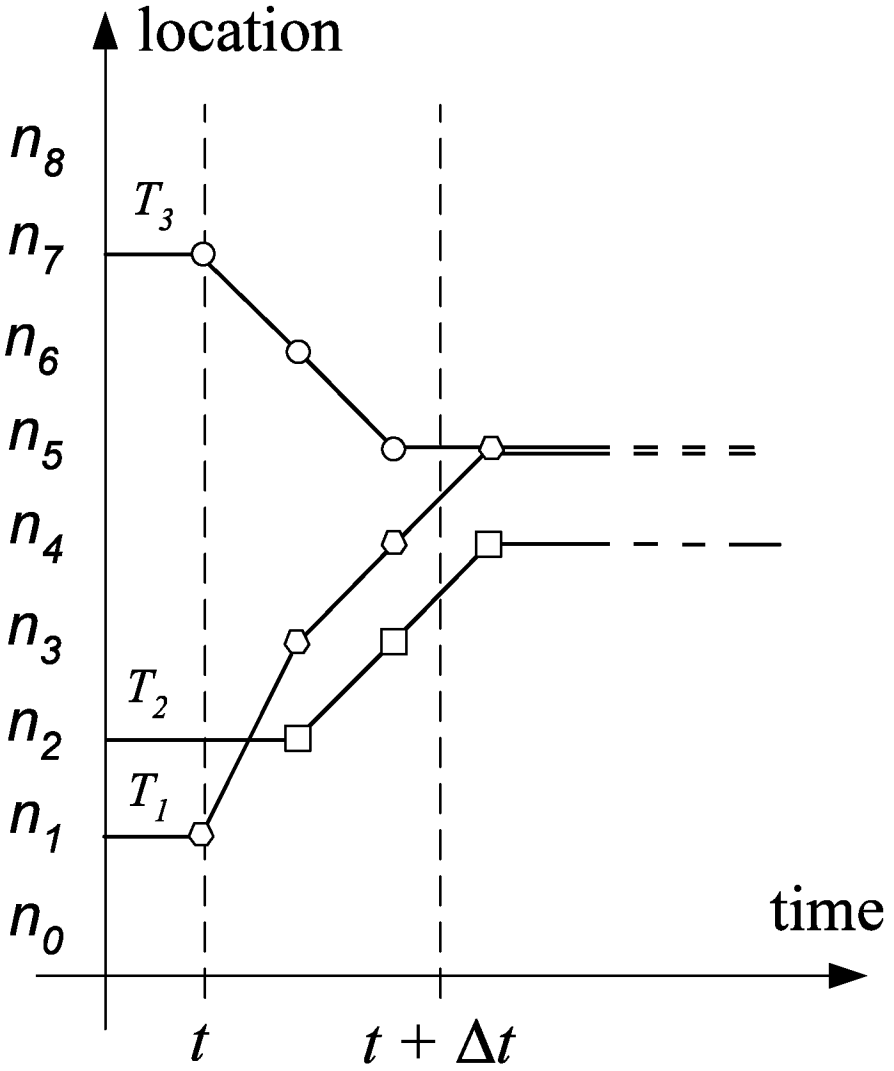
FIG. 13C is a train graph or "stringline" illustrating a deadlocked state of the model of FIG. 13B.

A feasible solution to P for this situation is shown in the train graph of FIG. 13C. As trains transit according to this feasible schedule, the system becomes physically deadlocked at $t+\Delta t$ because T3 and T2 are both on two slot node n5 and T1 is on single slot node n4, so that none of T1, T2 and T3 can proceed along their paths. This is also reflected by the optimization model $P(t+\Delta t, X_{t+\Delta t}, F)$ becoming infeasible. Note that this occurs despite the absence of imperfect information or system disturbances.

Instances affected by a deadlock are reflected as models that do not allow for a finite, feasible set of start times y, i.e., equation (11) cannot be solved to obtain start times for each train that do not result in a node, edge or slot conflict, so that a solution for $P(t, x_t, F)$ is infeasible. Given that $P(t, x_t, F)$ exclusively entails physical constraints on traffic, rather than operational ones such as deadlines, an infeasible model indicates that there is no sequence of decisions steering trains from their current position to their respective terminals that is compatible with the physical limitations on traffic, i.e., that there is a deadlock. Hence, a state x, is deadlocked if and only if $P(t, x_t, F)$ is infeasible.

In the following section the relationship between $P(t, x_t, F)$ and $P(t, x_t, f)$ as it relates to deadlocking will be further examined.

3.1. Recursive Feasibility. Recursive feasibility is the fundamental notion used to establish the stability of linear, time-invariant systems under receding horizon controllers such as model predictive controllers [4]. Even though the presently described system is neither, due to the presence of binary variables and the fact that the constraints are time-varying, the issue of recursive feasibility remains crucial in ensuring that the system is not driven into a deadlocked state when the prediction horizons are shortened to $0 \leq f \leq F$.

In this section, a procedure is presented to compute a dynamic horizon termination schedule f that guarantees recursive feasibility and which may be implemented by scheduling machine 33. The core notion required for the construction of such a procedure is that of a safe state.

Definition 3.2 (Safe state). A safe state is a system state $x^{safe}=(n^{safe}_i, 0, l_i^{safe})_{i\in I}$ in which all trains are at a node, and all nodes $n \in N$ in the graph have an unoccupied slot. The term "non-regressive" denotes, with respect to x, a safe state in which trains occupy nodes that are successors along their paths from a given state x.

Definition 3.3 (Non-regressiveness). We define as non-regressive with respect to x a system state in which trains occupy nodes that are successors along their paths from a given state x.

The inequality sign "≤" is overloaded when applied to horizons to indicate non-regressiveness: $f_i \leq \tilde{f}_i$ means that, for train i, the horizon determined by $\tilde{f}_i$ terminates at a node that is further along i's path than the node reached by $f_i$. When $f_i$ and $\tilde{f}_i$ refer to two different points in time, the numbers might not satisfy the standard meaning of the inequality, but they still do imply non-repressiveness.

The following result is a characteristic of safe states which will be used to prove recursive feasibility.

Proposition 3.4. There Always Exists a Sequence of Train Movements that Drives the System from any Safe State $x_a^{safe}$ into any Other Safe State $x_b^{safe}$ that is Non-Regressive with Respect to $x_a^{safe}$.

Proof. Algorithm 1 constructs one such sequence of movements. Since the initial state is safe, any train can be moved forward to any other node in the network in a first step; the destination node has to have at least two slots (otherwise it can't be part of a safe state). Upon train arrival, the node has now either no empty slots left, or at least one. If it has at least one empty slot, then the current state is also safe, and the procedure can restart by picking any other train that hasn't been moved yet. If the current node has no slots left, there must be another train on the current node that has not been moved yet. By construction, all other nodes have at least one empty slot available for transit, meaning that the train can be moved anywhere in the network. This procedure can be repeated to termination.

Algorithim 1 Trivial Policy From Safe State to Safe State

1: $I^{open} \leftarrow I$
2: $i \leftarrow$ random choice from $I^{open}$
3: while $I^{open}$ not empty do
4: let i transit from $x_{i,a}^{safe}$ to $x_{i,b}^{safe}$
5: remove i from $I^{open}$
6: if $x_{i,b}^{safe} = x_{j,a}^{safe}$ for some $j \in I^{open}$ then $i \leftarrow j$
7: else $i \leftarrow$ random choice from $I^{open}$ Algorithm 2 presents a procedure to compute a dynamic horizon $f_t$ based on the notion of safe states, which may be implemented by scheduling machine 33. If the system is in a non-deadlocked state $x_t$, it is guaranteed to successfully compute an optimization horizon $f_t$ which ensures recursive feasibility. In the proposed procedure, the optimization horizon for each train $f_i$ is iteratively extended until it reaches a node such that the state of the system would be safe if trains transited up to that point from their current position. Prediction horizons are further extended until the computed $f_t$ results in a feasible $P(t, x_t, f_t)$, while retaining the condition on the final state being safe, a condition that is guaranteed to be met if $P(t, x_t, F)$ is feasible. We call horizons $f_t$ computed according to Algorithm 2 safe optimization horizons.

Remark 3.5. Note that the feasibility of $P(t, x_t, f_t)$ implies the feasibility of $P(t,x_t,f_t)$ for any $f_t \geq f_t$ that leads to a safe state. This is true because Algorithm I can always be used to generate a feasible schedule between the corresponding safe states.

Thus, choosing larger initialization horizons (line 1 of the algorithm) reduces the number of models that have to be attempted before a feasible one is found.

Algorithm 2 Compute Safe Horizon Termination f

1: $f_i \leftarrow 1$, for all $i \in I$
2: $\eta_n \leftarrow |L_n|$, for all $n \in N$
3: for all $i \in$ do
4: while $\eta_{n_i[f_i]} \leq 1$ do
5: $f_i \leftarrow f_i + 1$
6: $\eta_{n_i}[f_i] \leftarrow \eta_{n_i}[f_i] - 1$
7: if $P(t, x_t, f)$ is feasible then return f
8: else
9: select some $i \in I$ for which $f_i < F_i$
10: $f_i \leftarrow f_i + 1$
11: goto 2

Figure 14:
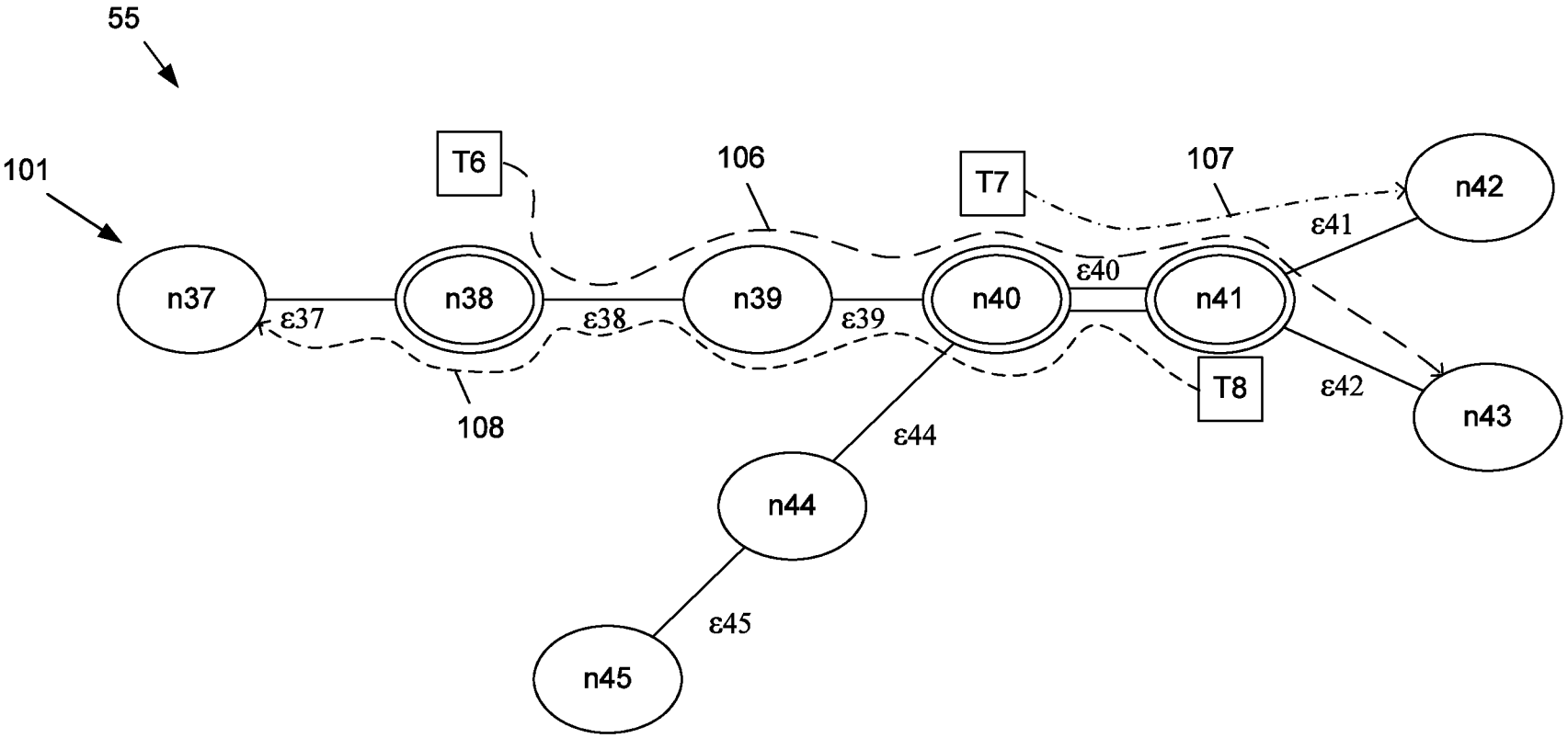
FIGS. 14 to 17 progressively illustrate the application of a procedure applied by the scheduling machine for determining optimization horizons for each of the trains on a rail network.

The implementation of Algorithm 2 by scheduling machine 33 will be illustrated with reference to FIGS. 14 to 17. In FIG. 14, trains T6, T7 and T8 have predetermined paths indicated as arrows 106, 107 and 108 which shows the paths that each will travel from their initial position to their final position. The state $x_t=(\underline{n_i},\underline{w_i},\underline{l_i})$ of, e.g. T6 for current time "t" is $x_t=(\underline{n38},\underline{0},\underline{0})$ reflecting that T6 is dwelling on slot l=0, being one of two slots, of node n38 and is a fraction that is 0 along edge 0 of its path (i.e. edge ε38).

Figure 15:
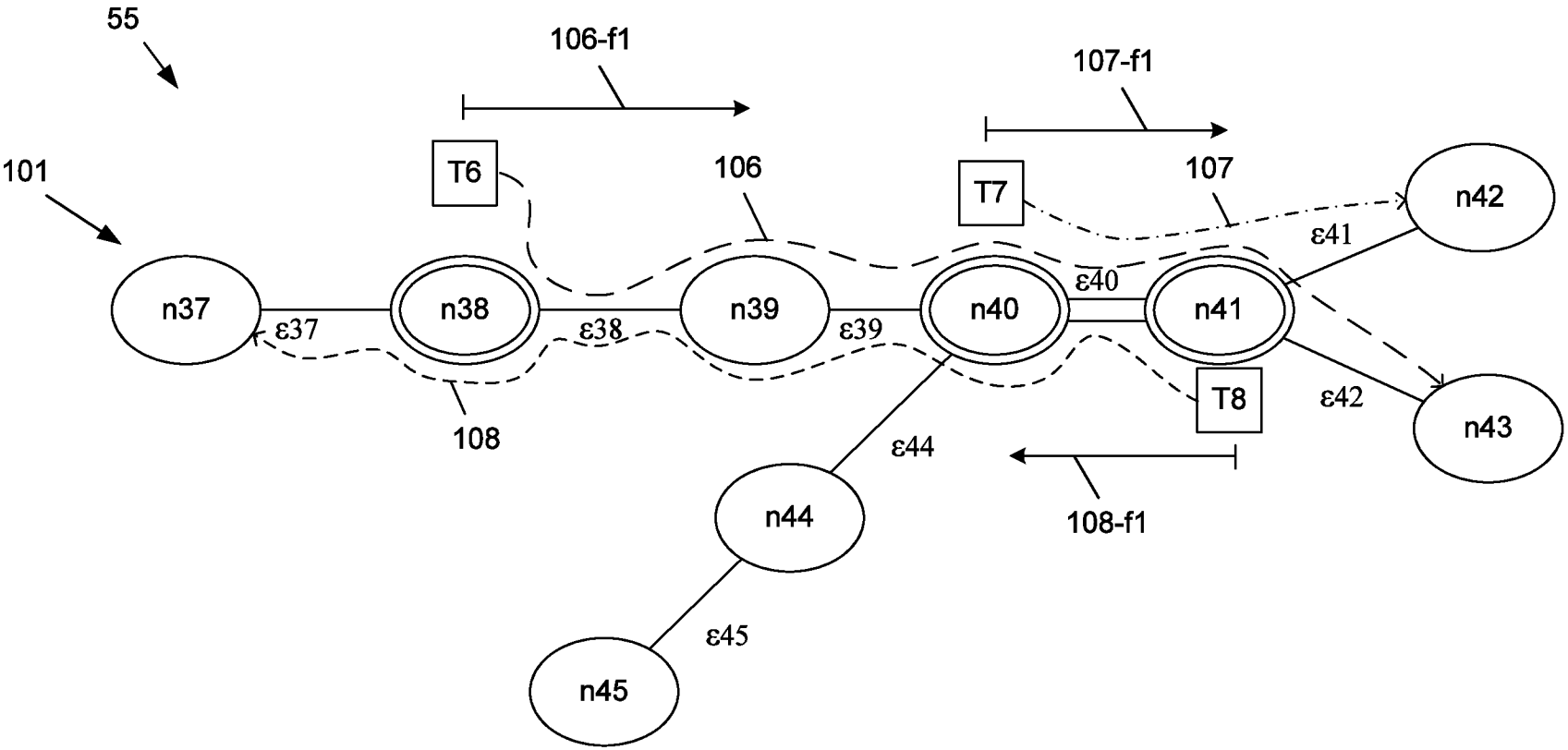

From that initial state Algorithm 1 executes as follows:

Line 1: set all initial horizons for all trains to 1 node ahead of their current positions along their respective paths as indicated in FIG. 15. The initial horizons for each train T6, T7, T8 are indicated as 106-*f*1, 107-*f*1 and 108-*f*1 in FIG. 15.

Line 2: Every node has an η "eta" value which is initially set to its number of slots. At Line 2 the η values are initialised: η(n37)←1; η(38)←2; η(n39)←1; η(n40)←2; η(n41)←2; η(n42)→1; η(n43)←1; η(n44)←1; η(n45)←1

Line 3 (T6): For each train $T_i$, i.e. trains T6 to T8 do lines 4 to 6. Initially process for T6.

Line 4 (T6): For the "while" condition in Line 4 to be triggered the η value (i.e. number of slots) of the node at which the current train's current horizon $f_i$ terminates must be less than or equal to 1. For train T6, the current η(n39) value of node 39 is η(n39)=1 (from Line 2) so that the "while" condition is triggered for T6.

Line 5 (T6): Provided the "while" condition was triggered at Line 4 then at Line 5 the horizon for the current train is incremented by 1. Accordingly the horizon f6←2, indicated as item 106-*f*2 of FIG. 16 now extends to node n40. The reasoning behind the design of Line 5 is that node 39 is a single slot node and it is not allowed for trains' horizons to finish at locations where there would be no spare slot for other trains to transit. The fundamental idea behind the definition of safe states is that a safe state is a state that leaves capacity for free passage of other trains.

Line 6 (T6): Since η(n40) is currently set to 2 the "while" loop of line 4 is exited and on Line 6 η(n40)←η(n40)−1 so that η(n40) is set to 1. Control now passes back to Line 3 where the next train (T7) is made the current train for processing.

Figure 16:
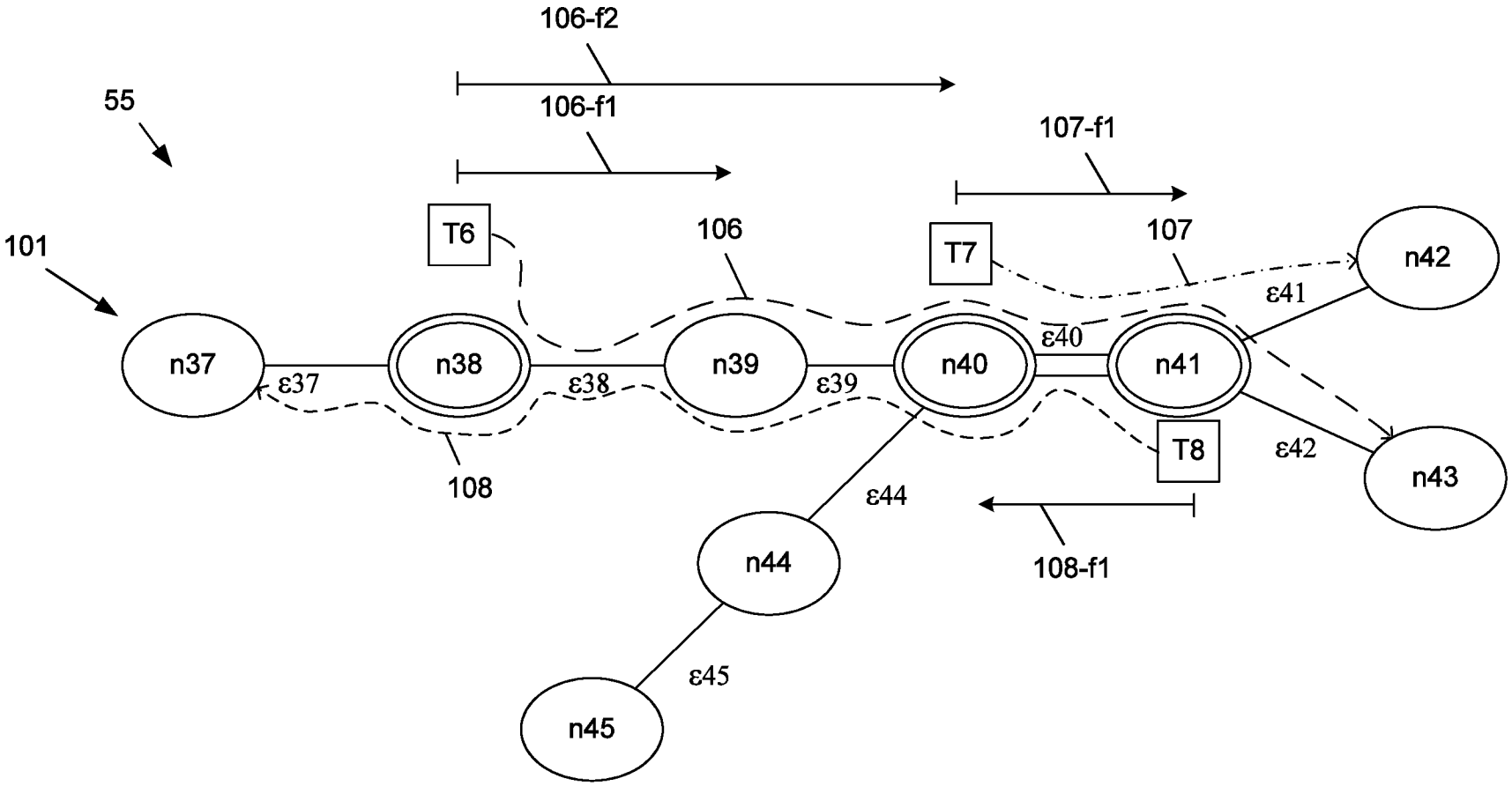

Line 3 (T7): As shown in FIG. 16, T7 currently has a horizon (indicated as item 107-*f*1 in FIG. 16) extending to node n41 and η(n41) is currently equal to 2 (from Line 1 above).

Line 4 (T7): Since η(n41) is currently equal to 2 the "while" condition at line 4 is not triggered and control bypasses Line 5 and passes to Line 6.

Line 6 (T7): At Line 6 η(n41)←η(n41)−1 so that η(n41) is set to 1 and control diverts back to Line 3.

Line 3 (T8): The current train is set to T8 and control passes to Line 4.

Line 4 (T8) Although node n40, which is the node at the end of the current horizon (108-*f*1, FIG. 12) for T8, physically has two slots, its η(n40) value was decreased to 1 in Line 6 (T6). Consequently, Line 4 (T8) is triggered. and so control passes to Line 5 (T8).

Figure 17:
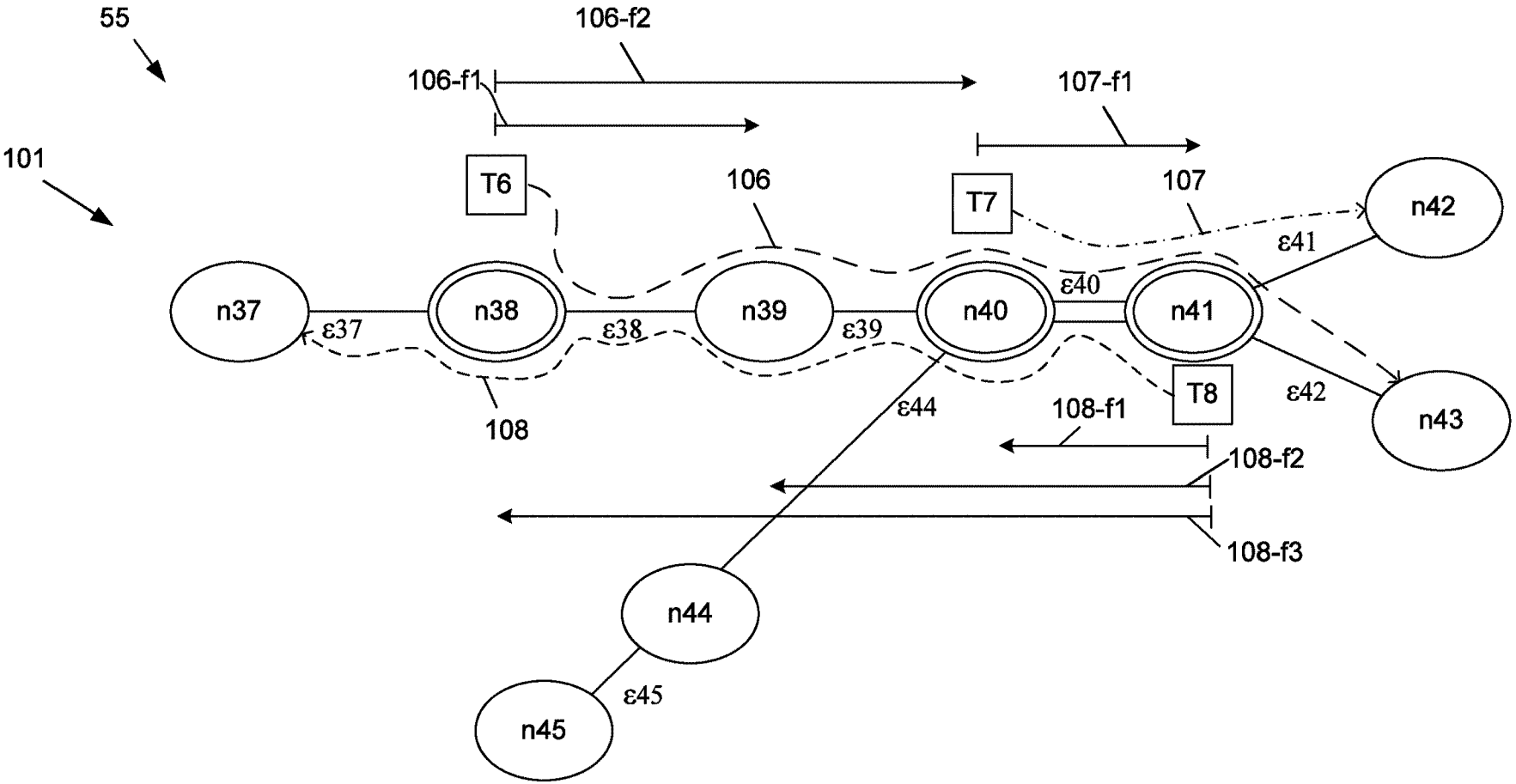

Line 5 (T8) The horizon f8 is incremented by 1 to f8=2 so that it extends to n39 (shown as item 108-*f*2 of FIG. 17).

Line 4 (T8) Since η(n39) is 1 the "while" condition in Line 4 is met and so control diverts to Line 5 (T8)

Line 5 (T8) f8 is incremented by 1 to f8=3 so that horizon f8, indicated as item 108-*f*3 of FIG. 117 now extends to node n38.

Ultimately the horizons appear as shown in FIG. 13 where:

Train 6 has a horizon f6=2 (item 106-*f*2 of FIG. 17));

Train 7 has a horizon f7=1 (item 107-*f*1 of FIG. 17)) and

Train 8 has a horizon f8=3 (item 108-*f*3 of FIG. 17).

This result assumes that each time scheduling machine 33 proceeds to Line 7 of Algorithm 2 it is possible to find a feasible solution, by using the optimization engine 41 for the model in the current state $P(t, x_t, f)$. If a feasible solution can't be found then Line 7 diverts to Line 9.

The scheduling machine 33 uses the optimization engine 41 of the rail traffic optimization software product 40 to search for a feasible solution within a practical time, e.g. five minutes of processing on a scheduling machine with 16 GB of RAM, an Intel i7-6700K CPU clocking at 4.00 GHz running on Linux Ubuntu 16.04.4 LTS and using Gurobi 7.5.2 as the optimization engine.

The correctness of Algorithm 2 will now be proved and a characterization of deadlocks will be provided that is generally computationally cheaper than solving the full-horizon model P(t, $x_t$, F).

Theorem 3.6 (Deadlock Characterization and Recursive Feasibility). Let P(t, $x_t$, f) be the Optimization Program Instance Generated at Time t for the Initial State x, and with any Non-Regressive Horizon Termination Schedule f Produced by Algorithm 2. Then, 2. the state x, is not deadlocked if and only if P(t, $x_t$, f) is feasible, and
3. if P(t, $x_t$, f) is feasible, then its operation is recursive feasible.

Proof. We first demonstrate part b) of the Theorem.

Let $(\tilde{y},\tilde{z})$ be any feasible solution of P(t, $x_t$, $f_t$), where $f_t$ is an horizon termination schedule computed at time t according to Algorithm 2. Let $(\bar{y}, \bar{z})$ be its augmentation to the terminal nodes by application of the trivial policy in Algorithm 1. Note that a state in which all trains are at terminals is always safe under our assumption of infinite capacity at these nodes. By construction of f and Algorithm 1, $(\bar{y}, \bar{z})$ is feasible for P(t, $x_t$, F), and hence $(\bar{y}-\Delta t, \bar{z})$ is feasible for P(t+Δt, $x_{t+\Delta t}$, F). This shows that $(\bar{y}-\Delta t, \bar{z})$ produces a path from $x_{t+\Delta t}$ to the terminals going through the safe state configuration given by the horizon termination schedule $f_t$ computed at t. We can extend this part of the solution by applying Algorithm 1 to construct a sequence of decisions to any non-regressive terminal conditions $f_{t+\Delta t}$ computed at t+Δt, ensuring the feasibility of P(t+Δt, $x_{t+\Delta t}$, $f_{t+\Delta t}$). This concludes the proof of part b).

For part a), if P(t, $x_t$, f) is feasible, the system is not deadlocked since, as shown in part b), a feasible solution to P(t, $x_t$, F) can always be constructed by applying Algorithm 1.

On the other hand, Algorithm 2 extends f until P(t, $x_t$, f) is feasible, which is guaranteed to succeed if the system is not deadlocked.

Note that with the application of Algorithm 2 safe optimization horizons are determined, merely to use within the optimization model. These are constructed to guarantee that enough interactions are taken into account to prevent deadlocks. Typically a new sequence of controls, i.e. schedules S1, . . . , SM, are computed before any of the trains have arrived at the final node within their respective horizons, in which case the system will generally not traverse that safe state. Also, note that optimization horizons required by Theorem 3.6 are not unique: in Example 3.1, both {$T_1$: $n_5$, $T_2$: $n_8$, $T_3$: $n_0$} as well as {$T_1$: $n_8$, $T_2$: $n_5$, $T_3$: $n_0$} would be valid. Further, the result does not depend on the optimality of the solution recovered, meaning that a solver can be safely interrupted as soon as a feasible solution to P(t, $x_t$, $f_t$) has been found.

The following counterexample illustrates how the result in Theorem 3.6 might fail when the assumption on non-regressiveness is violated.

Figure 19:
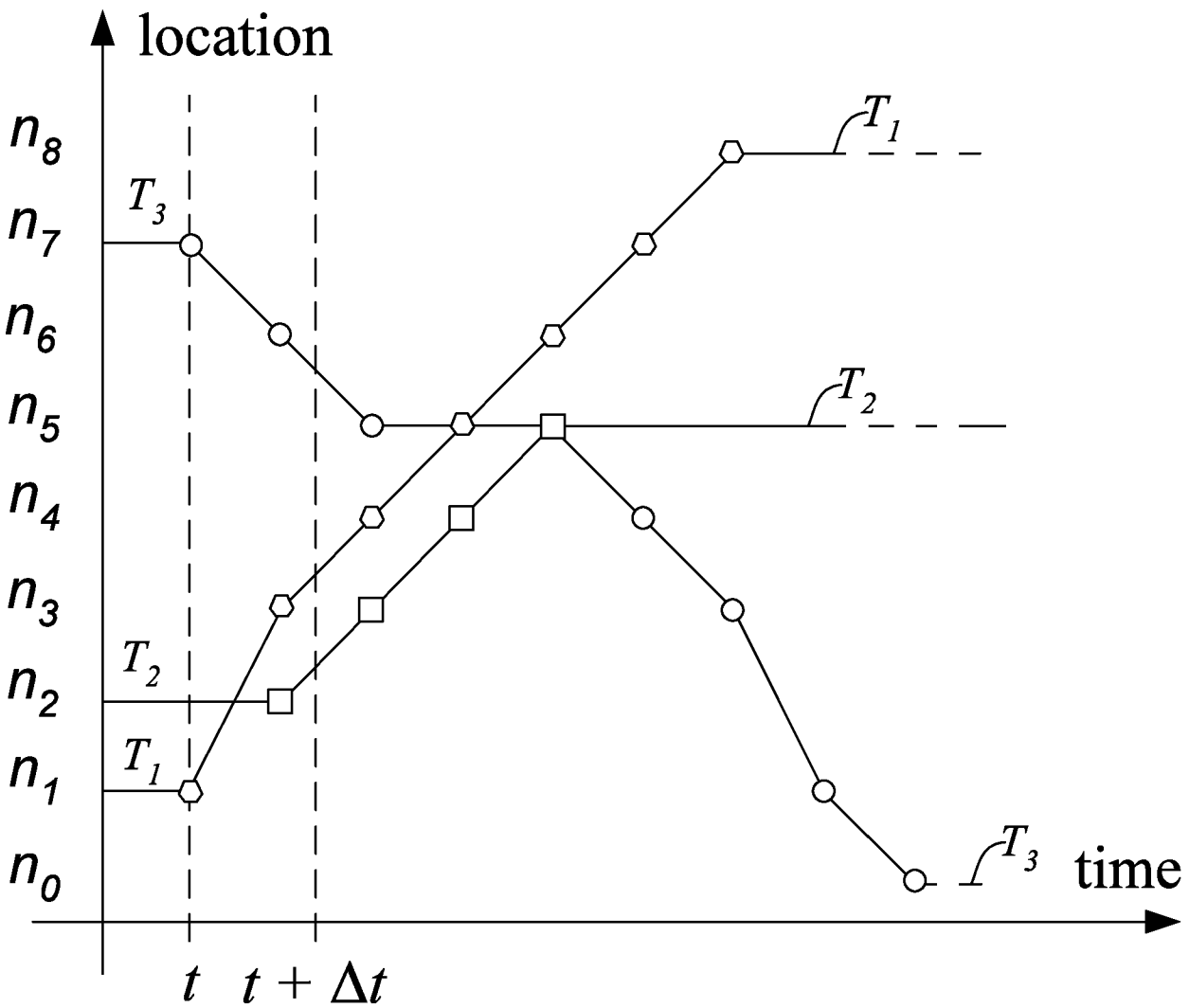
FIG. 19 is a train graph depicting a possible movement schedule for the model of FIG. 18.

Example 3.7 (Non-regressiveness). Consider again the example depicted in FIG. 13A. Application of Algorithm 2 in this situation can result in the horizons $$f_t = \begin{bmatrix} f_{T_1} \\ f_{T_2} \\ f_{T_3} \end{bmatrix} = \begin{bmatrix} 6 \\ 3 \\ 6 \end{bmatrix} \tag{12}$$

terminating at the nodes indicated with black dashed arrows in FIGS. 13A, 13B. Indeed, FIG. 19 presents a feasible movement schedule computed by solving P(t, $x_t$, $f_t$) from this state x, according to the horizons $f_t$ in (12).

Figure 18:
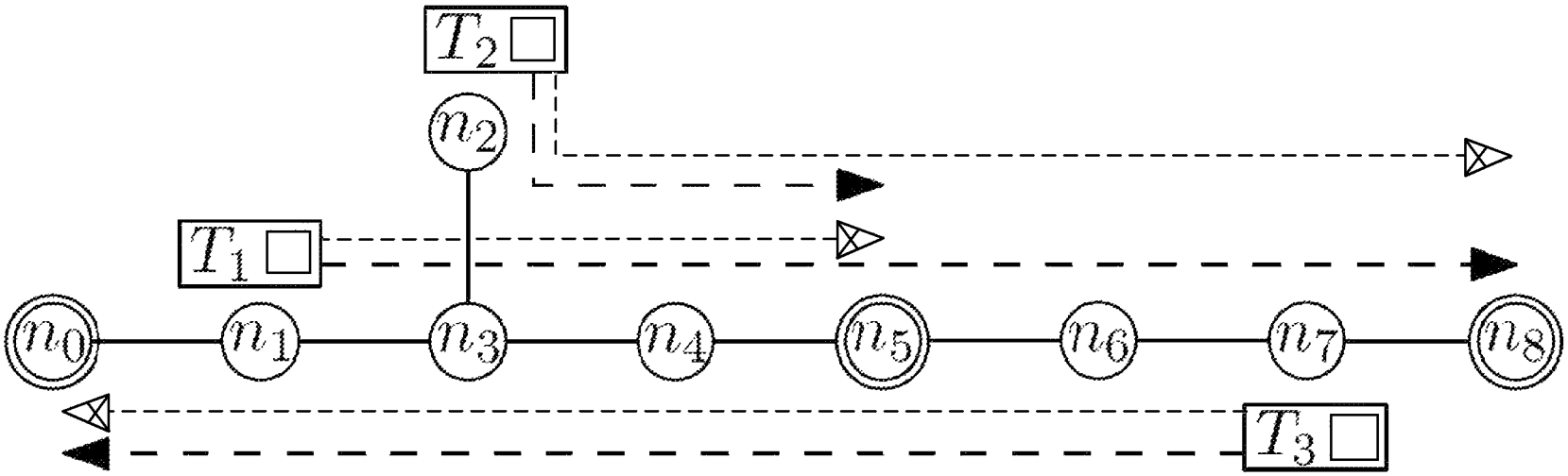
FIG. 18 is a model of a rail network system illustrating a scenario in which an assumption of non-regressiveness is violated.

Suppose that trains depart from their current location at time t according to this schedule, and at t+Δt the alternative horizons $$f_{t+\Delta t} = \begin{bmatrix} f_{T_1} \\ f_{T_2} \\ f_{T_3} \end{bmatrix} = \begin{bmatrix} 2 \\ 6 \\ 5 \end{bmatrix} \tag{13}$$

are selected, as indicated with cross-head dotted arrows in FIG. 18. The horizons in $f_{t+\Delta t}$ are safe but do not satisfy non-regressiveness: the movement was initiated with a horizon terminating at $n_8$ for $T_1$, while in this subsequent iteration it is regressed to $n_5$. Under these conditions we lose recursive feasibility: train $T_2$ has transit precedence over $T_1$ on shared segments, e.g. $z_{T_1, T_2, e_{34}}^{edge}=0$, but it is stopping at $n_5$, deadlocking $T_1$ and $T_3$ and, hence, ultimately resulting in an infeasible P(t+Δt, $x_{t+\Delta t}$, $f_{t+\Delta t}$).

Finally, note that the notion of safe states introduced in Definition 3.2 does not exclude the existence of more efficient definitions. Definition 3.2 is sufficient to guarantee recursive feasibility and works well for the freight network discussed in the results discussion Section 5. Alternative definitions might be devised for other networks; the only fundamental requirement is that a safe state must be endowed with a (usually trivial) policy that drives all trains from that safe state into a subsequent safe state, and that this policy can be applied recursively, ensuring that the system can be continuously operated for an "infinite" amount of time without deadlocking. This is accomplished by the (inefficient, but valid) policy described in Algorithm 1.

In the following section computational ramifications of recursive feasibility are discussed.

4. Computationally Efficient Optimization Approaches

As mentioned previously, the computation of solutions to P becomes a practical difficulty, in particular when the size of the network and number of trains is large. In this section several approaches to tackle this issue based on the previous section's results will be discussed.

A. Warm Starting

In warm starting solutions computed at t are reused at t+Δt as a system has moved from $X_t$ to $X_{t+\Delta}$t. We first illustrate how warm starting might fail when the conditions required by Theorem 3.6 are violated.

Figure 20:
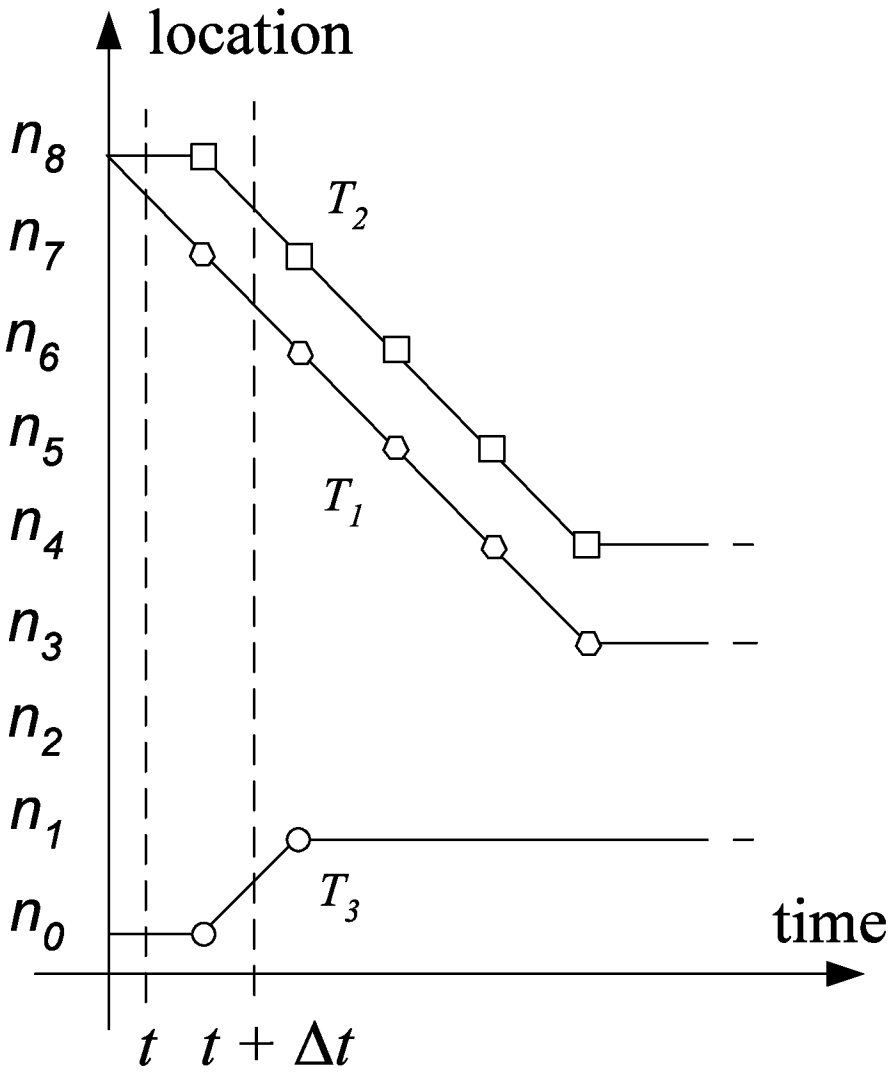
FIG. 20 is a train graph illustrating the effect of warm starting procedures according to embodiments of the invention.

Example 4.1 (Warm-starting). Consider the train graph depicted in FIG. 20 related to the network portion shown in FIG. 13A but with different initial trains positions. Final train destinations are {$T_1$: $n_0$, $T_2$: $n_2$, $T_3$: $n_5$}, but in the current optimization model horizons have been truncated as shown on the train graph. They do not satisfy safety as defined herein. According to this schedule, $T_1$ transits over $e_{45}$ before $T_2$. At t+Δt an optimization model is built with the horizon for $T_2$ extending to $n_2$ and $T_3$ to $n_5$. The only feasible sequence at this stage is for $T_2$ to transit over $e_{45}$ before $T_1$ which is not compatible with the previous solution. Note that the optimization model, in contrast to previous examples, is still feasible at t+Δt as $T_1$ and $T_2$ are still on time to invert transit order in the passing point at $n_5$, but the schedule computed at t is not a valid starting point to seed this optimization.

The procedures laid out in Theorem 3.6 for the construction of safe optimization horizons guarantee that warm starting can always be performed. That is, any solution to $P(t, x_t, f_t)$ when $P(t, x_t, f_t)$ is feasible and $f_t$ is computed according to Algorithm 2, can always be reused by scheduling machine 33 at $t+\Delta t$ as a partial solution to $P(t+\Delta t, X_{t+\Delta t}, f_{t+\Delta t})$. This is shown in the proof of the theorem, when a complete solution to $P(t+\Delta t, x_{t+\Delta t}, f_{t+\Delta t})$ is derived combining the procedure in Algorithm 1 with a solution to $P(t, x_t, f_t)$.

It should be noted that these partial solutions can either be enforced in the following optimization model $P(t+\Delta t, x_{t+\Delta t}, f_{t+\Delta t})$, in which case the size of the model to be solved is reduced, or used only as initialization points for solvers. Both can result in faster computations.

A by-product of this result is that Algorithm 2 can be substituted by the more efficient procedure in Algorithm 3 to compute $f_t$ when the preceding $f_{t-\Delta t}$ is available. In particular, this more effective procedure does not require one to verify the feasibility of $P(t, x_t, f_t)$ for a candidate $f_t$, as done on line 7 of Algorithm 2, since the generated $f_t$ is guaranteed to result in a feasible $P(t, x_t, f_t)$. This is true because, as discussed in Remark 3.5, having established that $P(t-\Delta t, x_{t-\Delta t}, f_{t-\Delta t})$ is feasible automatically ensures the feasibility of $P(t, x_t, f_t)$ for $f_t \geq f_{t-\Delta t}$. Strictly speaking, Remark 3.5 ensures the feasibility of $P(t-\Delta t, x_{t-\Delta t}, f_t)$ which, in turn, ensures the required feasibility.

Algorithm 3 Warm-Started Computation of f

Required: $ft-\Delta t$ and $n_{i,i-\Delta t}$, the node sequence (1) of train $i \in I$ at $t-\Delta t$.
1: $\eta_n \leftarrow |L_n|, \forall n \in N$
2: for all $i \in I$ do
3: $f_i \leftarrow k_i[n_{i,t-\Delta t}[ft-\Delta t]]$ $k_i[n]$ is the index of node n in $n_{i,t}$
4: while $\eta_{n_i}[f_i] \leq 1$ do
5: $f_i\ f_i + 1$
6: $\eta_{n_i}[f_i] \leftarrow \eta_{n_i}[f_i] - 1$ B. Anytime Approaches A direct consequence of the results in Section 3 and 4-A is that feasible solutions for arbitrary horizons lengths at subsequent iterations can be obtained without performing optimizations. Namely, once an initial feasible solution to a safe state is found, cf. line 7 of Algorithm 2, that solution remains valid at $t+\Delta t$ according to the discussion in Section 4-A. It can then easily be extended into a solution to any arbitrarily long optimization horizon which satisfies the condition of being safe by application of Algorithm 1. This guarantees that at $t+\Delta t$ a complete feasible solution to $P(t+\Delta t, x_{t+\Delta t}, f_{t+\Delta t})$ is available before any optimization is performed. Solvers can thus always be seeded with an initial feasible solution, and since all results herein do not rely on optimality, the solution progress can be interrupted at any time returning valid schedules.

The quality of the solutions recovered with this approach depends on the quality of the heuristic utilized to move trains from safe state to safe state. The policy in Algorithm 1 is evidently suboptimal. It could be improved, for instance, by moving all trains that do not interact which each other at the same time. Generally, designing efficient movement schedules between safe states appears to be simpler than working with generic initial and terminal states.

C. Time-Wise Problem Decomposition

One important ramification of Theorem 3.6 is that scheduling machine 33 can be configured to calculate a feasible solution to $P(t, x_t, f_t)$, for any arbitrarily long safe optimization horizon $f_t$, by solving a sequence of smaller optimization models, each of which incrementally considers an additional portion of time. More precisely, if $(\bar{y}, \bar{z})$ is any (not necessarily optimal) feasible solution to $P(t, x_t, f_t)$ then the values of $(\bar{y}, \bar{z})$ are also valid for the optimization problem $P(t, x_t, \tilde{f}_t)$ where $\tilde{f}_t \geq f_t$ as long as $\tilde{f}_t$ is safe. That is, the values of $(\bar{y}, \bar{z})$ can be forced unto the corresponding variables of $P(t, x_t, \tilde{f}_t)$ and the latter remains feasible.

This is true because scheduling machine 33 can always construct a feasible solution to $P(t, x_t, \tilde{f}_t)$ by extending a solution to $P(t, x_t, f_t)$ to any non-regressive safe horizon $\tilde{f}_t \geq f_t$ by application of the trivial policy in Algorithm 1, thus guaranteeing feasibility.

Since all variables $(\bar{y}, \bar{z})$ may be forced, feasibility guarantees are preserved when only a subset of them are forced; in particular, only the binary variables z can be forced, for example. Further, since $(\bar{y}, \bar{z})$ drives the system into a safe state, which might not be an efficient network state, variables close to the end of the optimization horizon of the current iteration can be excluded from the variables forced on subsequent models. Finally, rather than forcing values, this procedure can be used to seed valid initial values for the binary variables in the model.

Note that the chances of time-wise decomposition working on extensive networks with large fleets are exceedingly low when not enforcing safe horizons. As traffic density increases, the likelihood of at least one train terminating at a node that impedes the transit of other trains in subsequent steps also increases (e.g., dwelling on a single slot node).

D. Train-Wise Problem Decomposition

Figure 3:
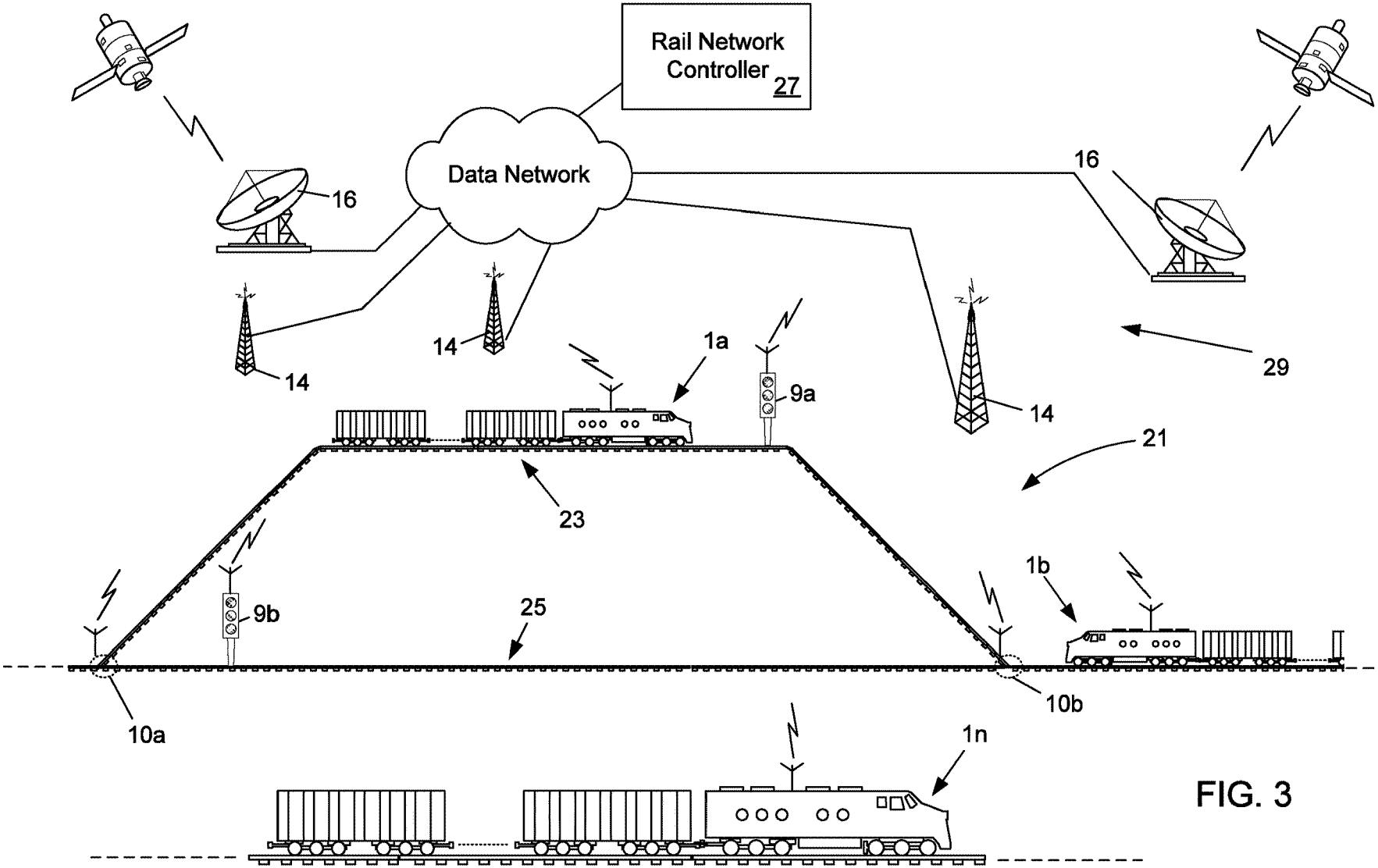
FIG. 3 is a block diagram a rail network in use.
Figure 4:
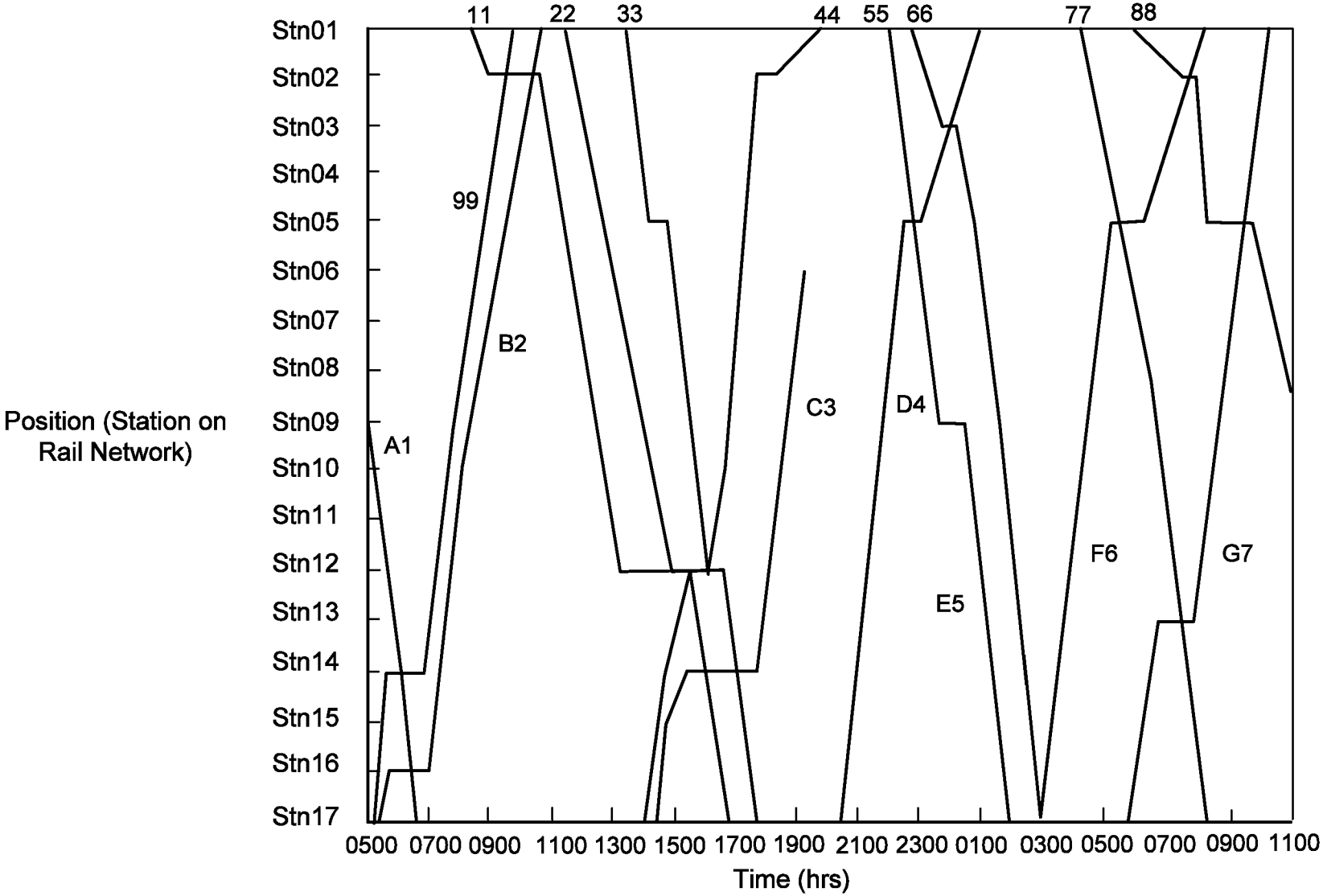
FIG. 4 is an example of a stringline plot train schedule.

The Inventors have found that a consequence of the results in Section 3-A is that, under certain provisions, it is possible to solve P by considering only portions of the train fleet, e.g. trains 1*a*, . . . , 1*n* of FIG. 3, at a time. Namely, let $P_{I_0}$ and $P_{I_1}$, be instances of P only entailing trains in $I_0 \subseteq I$ and $I_1 \subseteq I$ respectively. Conditions ensuring that the corresponding sub-solutions $(\bar{z}_i)_{i \in I_0}$ and $(\bar{z}_i)_{i \in I_1}$ constitute a valid partial solutions to $P_{I_0 \cup I_1}$ will now be discussed. Note that we restrict this analysis to the binary variables z.

Two specific procedures enabled by this result are as follows:

i. I is partitioned into non-overlapping subsets, i.e., $I_i \cap I_j = \emptyset$ for all partitions $I_i$ and $I_j$. This decomposition allows the construction of a partial feasible solution to P by solving the independent sub-models $P_{I_i}$ in parallel.
ii. I is decomposed into incrementally larger subsets, i.e., $I_0 \subseteq I_1 \subseteq \ldots \subseteq I_N$. This decomposition produces solutions to P by considering subsets of trains that are progressively enlarged. If $I_N \equiv I$, this procedure computes the complete set of variables z for P.

In both cases, at each iteration the size of the problems to be solved are smaller than the full-scale model P.

An example illustrating that, as expected, this is generally not possible will now be provided. However, a way in which adjustments may be made to boundary conditions to resolve the underlying issue will also be discussed.

Figure 21A:
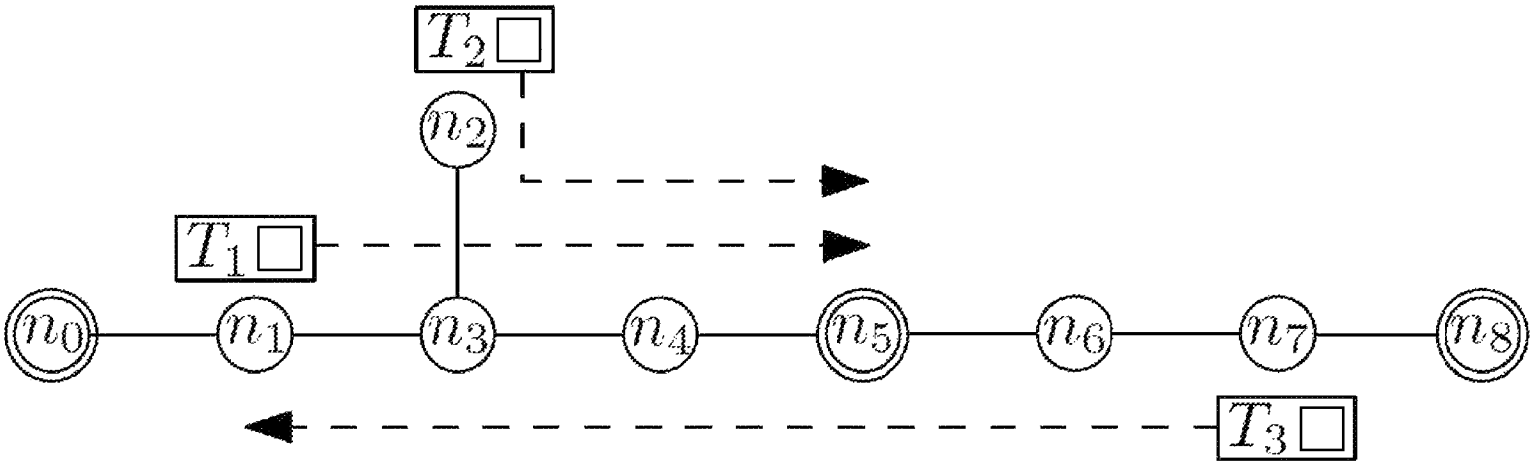
FIG. 21A is a model including a graph being the same as that of FIG. 13B for illustrating a train-wise decomposition procedure.
Figure 21B:
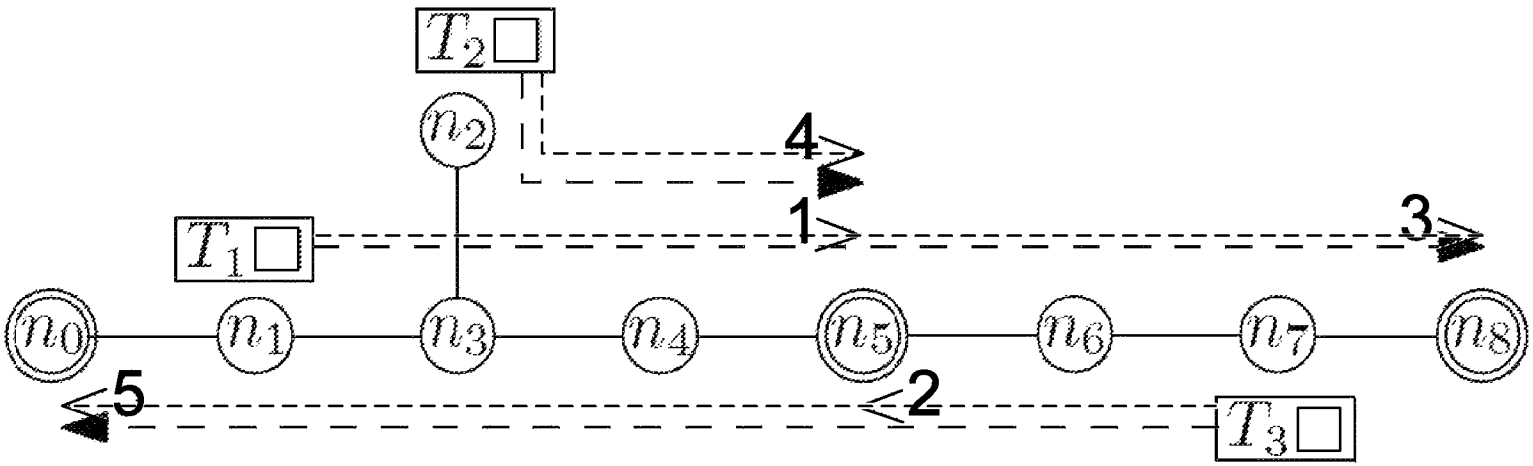
FIG. 21B further illustrates the train-wise decomposition procedure.

Example 4.2. Consider again the example depicted in FIGS. 13A, 13B, and the corresponding model in FIG. 21A, in which initial optimization horizons are shown. Under these circumstances, the only feasible sequence of train movements is to move $T_1$ to node $n_5$ first, then $T_3$ to $n_1$ and finally $T_2$ to $n_5$. Suppose, however, that procedure ii. is followed, with the following arbitrary sequence of subsets of I: $I_0=\{T_2, T_3\}$, $I_1=\{T_1, T_2, T_3\} \equiv I$. The optimization model $P_{I_0}$ is not aware of $T_1$, and it can thus elect to give precedence to $T_2$ over $T_3$, i.e., to set $z_{T_2, T_3, e_{45}}^{edge}=1$. Freezing this value for $z_{T_2,T_3,e_{45}}^{edge}$ would render the subsequent optimization model $P_{I_1}$ infeasible, where $T_1$ is introduced and $I_1$ is considered. FIG. 21B illustrates how setting $z_{T_2,T_3,e_{45}}^{edge}=1$ can be resolved in a feasible schedule when horizons are extended to terminate in a safe state. Note that the initial state of the trains is exactly the same as in FIG. 21A.

To see how the desired result might be possible more generally, we first observe that movements of individual trains are almost entirely independent of each other in Algorithm 1. Note that the algorithm assumes that initial and final states are safe. The only coupling between trains in the policy occurs when a train i is moved to its destination node n, resulting in all slots in n to be occupied. In this case the policy, as presented, does enforce a specific transit order for scheduling trains by requiring j, another train at node n that hasn't been moved yet, to be moved next. Note, however, that it would be possible to rectify this by delaying the departure of all—or any subset—of the trains already processed ($I\backslash I^{open}$) and move j first. The node at which j arrives can itself then be fully occupied, but as before, a train that hasn't moved yet must exist at this node and hence the same procedure can be re-applied. These recursive iterations must terminate because the number of trains that haven't been moved yet is finite.

This demonstrates that the policy can be adapted to return a train transit schedule by processing trains in any sequence and/or independently of each other, provided boundary conditions adhere to safe state requirements. It thus follows that precedences in instances of P, in which initial and final states are safe, can be solved by considering conflicts of subsets of trains in any order and, hence, both decomposition schemes mentioned above can be applied. The modified procedure does, however, also require the ability to modify y through iterations, which is why the analysis in this section is exclusively valid for z.

Example 4.2 violated the assumption on boundary conditions, both for the initial as well the final states. Adjusting the terminal conditions was sufficient to recover feasibility. It is generally possible to make this adjustment whenever optimization horizons can be stretched far enough to reach a safe state, which is always possible under the assumption of infinite capacity at the terminals.

To guarantee that the procedure succeeds in all cases, however, we need to address initial conditions as well.

One approach is to run Algorithm 2, which outputs a minimal safe horizon $f_t$ together with a feasible solution to $P(t, x_t, f_t)$ and only consider the output $f_t$. Solve problem $P(t, x_t, \tilde{f}_t)$ for any safe $\tilde{f}_t \geq f_t$ using either procedure i. or ii. but, at each iteration, only freeze optimization variables indexed from $f_t$ onwards; all other variables, which concern the schedule from the trains' current position to the horizon $f_t$, need to be left open as optimization variables. They can, however, be seeded with the values obtained in previous iterations, which, as noted above, will often be a valid initialization point. This is guaranteed to work because running Algorithm 2 ensures that a feasible schedule exists from the trains' current position to $f_t$. As long as the existence of at least one solution is guaranteed, the model can be extended from that point using either procedure i) or ii) into a feasible solution to $P(t, x_t, \tilde{f}_t)$ for any arbitrary $\tilde{f}_t \geq f_t$ that is safe.

An alternative approach is to first construct a feasible schedule from the trains' current state into a safe state. One way to obtain this is to run Algorithm 2 and consider both the horizon $f_t$ as well as the feasible solution to $P(t, x_t, f_t)$. We can then solve the problem $P(t, x_t, \tilde{f}_t)$ to any arbitrary $\tilde{f}_t \geq f_t$ by following procedures i. or ii. Note that this approach, however, forces the system to pass through the safe state determined by solving $P(t, x_t, f_t)$.

The Inventors have found that this approach works independently of the extent of the network and the complexity of its topology. It is also independent of the train fleet size. The only relevant factors are the initial and terminal conditions, the approach works for any arbitrary complexity degree of traffic patterns between those boundary conditions.

The Inventors have found that that the quality of the schedules obtained with this model decomposition depends on the size and sequence of the subsets of I used in the iterations.

Figure 22:
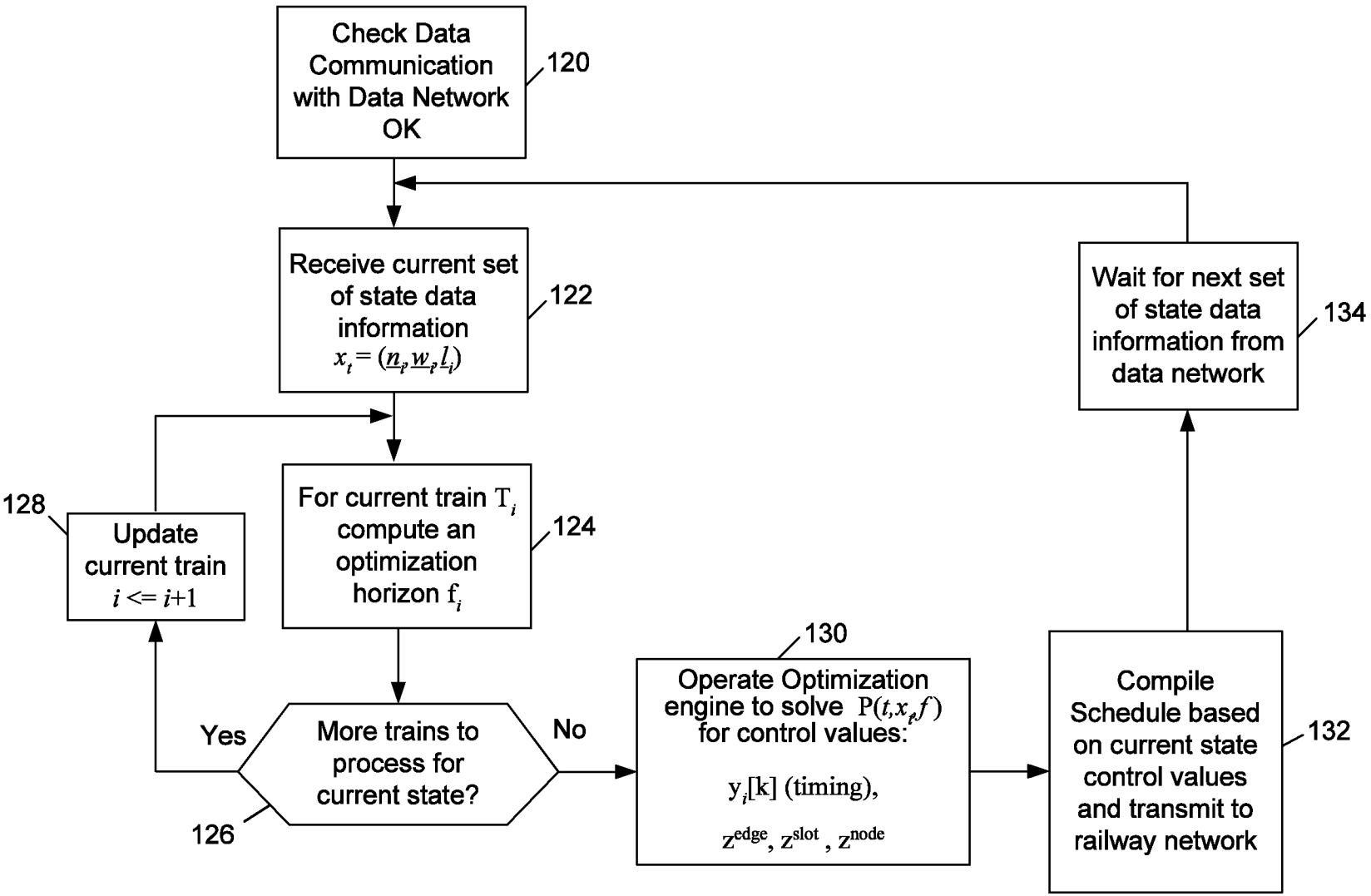
FIG. 22 is a flowchart of a method according to an embodiment of the present invention.

FIG. 22 is a flowchart of a method according to an embodiment of the invention. Δt box 120 the scheduling machine 33 (FIG. 5) checks that data communication with data communications system 29 is active. At box 122 the scheduling machine 33 receives a state report comprising the current set of state data information $xt=(\underline{n}_i, \underline{w}_i, \underline{l}_i)_{i\in I}$ for the railway network 21. At box 124, for a current train (which will initially be the first train to be processed) the scheduling machine 33 computes an optimization horizon, for example by executing instructions in scheduling software 40 to implement Algorithm 2.

At decision box 126, control diverts to box 128 where counter variable i is incremented so that box 124 determines an optimization horizon for the next train. Once all trains have been processed to determine their associated optimization horizons for the current state the procedure proceeds to box 130.

At box 130 the scheduling machine 33 implements the optimization engine 41 to solve the model P for the current state using the optimization horizons that have been determined at box 124. The optimization engine finds controls in the form of timing $y_i[k]$ for the train, e.g. a time for the train to commence movement from its current position, and also $z^{edge}$, $z^{slot}$ and $z^{node}$ controls which dictate which edge node and slot on the node the train should proceed to.

At box 132 scheduling machine 33 compiles a schedule based on the control values that have been determined at box 132 for all of the trains for the current state. The schedule, e.g. S1 of FIG. 5 is then transmitted back to the data communications network, for example for use by rail network controller 27 (FIG. 5). The procedure then moves to box 132 and waits for the next set of state data, defining the next state of the railway network to arrive. Once that arrives the next state is set to the current state and the procedure moves to box 122 and then repeats as previously discussed.

How the control values $y_i[k]$ and $z^{edge}$, $z^{slot}$ and $z^{node}$ are used depends the deployment of the network 21.

For example, the schedules S1, . . . , Sm may be displayed on monitors of computers in the rail network controller 27 to train controllers (people that sit in front of screens and operate on computers in the rail network controller to effect changes in signals 9 and switches 10 (e.g. switch 10*a* of FIGS. 5A, 5B) of railway network 21 to effect changes for the trains. In that case the human controllers look at the schedules, and implement them by manual input of parameters such as traffic signal states).

Figure 26:
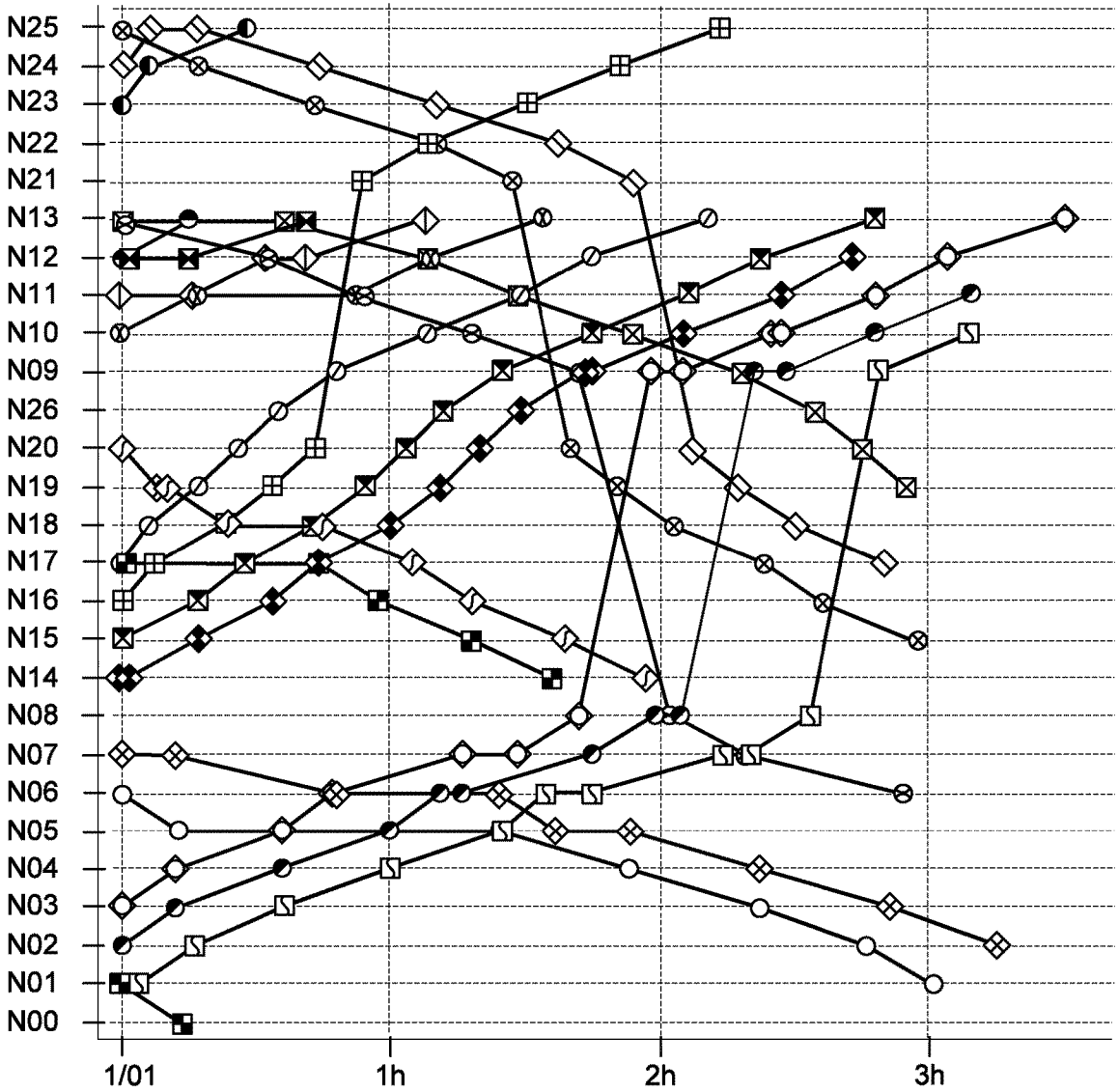
Figure 29:
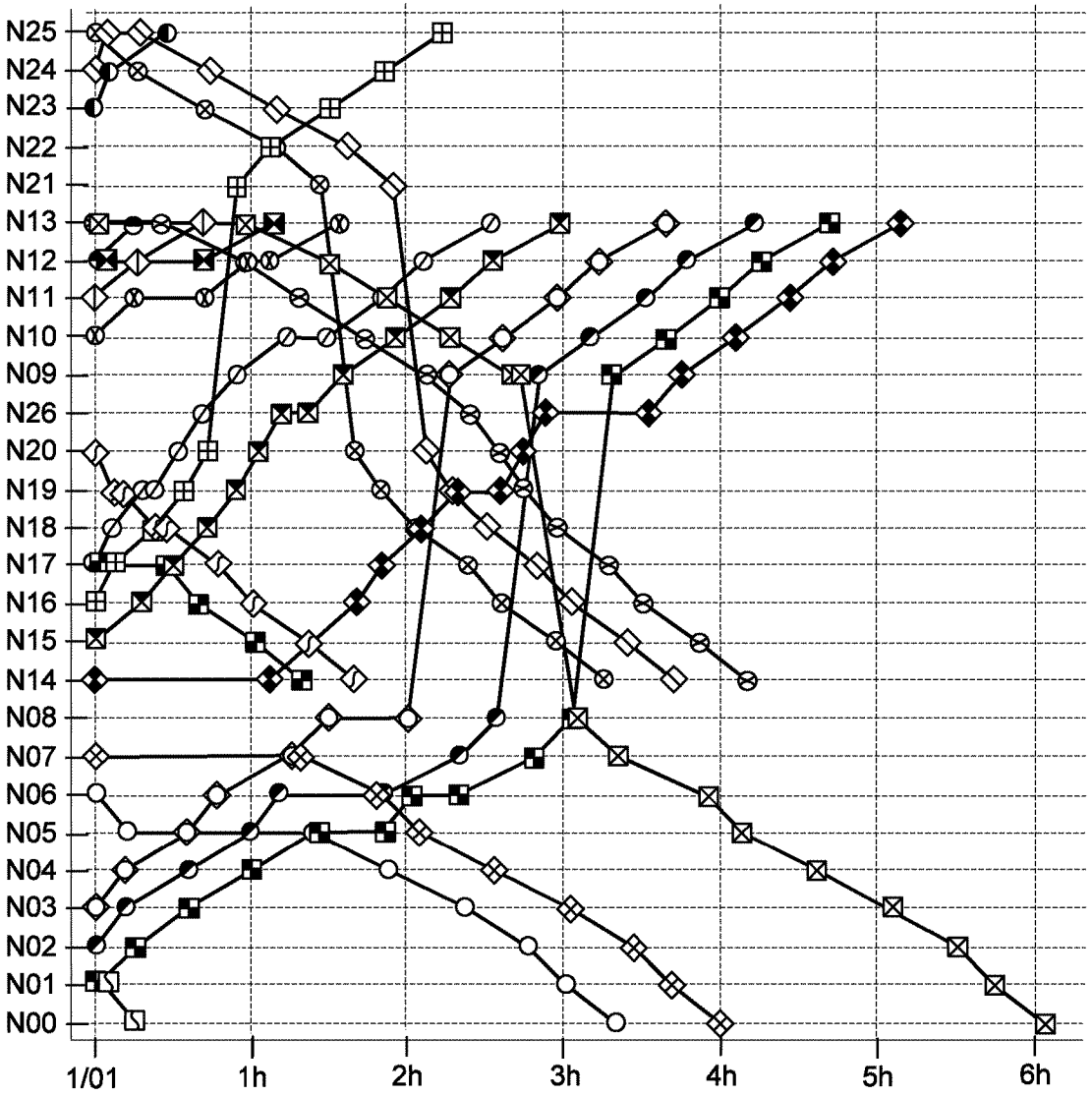
Figure 30A:
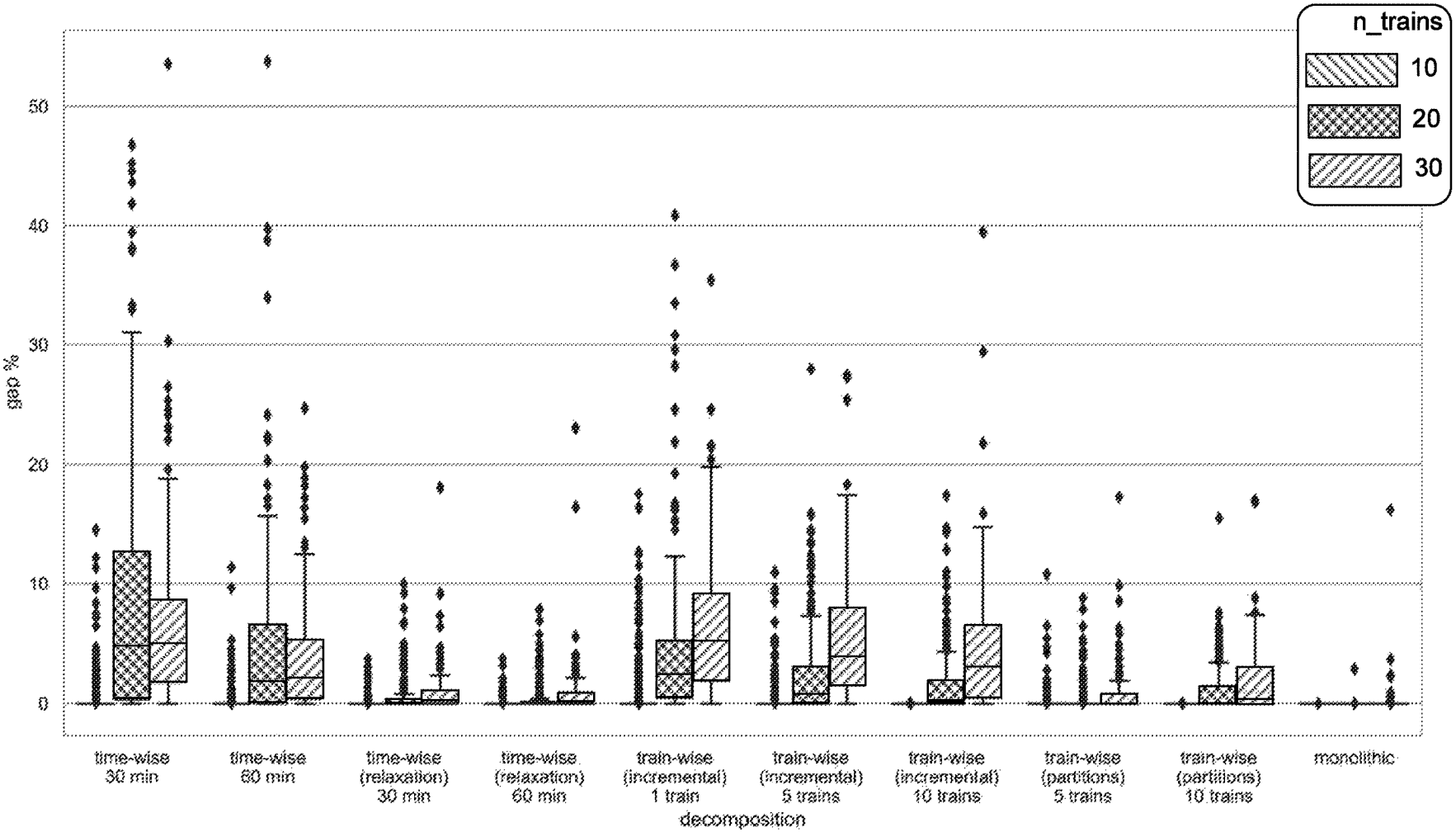
FIGS. 30A and 30B are graphs displaying sensitivity of the operation of the scheduling machine to traffic levels in a 27-node network.
Figure 30B:
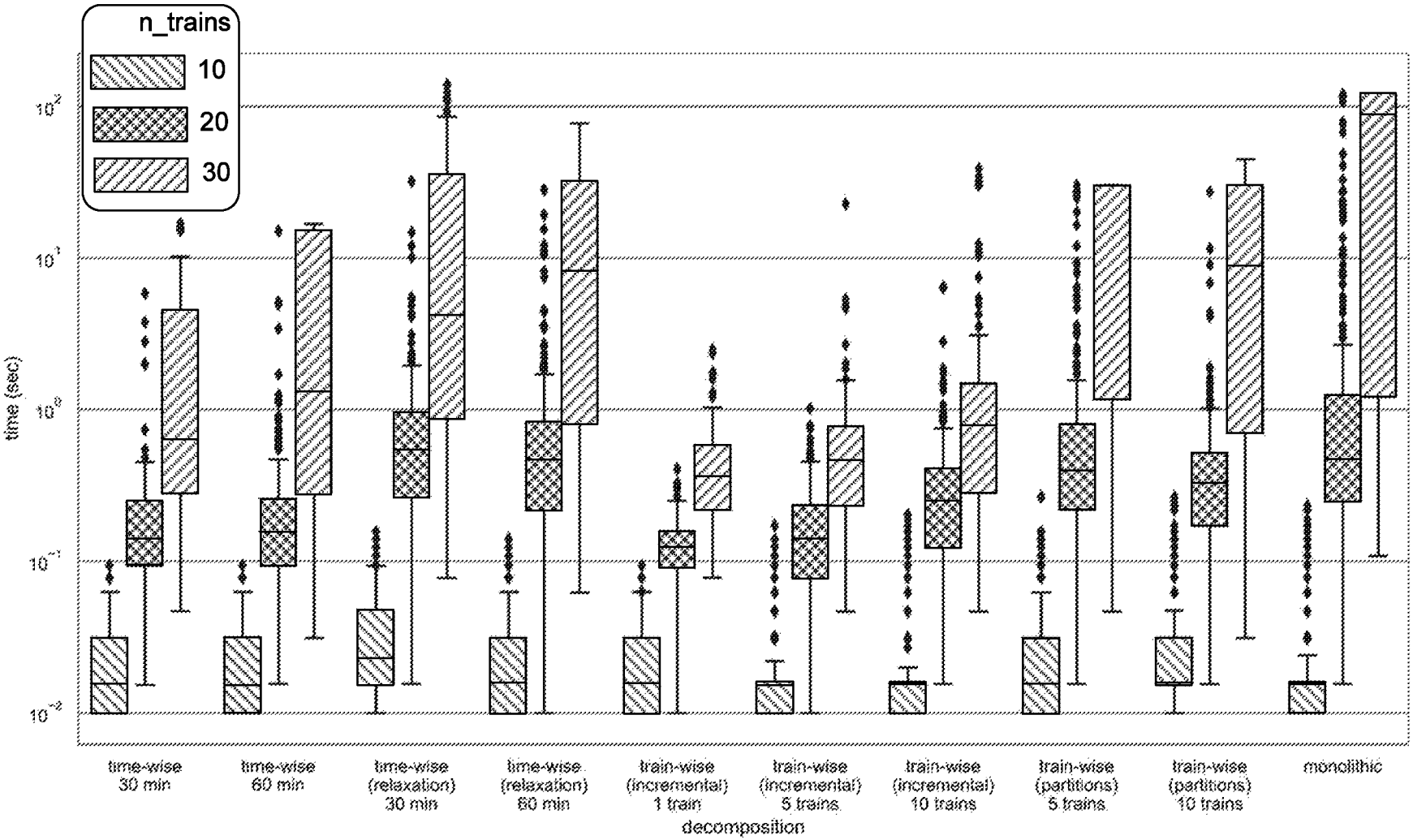
Figure 31A:
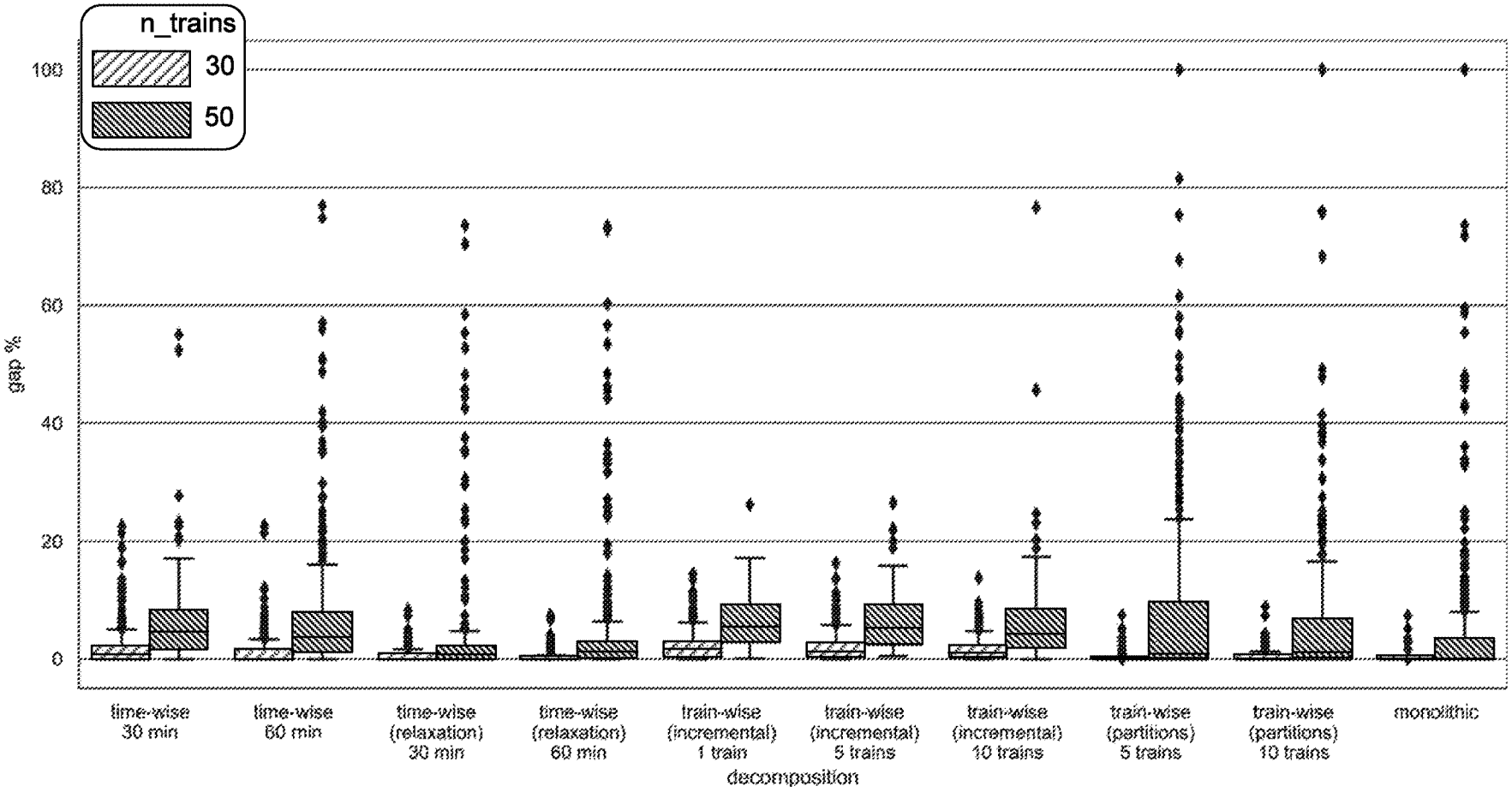
FIGS. 31A and 31B are graphs displaying sensitivity of the operation of the scheduling machine to traffic levels in a 69-node network.
Figure 31B:
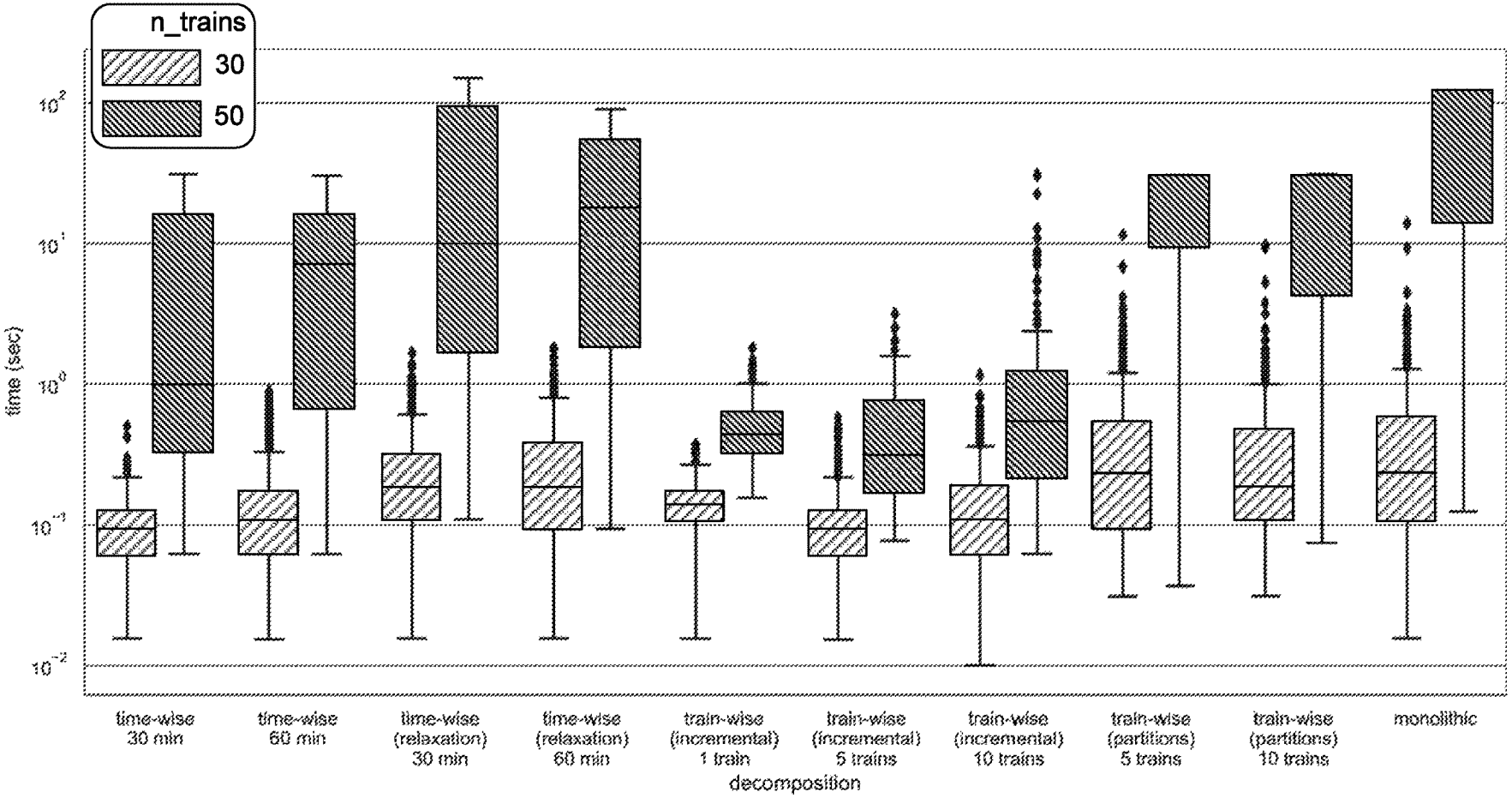

In this context, for those binary variables: the stringlines that are produced, e.g. as shown in FIGS. 26 and 29, which will be discussed, do not explicitly display the value of z-slot. The z-node binary variable can be thought of as an auxiliary variable needed by the model and is in some sense displayed because you can see what train transits first over a node (e.g. stations on the vertical axis of a stringline). The z-edge variable may be considered as usually the most important quantity since it contains information as to which train transits first over an edge and is essentially the dominant feature show discernible in the stringline plots that are generated.

In other embodiments the scheduling machine 33 may control the railway network 21 in an autonomous fashion in which point z-slot information can be used and mapped to a control, e.g. switches 10 (such as switch 10 of FIGS. 5A, 5B and signalling lights 9*a*, 9*b*), that deviate a train into a desired location such as a siding or a mainline.

5. Testing and Results

Figure 23:
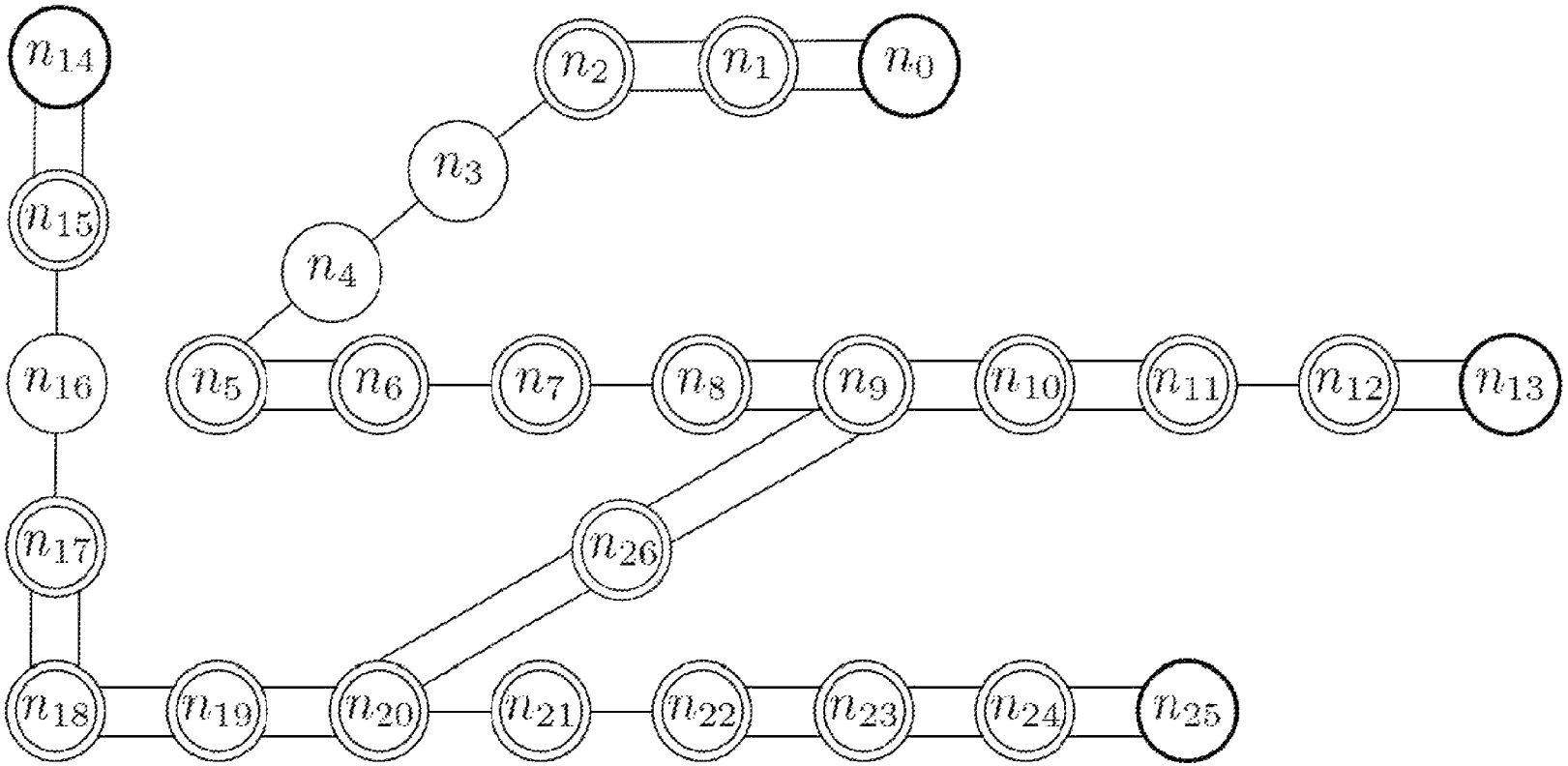
FIG. 23 is a graph of a model for a railway network that is used as an example of operation of the scheduling machine.

Scheduling machine 33 was tested in different configurations on two networks. The first network was modelled with a graph comprising 27 nodes, displayed in FIG. 23. Testing was also performed in respect of a second network modelled with a graph of 69 nodes corresponding to railway system operating in the Pilbara region of Australia for freight transport of mineral ore. The travel times over the edges for the first network with 27 nodes are randomly distributed between 5 and 20 minutes.

Figure 24:
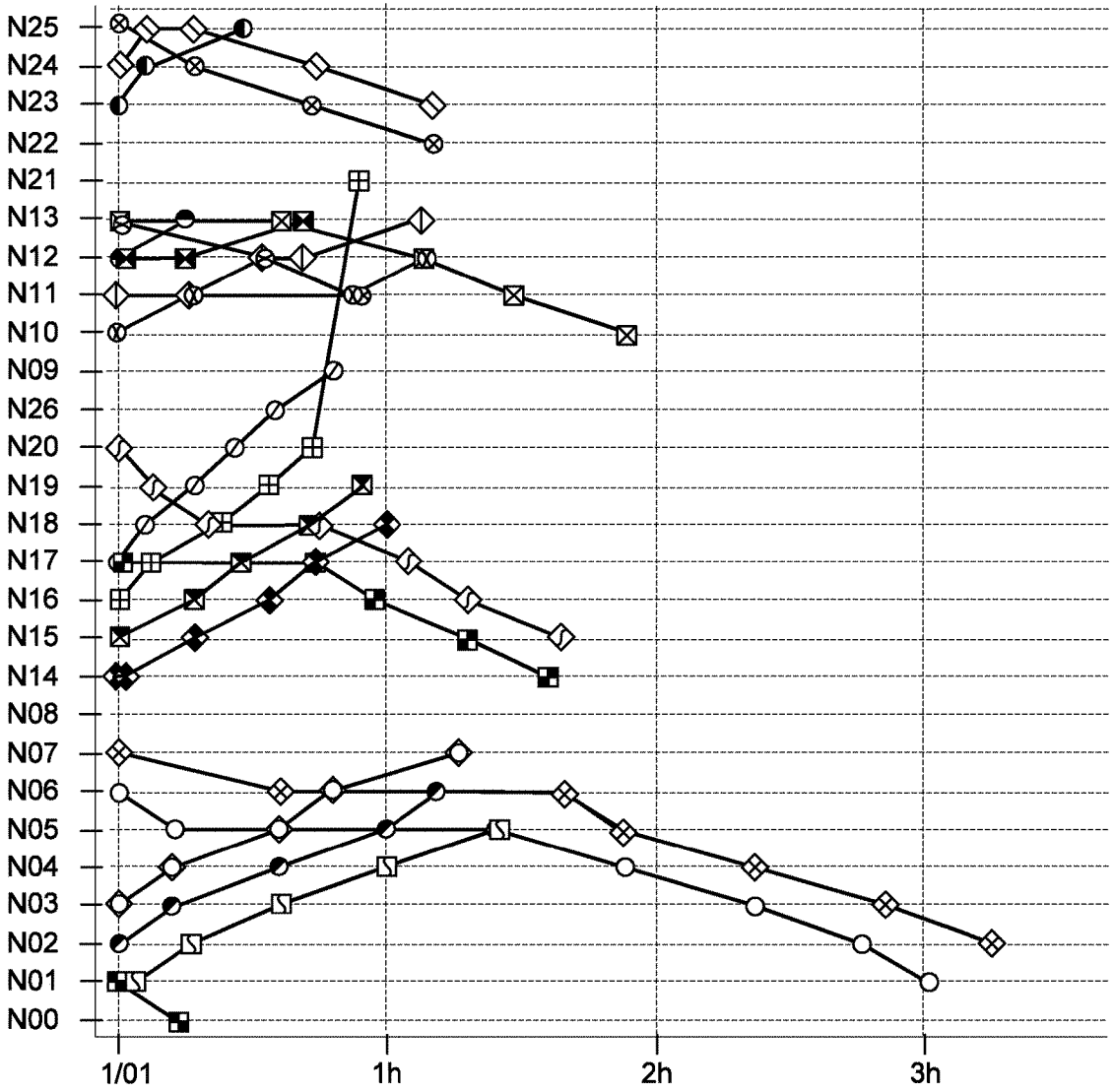
FIGS. 24-26 are stringline charts displayed as screens on electronic displays under control of the scheduling machine, progressively illustrating generation of a train schedule with the scheduling machine implementing a time-wise decomposition solution method.
Figure 25:
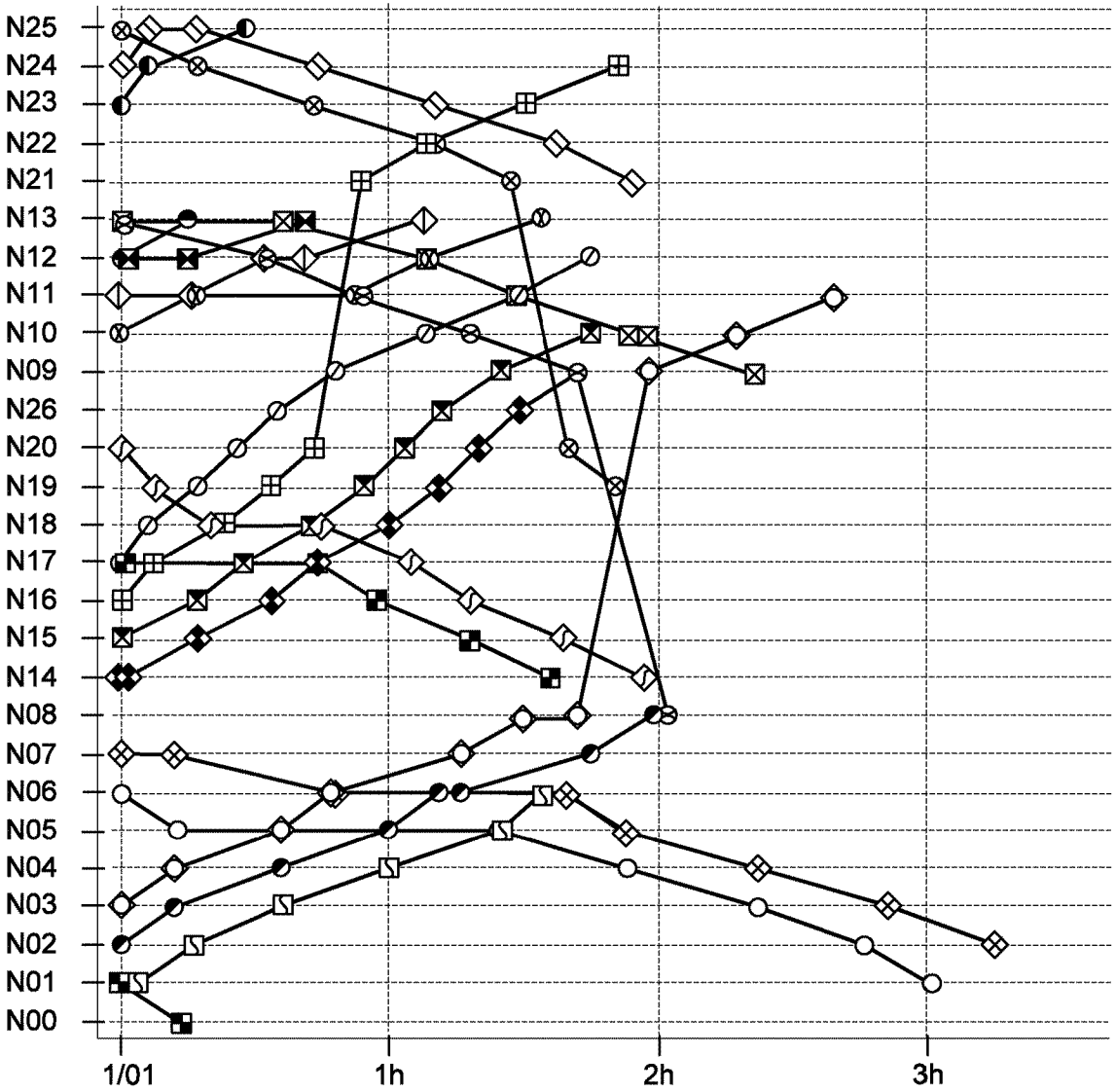

Scheduling machine 33 was tested whilst varying the number of trains present in the network to assess the sensitivity of computations to traffic levels. For the network with 27 nodes, 10 (moderate traffic), 20 (high traffic) and 30 trains (very high traffic-more trains than nodes), were considered. For the 69-node network, 30 and 50 trains on the network were tested. For each network and train number combination, 500 random initial positions of trains were created. For each random initial condition, P (eqn (11)) was solved using the processing methods presented in the previous section:

Time-wise decomposition. In time-wise decompositions, the results in Section 4-C were utilized. Three iterations of the time-wise decomposition solution approach that were implemented by scheduling machine 33 are illustrated in the stringlines generated in FIGS. 24-26. At each step, the movements schedule is extended by at least 60 minutes. Note in the first iteration (FIG. 24) how the horizon for the trains departing from N6 and N7 is extended further than the rest: after 60 minutes, they would occupy N5 and N6, both of which have two slots but are already terminal for the trains departing from N1 and N2. Nodes N3 and N4 have only one slot so they cannot function as terminal nodes. Horizons are consequently extended up to N1 and N2, both of which have two slots and are not terminal for other trains. The optimization model is split into segments of 30 and 60 minutes, that is, the model is optimized considering a number of edges that is increased at each step in a way that ensures that the total unimpeded travel time is increased by at least 30 or 60 minutes for each train, and extend those further to accommodate for finite, safe horizons. A variant ("relaxation") was also considered where at each step enforcement of binary variables was relaxed for the last 15 minutes of the previous solution but, instead, they were used only as an initialization point.

Figure 27:
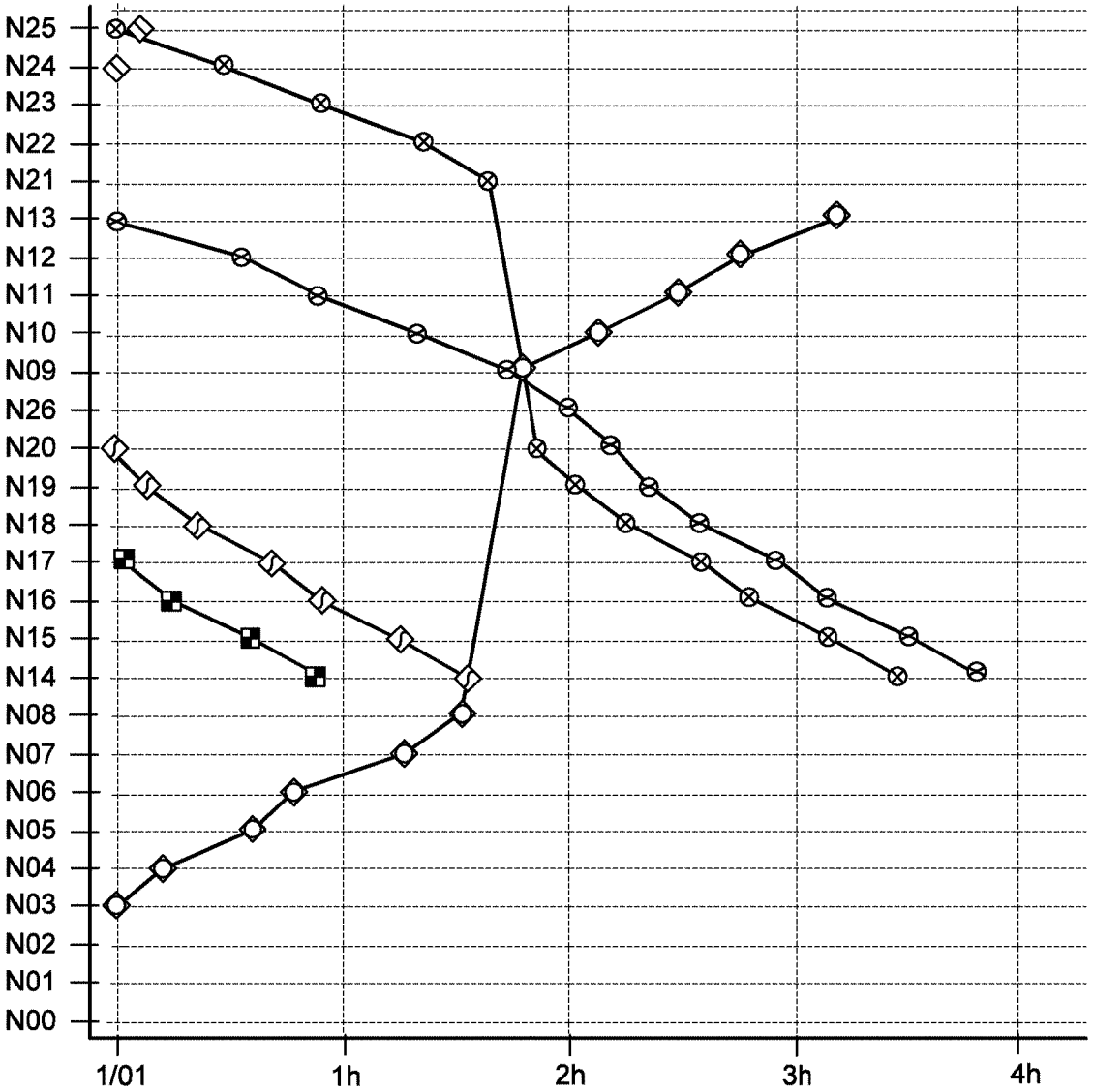
FIGS. 27-29 are stringline charts displayed as screens on electronic displays controlled by the scheduling machine, progressively illustrating generation of a train schedule with the scheduling machine implementing a train-wise decomposition solution method.
Figure 28:
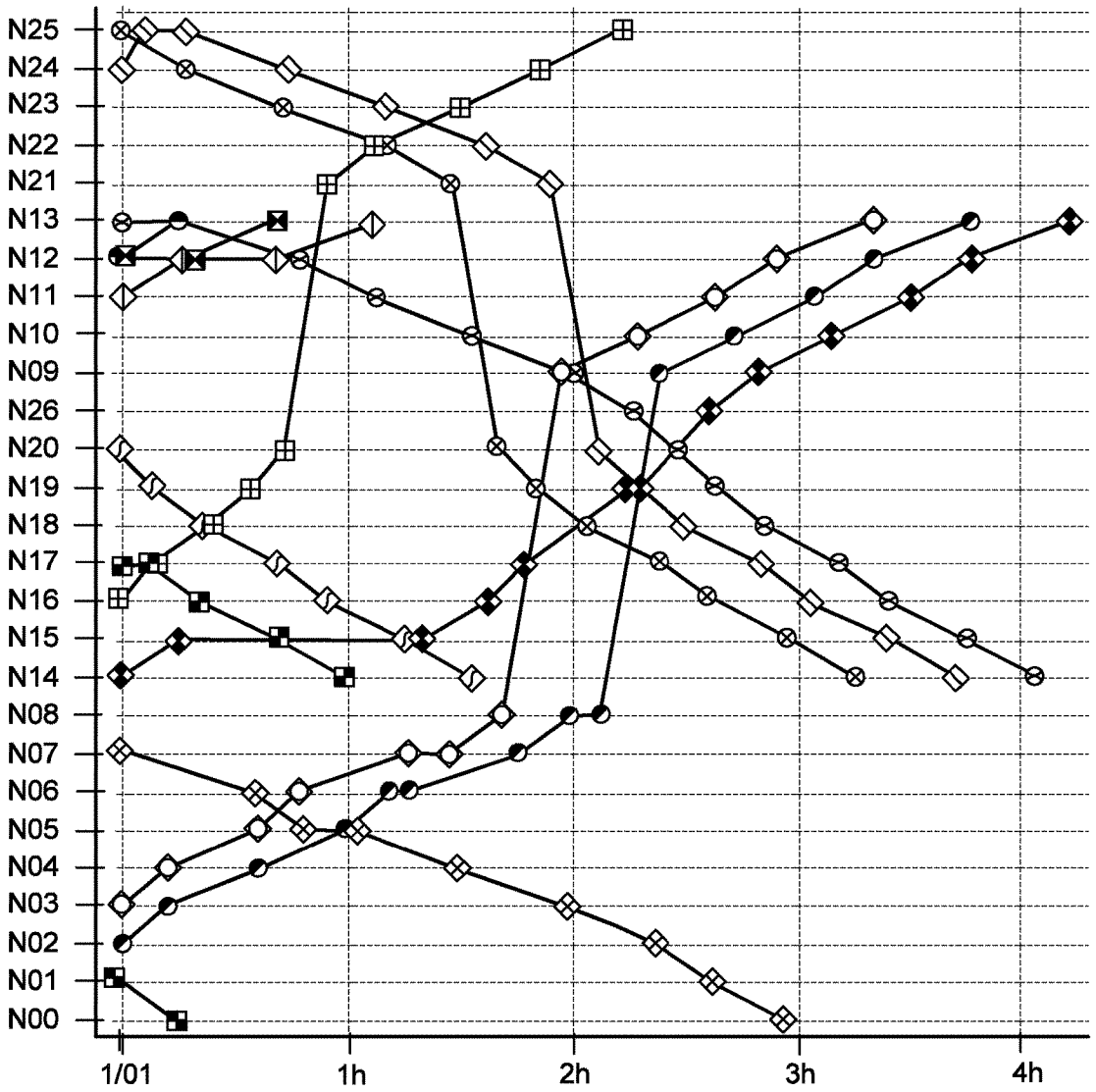

Train-wise decomposition. In train-wise decompositions, the procedures from Section 4-D were utilized to configure the scheduling machine 33. Three iterations of the time-wise decomposition solution approach by the scheduling machine 33 are illustrated in the stringlines generated in FIGS. 27-29. $\Delta t$ each iteration, the scheduling machine 33 added an additional subset of trains to the model while previously established precedences are frozen.

The "incremental" version refers to variant i., while "partitions" corresponds to variant ii. Experiments were run with varying sizes of the train subsets considered at each step. To make comparisons fair, since the "partitions" strategy only recovers a partial solution to P, a last step was performed by scheduling machine 33 in which that partial solution is enforced into the full model P to retrieve a complete solution. The trains selected to be within the next subset at each iteration were chosen randomly for this test.

Monolithic. In the monolithic version, P is solved as a single optimization model until the incumbent solution has a guaranteed optimality gap of less than 0.1% or 120 seconds have elapsed, whichever occurs first.

The results of these experiments are presented in FIGS. 30A, 30B and 31A, 31B, for 27 and 69 nodes networks respectively. All optimizations were performed using a scheduling machine implementing a Gurobi optimization engine with 16 GB of RAM, and an Intel i7-6700K CPU clocking at 4.00 GHz running Linux Ubuntu 16.04.4 LTS operating system. Computation times presented in the results only consider the time spent performing optimizations (total Gurobi runtime), as the time spent setting up the various algorithms is highly dependent on implementation details and does not entail exponential complexities (as opposed to solving mixed-integer models). Computation times are floored at 0.01 sec to enable logarithmic plotting.

For the first network and moderate traffic case (10 trains), all methods quickly ($\leq$0.1 sec) solve the model to optimality in the vast majority of cases. For cases with higher traffic, it is possible to distinguish a trade-off between computation time and solution quality. Approaches with higher compute times are generally producing higher quality solutions and vice-versa. The monolithic variant tends to produce solutions with lowest optimality gaps, while median compute times for incremental variants of train-wise decompositions are two orders of magnitude faster, while retaining (in median) optimality gaps of 5% or less.

Computational constraints for the network with 69 nodes make this a more challenging set of instances, especially the experiments involving 50 trains. For this case, the monolithic approach caps at the maximum allowed compute time of 120 seconds in the majority of instances, and presents several outliers with high optimality gaps. Incremental train-wise decompositions with 1 and 5 trains per subset significantly outperform this approach in terms of worst-case optimality gap while being more than two orders of magnitude faster in terms of median computation times.

The results indicate that problems' hardness is very strongly related to the traffic density in the network: significant increases in compute times can be observed for all algorithms on both networks as the number of trains is increased. In particular, median compute times for the monolithic variant grow in excess of an order of magnitude at each higher level of traffic density for both networks. Note also that compute times for the synthetic network with 30 trains are approximately an order of magnitude slower than for the 69 nodes network with the same number of trains. This is to be expected as the number of conflicts (and hence binary variables) grows with increased interactions between the trains.

Comparing time-wise decompositions, we note that performing relaxations drastically improves solutions' quality, while retaining median compute times that are approximately one order of magnitude faster than the monolithic approach for the cases with the highest traffic. Improved quality is likely due to the fact that solutions are not forced through a safe state at the end of each solution step.

Train-wise decomposition with partitions tend to require more computations than the incremental variant and this is mainly due to the last step, in which a full solution is computed from a partial one. All prior steps, involving separate and independent partitions, compute very quickly.

The following articles are each incorporated herein in their entireties by reference.

1. Natashia L Boland and Martin W P Savelsbergh, *Optimizing the hunter valley coal chain*, Supply Chain Disruptions, Springer, 2012, pp. 275-302.
2. Francesco Borrelli, Alberto Bemporad, and Manfred Morari, *Predictive control for linear and hybrid systems*, Cambridge University Press, 2017.
3. Gabrio Caimi, Martin Fuchsberger, Marco Laumanns, and Marco Lu¨thi, *A model predictive control approach for discretetime rescheduling in complex central railway station areas*, Computers & Operations Research 39 (2012), no. 11, 2578-2593.
4. Eduardo F Camacho and Carlos Bordons Alba, *Model predictive control*, Springer Science & Business Media, 2013.
5. Andrea D'Ariano, Francesco Corman, Dario Pacciarelli, and Marco Pranzo, *Reordering and local rerouting strategies to manage train traffic in real time*, Transportation science 42 (2008), no. 4, 405-419.
6. Andrea D'ariano, Dario Pacciarelli, and Marco Pranzo, *A branch and bound algorithm for scheduling trains in a railway network*, European Journal of Operational Research 183 (2007), no. 2, 643-657.
7. B De Schutter and T Van Den Boom, *Model predictive control for railway networks*, Advanced Intelligent Mechatronics, 2001. Proceedings. 2001 IEEE/ASME International Conference on, vol. 1, IEEE, 2001, pp. 105-110.
8. Bart De Schutter, T Van den Boom, and A Hegyi, *Model predictive control approach for recovery from delays in railway systems*, Transportation Research Record: Journal of the Transportation Research Board (2002), no. 1793, 15-20.
9. Paolo Falcone, Francesco Borrelli, Jahan Asgari, Hongtei Eric Tseng, and Davor Hrovat, *Predictive active steering control for autonomous vehicle systems*, IEEE Transactions on control systems technology 15 (2007), no. 3, 566-580.
10. Rob M P Goverde, *Railway timetable stability analysis using max-plus system theory*, Transportation Research Part B: Methodological 41 (2007), no. 2, 179-201.
11. *A delay propagation algorithm for large-scale railway traffic networks*, Transportation Research Part C: Emerging Technologies 18 (2010), no. 3, 269-287.
12. Inc. Gurobi Optimization, *Gurobi optimizer reference manual,* 2016.
13. Ali E Haghani, *Rail freight transportation: a review of recent optimization models for train routing and empty car distribution*, Journal of Advanced Transportation 21 (1987), no. 2, 147-172.
14. Pavle Kecman, Francesco Corman, Andrea D'Ariano, and Rob M P Goverde, *Rescheduling models for railway traffic management in large-scale networks*, Public Transport 5 (2013), no. 1-2, 95-123.
15. Michael Kettner, Bernd Sewcyk, and Carla Eickmann, *Integrating microscopic and macroscopic models for railway network evaluation*, Proceedings of the European transport conference, 2003.
16. Gregor Klancar and Igor Skrjanc, *Tracking-error model-based predictive control for mobile robots in real time*, Robotics and autonomous systems 55 (2007), no. 6, 460-469.
17. Manfred Morari and Jay H Lee, *Model predictive control: past, present and future*, Computers & Chemical Engineering 23 (1999), no. 4-5, 667-682.
18. Tomii Norio, Tashiro Yoshiaki, Tanabe Noriyuki, Hirai Chikara, and Muraki Kunimitsu, *Train rescheduling algorithm which minimizes passengers' dissatisfaction*, International Conference on Industrial, Engineering and Other Applications of Applied Intelligent Systems, Springer, 2005, pp. 829-838.
19. S Joe Qin and Thomas A Badgwell, *A survey of industrial model predictive control technology*, Control engineering practice 11 (2003), no. 7, 733-764.
20. Stefan Richter, S´ebastien Mari´ethoz, and Manfred Morari, *High-speed online mpc based on a fast gradient method applied to power converter control*, American Control Conference (ACC), 2010, IEEE, 2010, pp. 4737-4743.
21. Thomas Schlechte, Ralf Bornd¨orfer, Berkan Erol, Thomas Graffagnino, and Elmar Swarat, *Micro-macro transformation of railway networks*, Journal of Rail Transport Planning & Management 1 (2011), no. 1, 38-48.
22. Tom Schouwenaars, Jonathan How, and Eric Feron, *Decentralized cooperative trajectory planning of multiple aircraft with hard safety guarantees*, AIAA Guidance, Navigation, and Control Conference and Exhibit, 2004, p. 5141.
23. Leena Suhl, Claus Biederbick, and Natalia Kliewer, *Design of customer-oriented dispatching support for railways*, Computer-Aided Scheduling of Public Transport, Springer, 2001, pp. 365-386.
24. Johanna T´ornquist and Jan A Persson, *N-tracked railway traffic re-scheduling during disturbances*, Transportation Research Part B: Methodological 41 (2007), no. 3, 342-362.
25. T J J Van den Boom and B De Schutter, *On a model predictive control algorithm for dynamic railway network management,* 2nd International Seminar on Railway Operations Modelling and Analysis (Rail-Hannover2007), 2007.
26. Frederic Herbert Georges Weymann and Ekkehard Wendler, *Qualita¨t von heuristiken in der disposition des eisenbahnbetriebs*, Tech, report, Lehrstuhl fu¨r Schienenbahnwesen und Verkehrswirtschaft und Verkehrswissenschaftliches Institut, 2011.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described herein comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms. The Abstract of the invention as lodged with this specification is hereby incorporated herein by reference.

Features, integers, characteristics, moieties or groups described in conjunction with a particular aspect, embodiment or example of the invention are to be understood to be applicable to any other aspect, embodiment or example described herein unless incompatible therewith.

Any embodiment of the invention is meant to be illustrative only and is not meant to be limiting to the invention. Therefore, it should be appreciated that various other changes and modifications can be made to any embodiment described without departing from the scope of the invention.

The invention claimed is:

1. A railway system comprising:

a railway network including, a plurality of blocks of rails and a number of trains located thereon; and one or more positioning assemblies for determining positions of each train;

a data communication system for transmitting state data defining states of the railway network at respective times;

a model of the railway network stored in an electronic data source, the model defining locations in the railway network allowing passing of the trains and paths for journeys of each of the trains; and a scheduling machine in communication with the data communication system for receiving the state data, the scheduling machine including:

one or more processors; and an electronic memory in communication with the one or more processors containing instructions for the one or more processors to:

access the model of the railway network stored in the electronic data source;

apply the state data to the model to determine, at each of the respective times, controls associated with the path for each of the trains;

determine the controls by optimizing an objective function for the trains, taking into account said locations in the railway network, positions of the trains and paths of each of the trains; and transmit the controls to the railway network for controlling movement of the trains; wherein the electronic memory contains instructions for the processors to determine the controls to control movement of the trains according to an optimization horizon, for each of the trains along its path, wherein the optimization horizon extends to at least one location allowing passing of the trains to thereby avoid deadlock of the trains on the railway network.

2. The railway system of claim 1, wherein the controls include timings for movements of the trains.

3. The railway system of claim 1, wherein the controls specify positions for each train at the locations in the railway network.

4. The railway system of claim 3, wherein the controls specify a position comprising a siding at the railway network location.

5. The railway system of claim 1, wherein the electronic memory contains instructions for the one or more processors to apply control signals based on the controls to traffic controllers of the railway network.

6. The railway system of claim 5, wherein the traffic controllers include signal lights for timing the movement of the trains.

7. The railway system of claim 5, wherein the traffic controllers include switches for directing trains to the positions at the locations in the railway network.

8. The railway system of claim 1, wherein the electronic memory contains instructions for the processors to transmit a series of train schedules comprising the controls.

9. The railway system of claim 8, wherein the electronic memory contains instructions for the one or more processors to display the train schedules as stringline plots on electronic displays for reference of human operators.

10. The railway system of claim 1, wherein the electronic memory contains instructions for the one or more processors to determine the controls by optimizing an objective function for the trains comprises minimizing total travel time of the trains.

11. The railway system of claim 1, wherein the electronic memory contains instructions for the one or more processors to determine said optimization horizon for each train in the railway system upon determining that the railway system is in a safe state.

12. The railway network of claim 11, wherein the electronic memory contains instructions for the one or more processors to iteratively extend the optimization horizon for each train in the safe state until it reaches a node of the model, such that a state of the system would be safe if the trains transited up to that node from respective current positions thereof.

13. The railway network of claim 12, wherein the electronic memory contains instructions for the processors to extend the optimization horizon for each train until the determined optimization horizon is solvable to obtain a feasible solution for the model.

14. The railway system of claim 1, wherein the electronic memory contains instructions for the one or more processors to determine if the railway network is in a non-deadlocked state.

15. The railway system of claim 1, wherein the electronic memory contains instructions for the one or more processors to apply a time-wise problem decomposition procedure comprising optimizing the objective function by optimizing objective functions for each of a sequence of smaller models for incremental additional portions of time.

16. The railway system of claim 1, wherein the electronic memory contains instructions for the one or more processors to apply a train-wise problem decomposition procedure comprising optimizing the objective function by considering only portions of the number of trains at a time.

17. The railway system of claim 1, wherein the electronic memory contains instructions for the one or more processors to implement an optimization engine for optimizing the objective function for the trains.

18. A method for operating a railway network having a number of trains, the method comprising:

operating a scheduling machine in communication with the railway network over a data communication system to receive time separated state data defining states of the railway network at respective times;

operating the scheduling machine to access a model of the railway network stored in an electronic data source, the model defining locations in the railway network allowing passing of the trains and paths for journeys of each of the trains;

operating the scheduling machine to apply the state data to the model to determine, at each of the respective times, controls associated with the path for each of the trains;

wherein the scheduling machine is operated to determine said controls by optimizing an objective function for the trains, taking into account said locations in the railway network, positions of the trains and paths of each of the trains and by determining controls to control movement of the trains according to an optimization horizon, for each train along its path, wherein the optimization horizon extends to at least one railway network location allowing passing of the trains for avoidance of deadlocking in the railway network; and transmitting the controls via the data communication system to control movement of the trains through the railway network based on the controls.

19. The method of claim 18, wherein the controls include timings for movements of the trains.

20. The method of claim 18, wherein the controls include positions for the trains at the locations in the railway network.

21. The method of claim 20, wherein the positions for the trains at the locations in the railway network include a siding.

* * * * *